US009498873B2

(12) United States Patent
Kato et al.

(10) Patent No.: US 9,498,873 B2
(45) Date of Patent: Nov. 22, 2016

(54) STAPLER

(71) Applicant: MAX CO., LTD., Tokyo (JP)

(72) Inventors: Yutaka Kato, Tokyo (JP); Suguru Miwa, Tokyo (JP)

(73) Assignee: MAX CO., LTD., Tokyo (JP)

( * ) Notice: Subject to any disclaimer, the term of this patent is extended or adjusted under 35 U.S.C. 154(b) by 808 days.

(21) Appl. No.: 13/764,879

(22) Filed: Feb. 12, 2013

(65) Prior Publication Data

US 2013/0206810 A1 Aug. 15, 2013

(30) Foreign Application Priority Data

Feb. 15, 2012 (JP) ..... 2012-030917

(51) Int. Cl.

| | |
|---|---|
| ***B25C 5/02*** | (2006.01) |
| *B42B 5/04* | (2006.01) |
| *B42B 4/00* | (2006.01) |

(52) U.S. Cl.

CPC ..... *B25C 5/0257* (2013.01); *B25C 5/02* (2013.01); *B25C 5/025* (2013.01); *B42B 4/00* (2013.01); *B42B 5/04* (2013.01)

(58) Field of Classification Search

CPC ..... B25C 5/16; B25C 5/02; B42B 4/00; B42B 5/00; B42B 5/04; B42B 5/11; B42B 5/02

USPC ..... 227/68, 76, 71, 77, 119, 120, 136; 412/36, 38

See application file for complete search history.

(56) References Cited

U.S. PATENT DOCUMENTS

| | | | | |
|---|---|---|---|---|
| 7,021,512 | B1 | 4/2006 | Nakamura | |
| 7,644,851 | B2 * | 1/2010 | Sugihara | B27F 7/19 227/155 |
| 2009/0136324 | A1 | 5/2009 | Aoki et al. | |

FOREIGN PATENT DOCUMENTS

| | | | | | |
|---|---|---|---|---|---|
| CN | 1852791 | A | | 10/2006 | |
| JP | A-2001-300865 | | | 10/2001 | |
| JP | 2002-168216 | A | | 6/2002 | |
| JP | 2007-167978 | A | | 7/2007 | |
| JP | 2007-185727 | A | | 7/2007 | |
| JP | 2007-185820 | A | | 7/2007 | |
| JP | 2007175785 | A | * | 7/2007 | |
| JP | A-2007-185728 | | | 7/2007 | |
| JP | 2008-044058 | A | | 2/2008 | |
| JP | 2008-044187 | A | | 2/2008 | |
| JP | 4654916 | B2 | | 1/2011 | |
| JP | 2012-016794 | A | | 1/2012 | |
| WO | WO 2007072979 | A2 | * | 6/2007 | B42B 5/08 |
| WO | WO 2007/081034 | A2 | | 7/2007 | |
| WO | WO 2008018509 | A1 | * | 2/2008 | B27F 7/21 |
| WO | WO 2010/143448 | A1 | | 12/2010 | |

* cited by examiner

*Primary Examiner* — Hemant M Desai
*Assistant Examiner* — Eduardo R Ferrero
(74) *Attorney, Agent, or Firm* — Drinker Biddle & Reath LLP

(57) ABSTRACT

A stapler is provided with a penetrating part including a pair of cutting blades which are disposed at an interval in a second direction. Holes are formed in sheets and a pair of leg portions of a staple penetrate the sheets by penetrating and withdrawing the cutting blades into and from the sheets in the first direction. An interval in the second direction between the pair of cutting blades at a tip end sides in the first direction is narrower than an interval in the second direction between the pair of cutting blades at base end sides which are opposite to the tip end sides in the first direction.

5 Claims, 90 Drawing Sheets

STAPLER

BACKGROUND OF THE INVENTION

Field of the Invention

The present invention relates to a stapler capable of stapling a workpiece using non-metal staples.

Related Art

Conventionally, there has been proposed a stapler capable of stapling a workpiece using staples made of a non-metal material which is a soft material, such as paper, instead of metal staples. A stapler using metal staples is configured to penetrate the workpiece using a staple element, but a stapler using staples made of a non-metal material which is a soft material, such as paper, includes insert blades for forming holes in the workpiece, by which the workpiece is formed with holes by the insert blades, and leg portions of the staples penetrate the holes.

The stapler including the insert blades and using the staples made of the non-metal material which is the soft material is configured to hold the staples between two insert blades in a state in which a pair of leg portions of the staple are arranged along each insert blade, and to drive the staple against the workpiece together with the insert blades to allow the one pair of leg portions of the staple to penetrate the workpiece.

As a configuration of holding the staple at the insert blades, JP-A-2002-168216 and JP-A-2007-167978 proposes a structure in which a boss for holding a tip end of the leg portion of the staple is provided on an inner surface of the insert blade.

In the structure, when the boss provided on the inside of the insert blade passes the workpiece by an operation of the insert blade penetrating the stapling blade and an operation of the insert blade leaving from the workpiece, a resistance between the insert blade and the workpiece is increased. In a stapler operated by a human power, if the resistance between the insert blade and the workpiece is increased, it causes a load to increase in push-down operation and returning operation of an operating handle.

Further, when the boss provided on the inside of the insert blade passes the workpiece, an inside of the hole is torn off. For this reason, when the leg portions of the staple are bent, there is a convex portion causing the leg portions or the like to deform, which deteriorates appearance of the staple stapling the workpiece.

SUMMARY OF THE INVENTION

One or more embodiments of the invention relates to a stapler capable of decreasing a resistance when blade portions for penetrating leg portions of a staple penetrate a workpiece, and improving appearance of the staple binding the workpiece.

BRIEF DESCRIPTION OF THE DRAWINGS

FIG. 25(*b*) is an explanatory diagram illustrating a variation of the cutting blade.

DETAILED DESCRIPTION OF THE EMBODIMENTS

An exemplary embodiment of a stapler will be described with reference the accompanying drawings.

<Exemplary Configuration of Stapler of the Embodiment>

Figure 1:
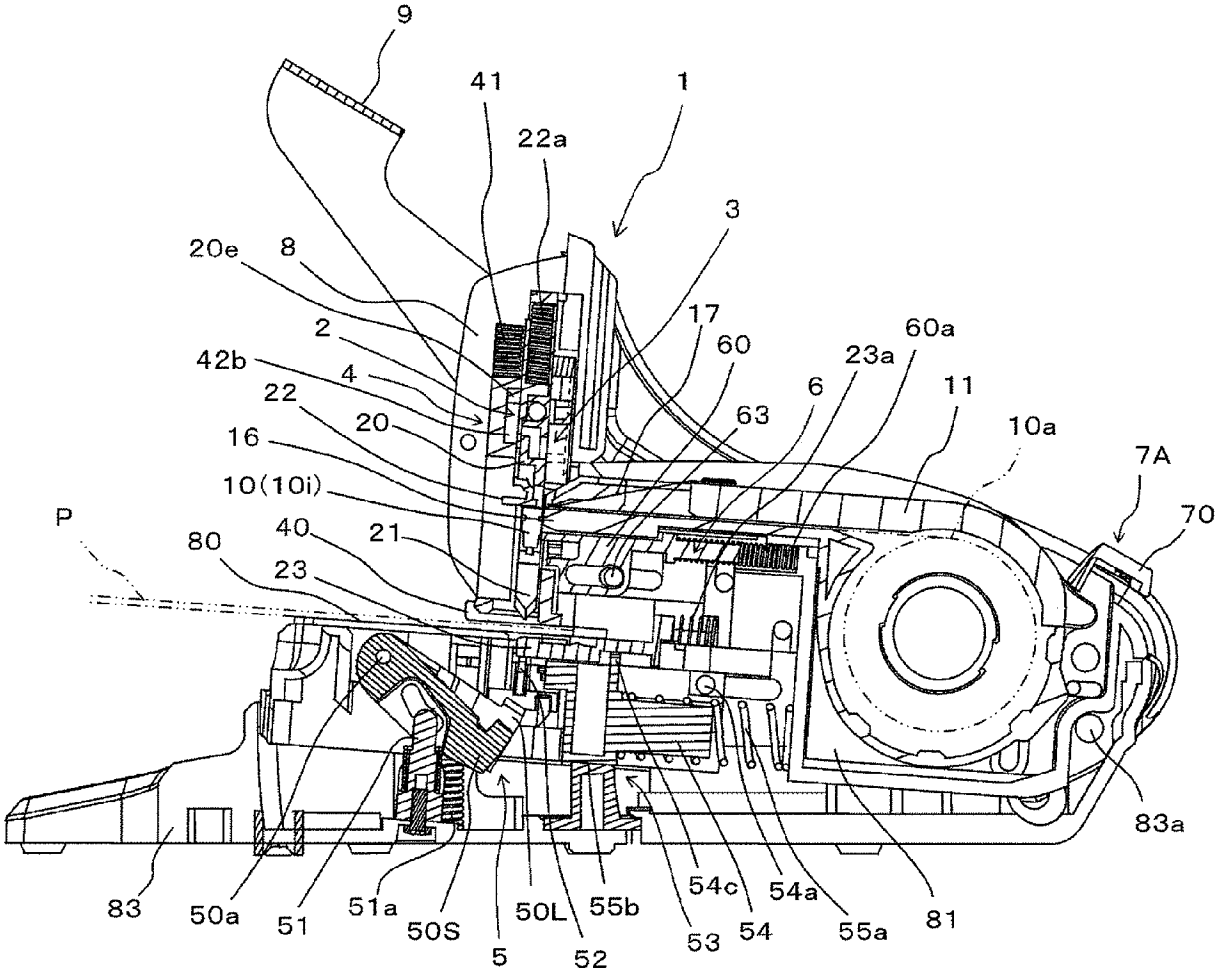
FIG. 1 is a side sectional view illustrating one example of an internal configuration of a stapler according to one embodiment.
Figure 2:
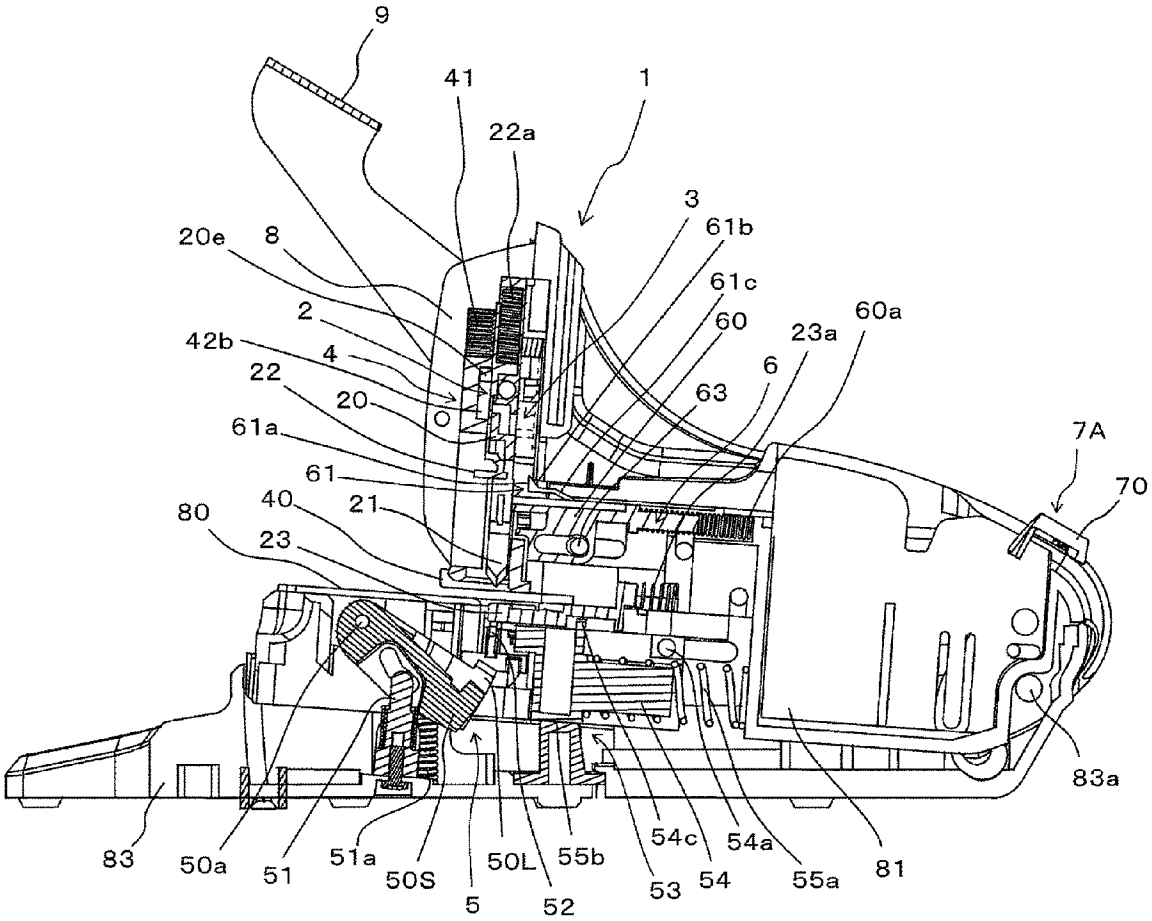
FIG. 2 is a side sectional view illustrating one example of the internal configuration of the stapler according to this embodiment.
Figure 3:
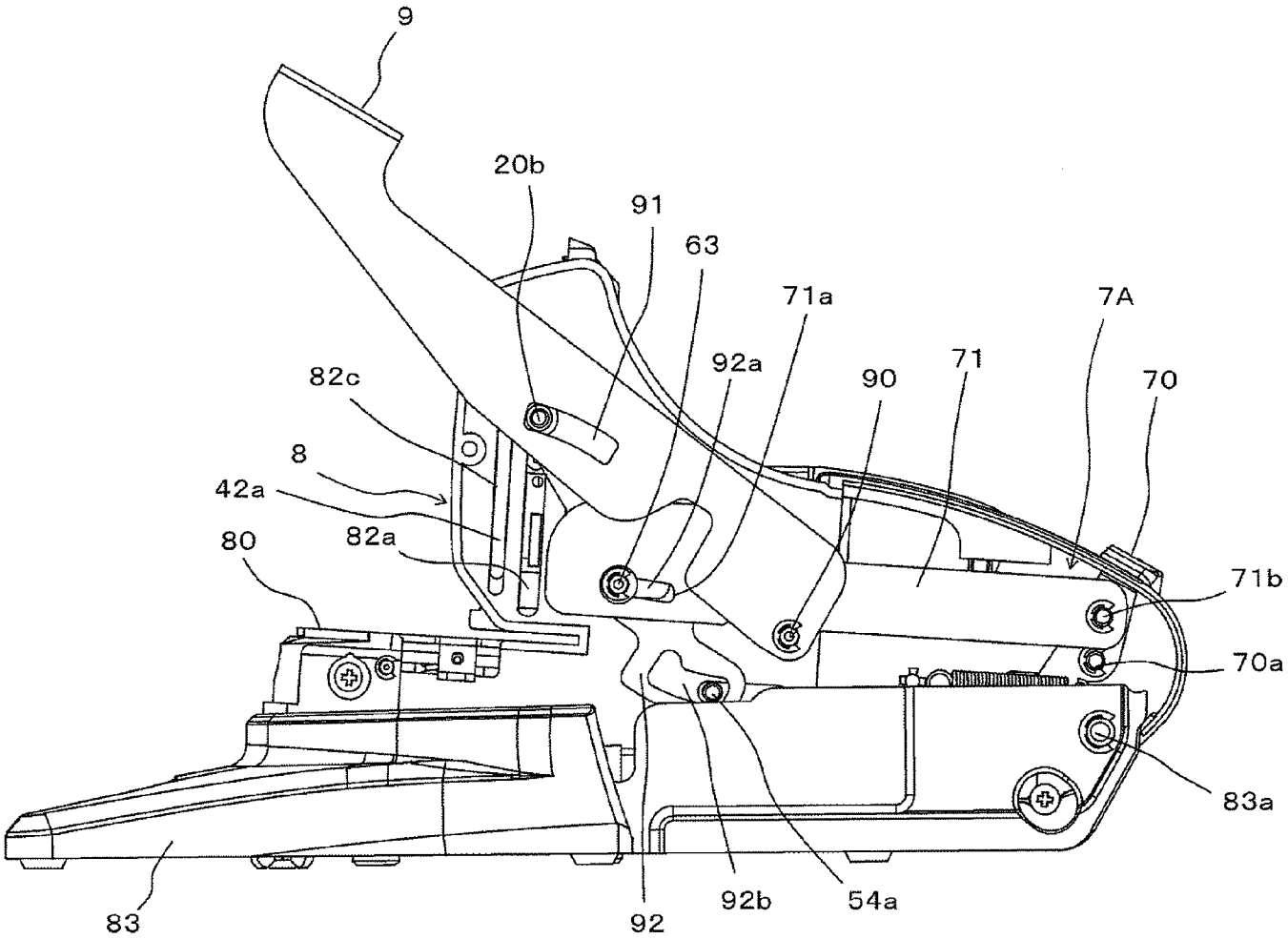
FIG. 3 is a side sectional view illustrating one example of the stapler according to this embodiment.

FIGS. 1 and 2 are side sectional views illustrating one example of the internal configuration of the stapler according to the embodiment, in which FIG. 1 shows a mounting state of a staple cartridge, and FIG. 2 shows a detached state of the staple cartridge. FIG. 3 is a side view illustrating one example of the stapler according to the embodiment.

Figure 4:
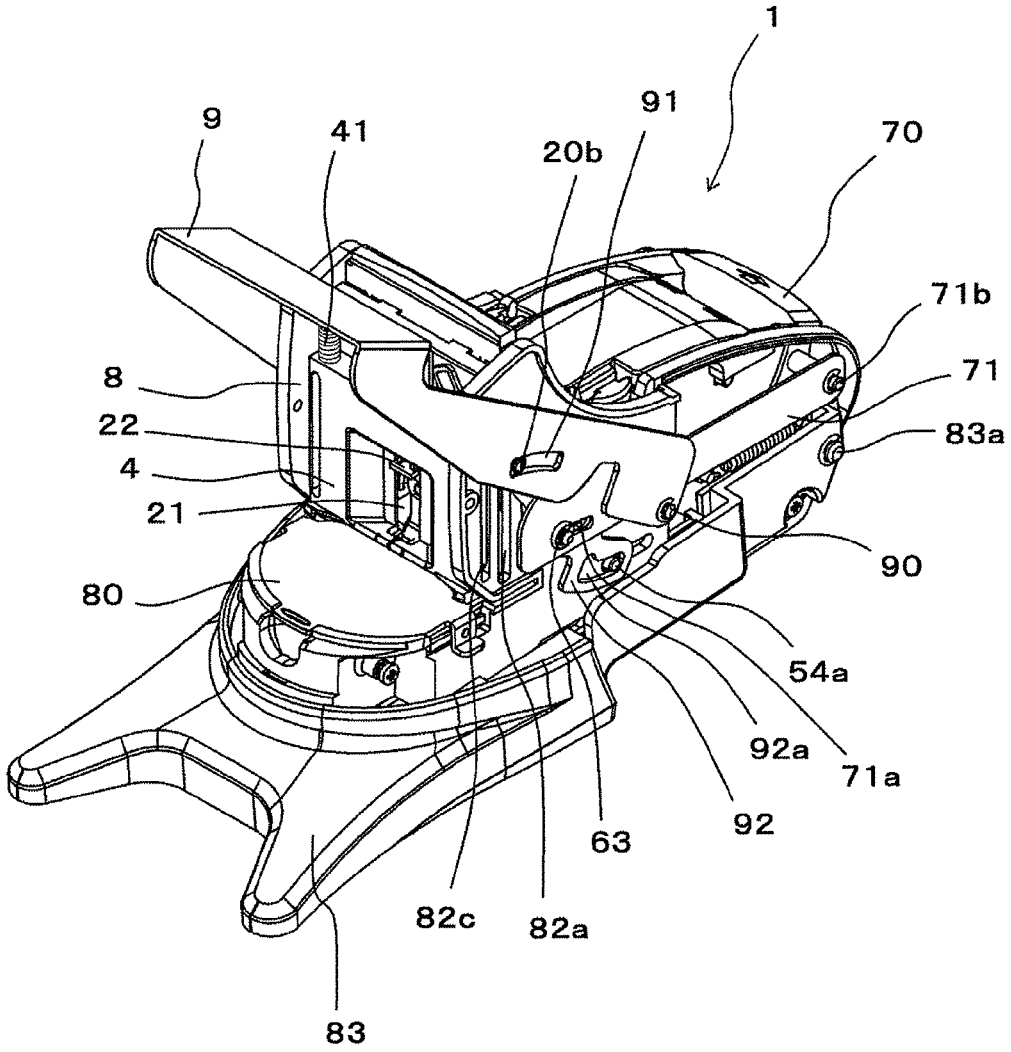
FIG. 4 is a perspective view illustrating one example of the stapler according to one embodiment when seen from a front.
Figure 5:
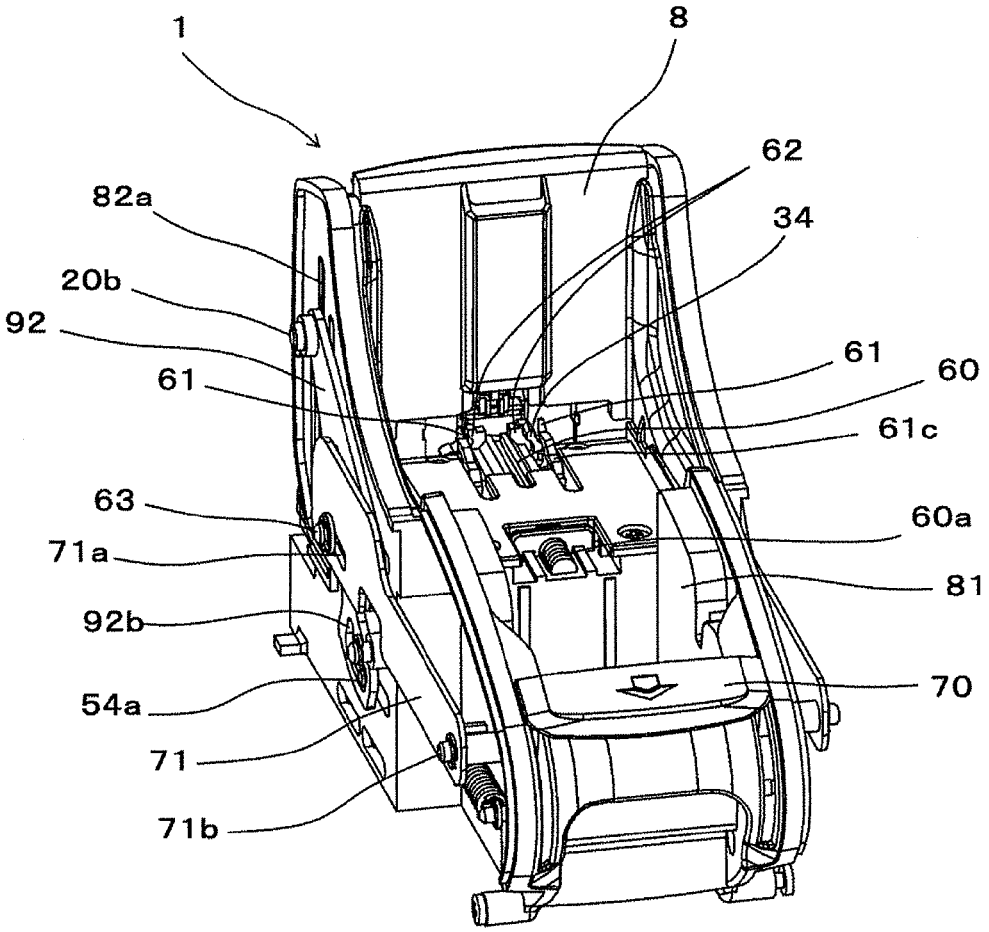
FIG. 5 is a perspective view illustrating one example of the stapler according to this embodiment when seen from a rear.
Figure 6:
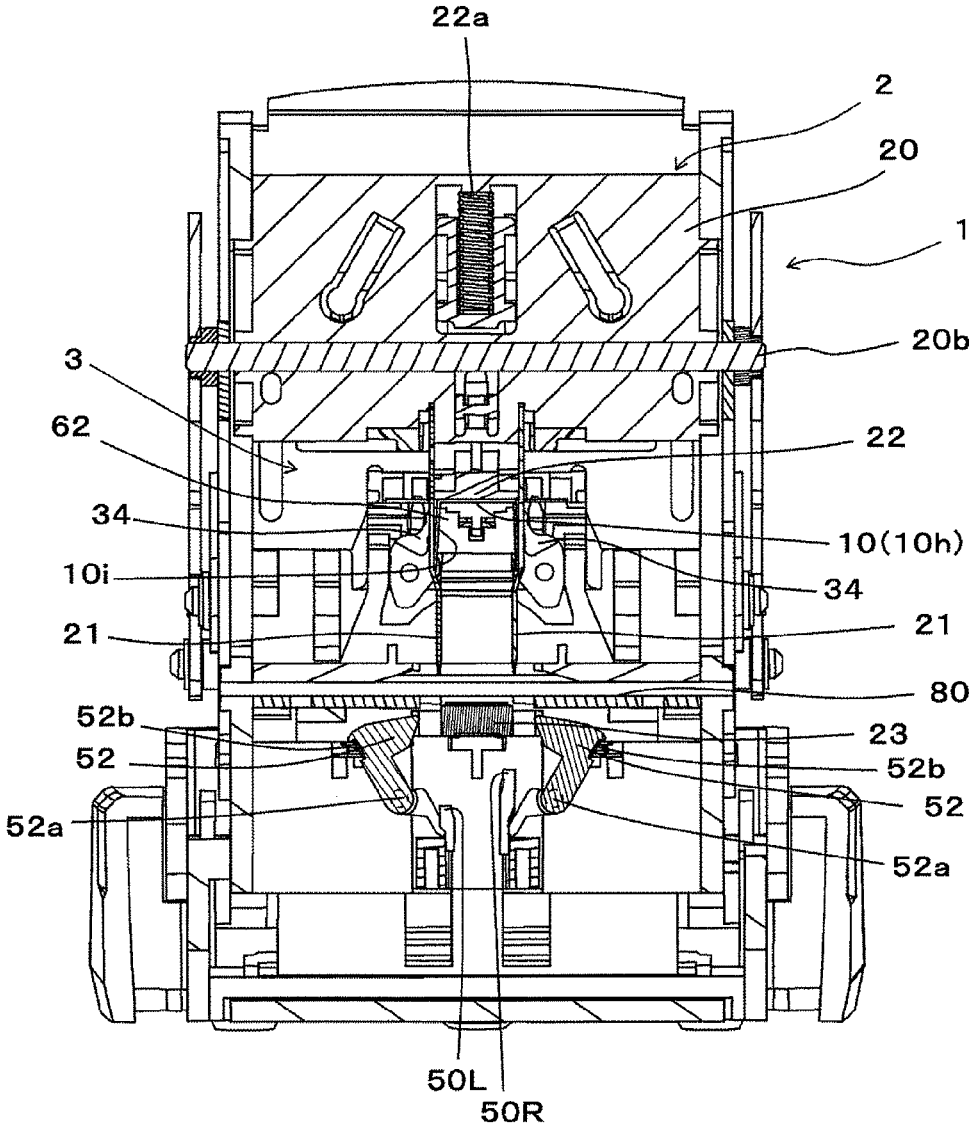
FIG. 6 is a forward sectional view illustrating one example of the internal configuration in a penetrating mechanism of the stapler according to this embodiment.
Figure 7:
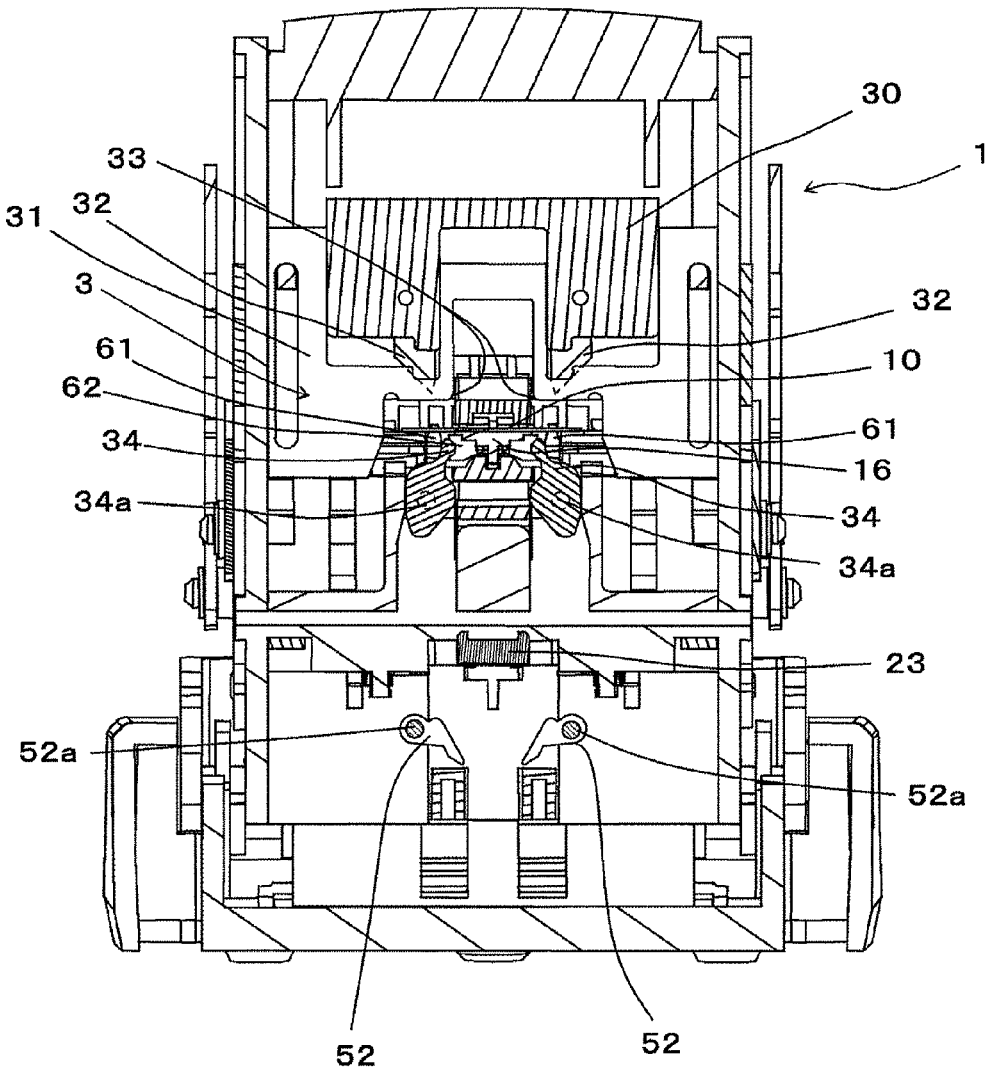
FIG. 7 is a forward sectional view illustrating one example of the internal configuration in a cutting/forming mechanism of the stapler according to this embodiment.

FIG. 4 is a perspective view illustrating one example of the stapler according to one embodiment when seen from a front. FIG. 5 is a perspective view illustrating one example of the stapler according to this embodiment when seen from a rear. FIG. 6 is a forward sectional view illustrating one example of the internal configuration in a penetrating mechanism of the stapler according to this embodiment. FIG. 7 is a forward sectional view illustrating one example of the internal configuration in a cutting/forming mechanism of the stapler according to this embodiment;

First, explaining an outline of the stapler 1 according to this embodiment, the stapler 1 binds the paper sheets P which are a workpiece, using a staple 10 made of a non-metal material which is a soft material. The staple 10 is supplied as a band-like staple-materials-connecting-body 10*a* integrally configured, as will be described later, and the staple-materials-connecting-body 10*a* is received in a staple cartridge 11, so that it is mounted in the stapler 1.

The stapler 1 includes a penetrating mechanism 2 configured to make a hole in the paper sheets P and to penetrate the staple 10 into the paper sheets P by an action of driving the staple 10 which is cut from the staple-materials-connecting-body 10*a* and formed.

Further, the stapler 1 includes a cutting/forming mechanism 3 configured to cut a staple material 10*m* from the staple-materials-connecting-body 10*a* and form the cut staple material 10*m* into a formed staple 10, in association with an operation of the penetrating mechanism 2 which drives the staple 10 and penetrates the paper sheets P.

Further, the stapler 1 includes a paper holding mechanism 4 configured to hold the paper sheets P to be penetrated by the penetrating mechanism 2, in association with the operation of the penetrating mechanism 2 which drives the staple 10 and penetrates the paper sheets P.

Further, the stapler 1 includes a bending mechanism 5 configured to bend the staple 10 penetrated the paper sheets P, in association with the operation of the penetrating mechanism 2 which drives the staple 10 and penetrates the paper sheets P.

Further, the stapler 1 includes a conveying mechanism 6 configured to convey the staples 10 cut from the staple-materials-connecting-body 10*a* and formed to the penetrating mechanism 2 which drives the staple 10, and convey the staple-materials-connecting-body 10*a* to the cutting/forming mechanism 3 from which the next staple 10 is conveyed to the penetrating mechanism 2.

Further, the stapler 1 includes an attaching/detaching mechanism 7A configured to convey the staple-materials-connecting-body 10*a* received in the staple cartridge 11 to a desired position, in association with the conveying mechanism 6, when the staple cartridge 11 is mounted in the stapler 1.

The stapler 1 includes a body section 8 provided with the penetrating mechanism 2, the cutting/forming mechanism 3, the paper holding mechanism 4, the bending mechanism 5, the conveying mechanism 6, and the attaching/detaching mechanism 7A which are described above. With the stapler 1, the respective above-described constituent elements is operated by a desired driving force, and the respective constituent elements is operated in an interlocking manner by operation of an operating handle 9 which is manipulated by a human power.

The body section 8 includes a paper placing base 80 in which the paper sheets P are placed, and a cartridge receiving portion 81 mounted with the staple cartridge 11. With the stapler 1, the paper placing base 80 is installed at one side, that is, a front side, of the body section 8, and the cartridge receiving portion 81 is installed at a rear side.

In the body section 8, the penetrating mechanism 2, the cutting/forming mechanism 3, and the paper holding mechanism 4 are installed over the paper placing base 80. The penetrating mechanism 2, the cutting/forming mechanism 3, and the paper holding mechanism 4 are disposed in order of the cutting/forming mechanism 3, the penetrating mechanism 2, and the paper holding mechanism 4 from a rear side in a conveyance direction of the staple-materials-connecting-body 10*a*.

The body section 8 is provided with guide grooves 82*a* for guiding movement of the penetrating mechanism 2, guide grooves 82*b* for guiding movement of the cutting/forming mechanism 3, and guide grooves 82*c* for guiding movement of the paper holding mechanism 4. The guide grooves 82*a* to 82*c* respectively extend in a vertical direction with respect to the paper sheets P placed in the paper placing base 80, and are provided parallel to each other.

Further, in the body section 8, the conveying mechanism 6 is installed at the rear of the penetrating mechanism 2, the cutting/forming mechanism 3, and the paper holding mechanism 4. The body section 8 is provided with a guide (not illustrated) for guiding movement of the conveying mechanism 6. In addition, in the body section 8, the bending mechanism 5 is installed under the paper placing base 80.

The body section 8 is rotatably attached to a base section in a state in which the body section is urged in an upward direction by a spring (not illustrated) using a shaft 83*a* as a fulcrum. Also, as the body section 8 is rotated around the shaft 83*a*, the body section operates in the vertical direction. The operating handle 9 is rotatably attached to the body section 8 in a state in which the operating handle 9 is urged in the upward direction by a spring (not illustrated) using a shaft 90 as a fulcrum. Also, as the operating handle 9 is rotated around the shaft 90, the operating handle operates in the vertical direction.

The operating handle 9 has an elongated slot 91 for transmitting the operation of the operating handle rotating around the shaft 90 to the penetrating mechanism 2. Further, the handle operating 9 has a link 92 for transmitting the operation of the operating handle rotating around the shaft 90 to the conveying mechanism 6 and the bending mechanism 5.

In the stapler 1, the operation of the operating handle 9 is transmitted to the penetrating mechanism 2, the cutting/forming mechanism 3, and the paper holding mechanism 4 through the elongated slot 91, so that the penetrating mechanism 2, the cutting/forming mechanism 3, and the paper holding mechanism 4 are guided by the guide grooves 82*a* to 82*c* to move in the vertical direction with respect to the paper sheets P placed in the paper placing base 80.

Accordingly, the stapler 1 performs the operation of the paper holding mechanism 4 to hold the paper sheets P placed in the paper placing base 80, as the operating handle 9 is operated. Also, in association with the operation of the paper holding mechanism 4 to hold the paper sheets P, the stapler performs the operation of the penetrating mechanism 2 to allow the staple 10 to penetrate the paper sheets P. Furthermore, in association with the operation of the penetrating mechanism 2 to allow the staple 10 to penetrate the paper sheets P, the stapler performs the operation of the cutting/forming mechanism 3 to cut and form the next staple 10.

Further, the stapler 1 performs the operation of the bending mechanism 5 to bend the staple 10 penetrating the paper sheets P, as the body section 8 is rotated in association with the operation of the operating handle 9.

In the stapler 1, the operation of the operating handle 9 is transmitted to the conveying mechanism 6 via the link 92, and thus the conveying mechanism 6 is moved in a forward and backward direction along the conveyance direction of the staple-materials-connecting-body 10*a*. Accordingly, as the operating handle 9 is operated, the stapler 1 conveys the staple-materials-connecting-body 10*a* to the cutting/forming mechanism 3 by the conveying mechanism 6, and conveys the staple 10 located at the leading end, which is cut and formed from the staple-materials-connecting-body, 10*a* to the penetrating mechanism 2.

<Exemplary Configuration of Staple and Staple-Materials-Connecting-Body>

Figure 8:
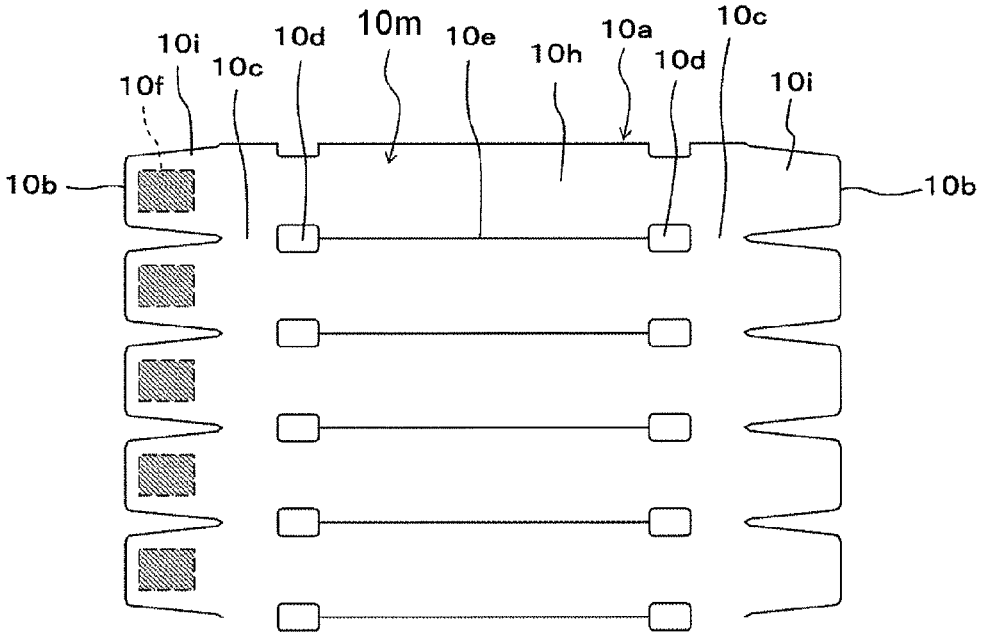
FIG. 8 is a plan view illustrating one example of a staple-materials-connecting-body.
Figure 9:
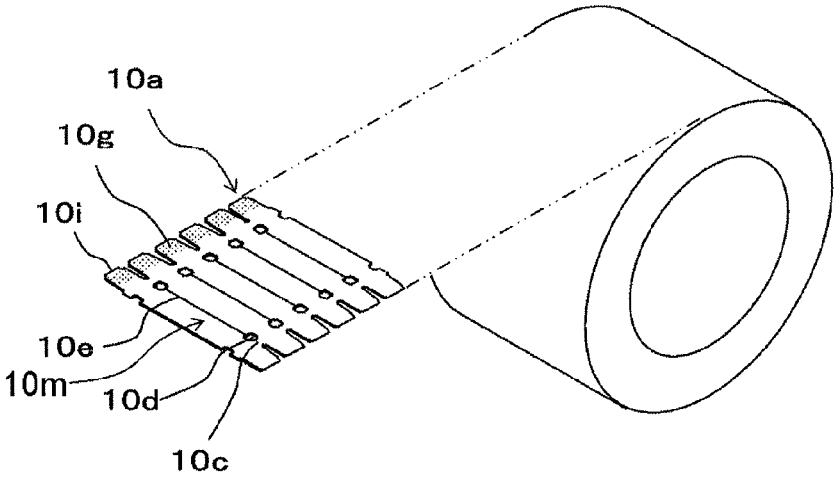
FIG. 9 is a perspective view illustrating one example of a receiving state of the staple-materials-connecting-body.
Figure 10:
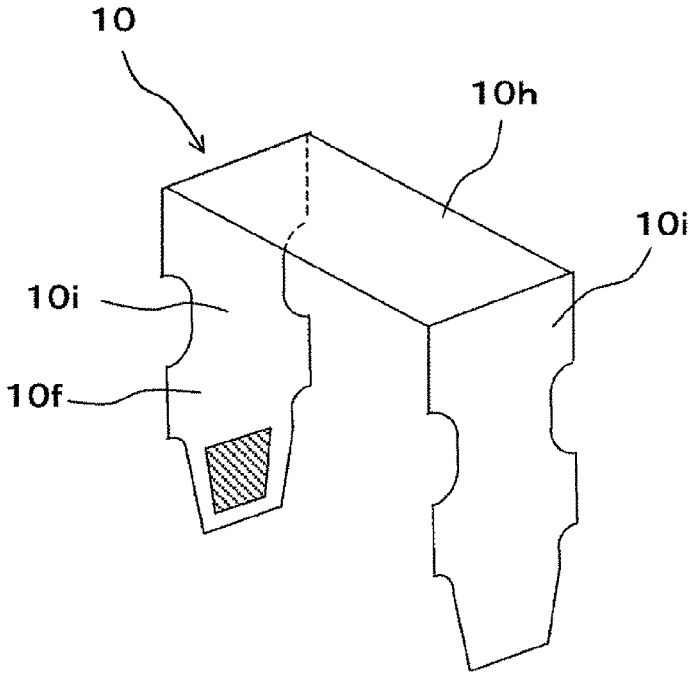
FIG. 10 is a perspective view illustrating one example of a formed staple.
Figure 11:
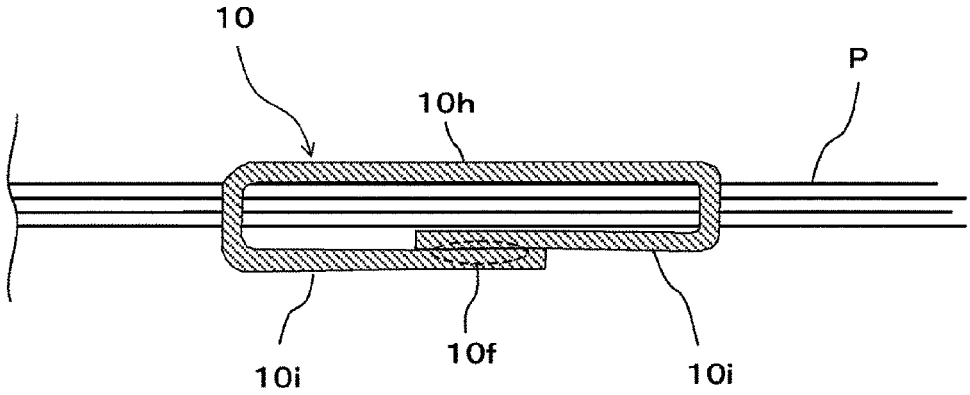
FIG. 11 is a cross-sectional view illustrating one example of a state in which paper sheets to be stapled are stapled with the staple.

FIG. 8 is a plan view illustrating one example of the staple-materials-connecting-body according to this embodiment. FIG. 9 is a perspective view illustrating one example of a receiving state of the staple-materials-connecting-body according to this embodiment. FIG. 10 is a perspective view illustrating one example of the formed staple according to the embodiment. FIG. 11 is a cross-sectional view illustrating one example of a state in which the paper sheets are stapled with the staple. Next, the configuration of the staple 10 and the staple-materials-connecting-body 10*a* according to this embodiment will be described with reference to each drawing.

The staple 10 is made of a non-metal material, which is a soft material, having a predetermined thickness. A staple material 10*m* before being formed to the staple 10 has an elongated straight shape, and both tip end portions 10*b* in its longitudinal direction are tapered toward its tip end. In this embodiment, the staple 10 and the staple material 10*m* is made of the paper, but may be made of resin film or sheet, instead of the paper.

The staple-materials-connecting-body 10*a* has a plurality of staple materials 10*m* arranged parallel to each other in the longitudinal direction, and each staple material 10*m* is connected to each other by a pair of connecting portions 10*c* provided in the inside of the tip end portions 10*b* near both end portions thereof in the longitudinal direction. In the staple-materials-connecting-body 10*a*, a portion outer than each connecting portion 10*c* in the longitudinal direction of each staple material is not provided with a portion connecting the staple materials 10*m* arranged parallel to each other, due to the tapered shape of the tip end portion 10*b*.

The staple-materials-connecting-body 10*a* is provided with a hole 10*d* adjacent to each connecting portion 10*c* at the inside of the one pair of the connecting portions 10*c* connecting the staple materials 10*m* arranged parallel to each other. The hole 10*d* has a predetermined length in the longitudinal direction and a short-side direction of the staple material 10*m*, and, in this embodiment, the hole is formed by an aperture of a substantially rectangular shape due to the rounded leg portion. Also, the hole 10*d* may be formed as a circular or oval aperture. The staple-materials-connecting-body 10*a* is not provided with a cut portion of the staples arranged parallel to each other between the connecting portion 10*c* and the hole 10*d*.

Further, the staple-materials-connecting-body 10*a* is provided with a slit 10*e* for separating the staple materials 10*m* arranged parallel to each other, between the respective holes 10*d*. The slit portion 10*e* is consecutively formed from one hole 10*e* to the other hole 10*d*, and thus the staple-materials-connecting-body 10*a* is not provided with a connecting portion of the staple materials 10 arranged parallel to each other, between the one hole 10*d* to the other hole 10*d*.

The staple-materials-connecting-body 10*a* is punched by pressing or stamping to have a predetermined shape of the tip end portions 10*b*, the connecting portions 10*c*, the holes 10*d*, and the slit portions 10*e*, which are described above.

The staple-materials-connecting-body 10*a* is provided with an adhesive portion 10*f* on one surface, that is, a reverse surface, of the one tip end portion 10*b* which is the end portion of each staple material 10*m* in the longitudinal direction. The adhesive portion 10*f* uses a property to obtain a desired adhesive force when the leg portion 101 of the staple 10 is bonded, in accordance with the material type of the staple 10.

When the staple-materials-connecting-body 10*a* is wound in a roll shape, as illustrated in FIG. 9, the staple materials 10*m* are overlapped, and thus the adhesive portion 10*f* located on the reverse surface of the one tip end portion 10*b* of the outer-peripheral staple material 10 comes into contact with the obverse surface of the one tip end portion 10*b* of the inner-peripheral staple material 10.

When the staple-materials-connecting-body 10*a* is wound in the roll shape, the other surface of the one tip end portion which at least comes into contact with the adhesive portion 10*f* is provided with a coated portion 10*g* made of silicon or the like, thereby preventing the staples from sticking in the staple-materials-connecting-body 10*a* which is wound.

Since the staple material 10*m* is cut and formed from the staple-materials-connecting-body 10*a* by the cutting/forming mechanism 3 illustrated in FIGS. 1 and 7, both end portions thereof in the longitudinal direction are bent by a predetermined length to be substantially parallel in a first direction, thereby the staple 10 in which a crown portion 10*h* as illustrated in FIG. 10 and leg portions 10*i* at both end portions of the crown portion 10*h* is formed.

According to the staple 10 cut and formed from the staple-materials-connecting-body 10*a*, the one pair of leg portions 10*i* penetrate the paper sheets P by the penetrating mechanism 2, and the one pair of leg portions 10*i* penetrating the paper sheets P are bent in a second direction along the paper sheets P by the bending mechanism 5.

Since the reverse surface of the one tip end portion 10*b* of the staple 10 is provided with the adhesive portion 10*f*, an adhesive force 10*f* is provided on the rear surface of one leg portion 10*i* in the form of the crown portion 10*h* and the leg portion 10*i* which are formed. In this embodiment, the staple 10 has a bending position inside than the hole 10*d*, and a length of the leg portion 10*i* is equal to or more than a half of the length of the crown portion 10*h*. If the one pair of leg portions 10*i* are bent, the adhesive 10*f* is overlapped with the leg portion 10*i*.

Accordingly, as illustrated in FIG. 11, after the other leg portion 10*i* is bent in the second direction along the paper sheets P, the one leg portion 10*i* is bent in the second direction along the paper sheets P, and thus the one leg portion 10*i* is overlapped with the other leg portion 10*i*, so that the leg portion 10*i* are bonded at the adhesive portion 10*f*.

<Exemplary Configuration of Staple Cartridge>

Figure 12:
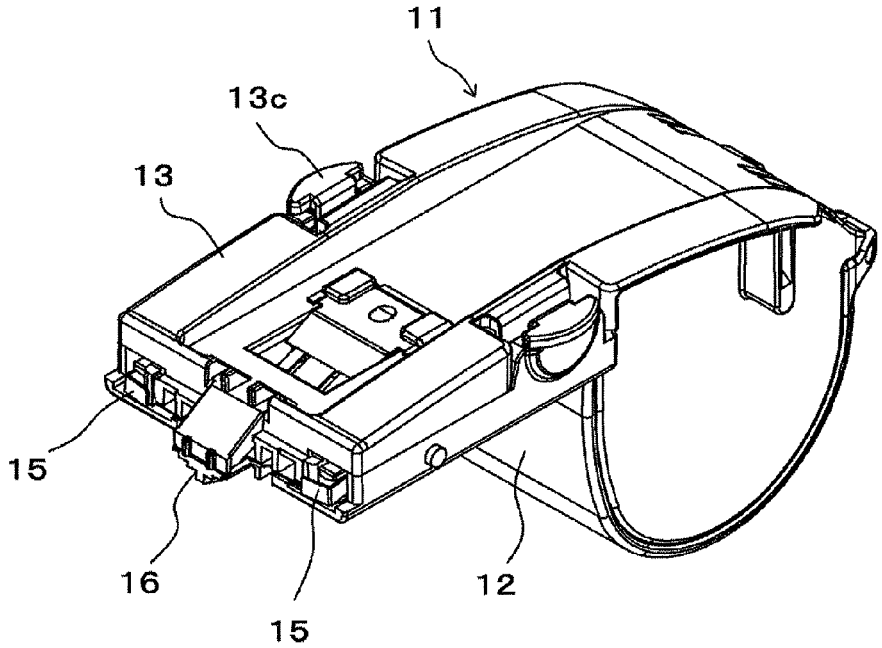
FIG. 12 is a perspective view illustrating one example of a staple cartridge.
Figure 13:
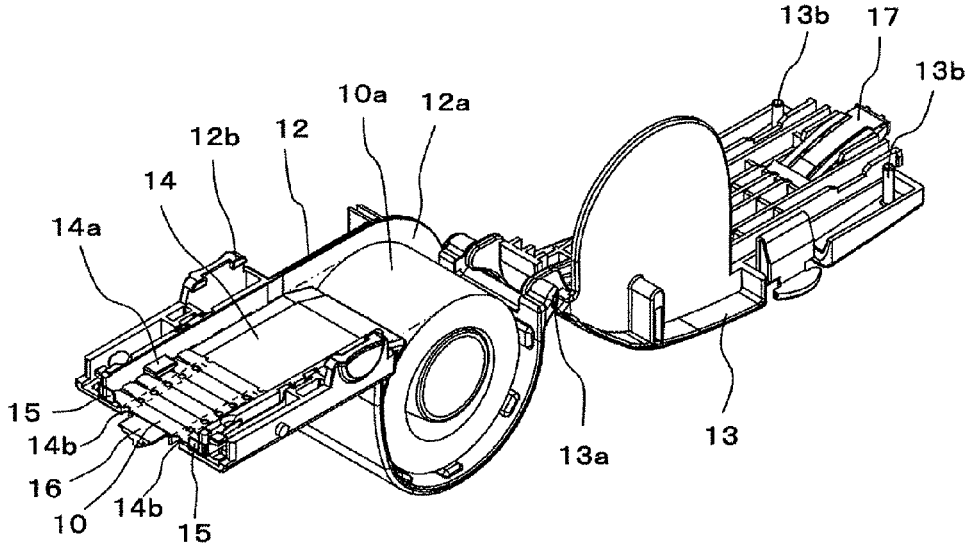
FIG. 13 is a perspective view illustrating one example of the staple cartridge.

FIGS. 12 and 13 are perspective views illustrating one example of the staple cartridge. The configuration of the staple cartridge 11 will now be described with reference to each drawing. Herein, FIG. 12 shows the state in which the staple cartridge 11 is closed, while FIG. 13 shows the state in which the staple cartridge 11 is opened.

The staple cartridge 11 includes a cartridge body 12 and a cartridge cover 13 for covering the cartridge body 12. In the staple cartridge 11, the cartridge body 12 is closed by rotation of the cartridge body 13 around a shaft 13*a* provided at a rear end side thereof.

The cartridge body 12 has a staple receiving portion 12*a* for receiving the staple-materials-connecting-body 10*a* wound in the roll shape therein, and a staple conveying path 14, protruding forward from the staple receiving portion 12*a*, for conveying the staple 10*a*.

The staple conveying path 14 has a pair of guide convex portions 14*a* adjacent to a tip end side thereof, the guide convex portions having a flat bottom portion along the surface of the staple-materials-connecting-body 10*a* drawn from the staple receiving portion 12*a* and extending in a straight line to suppress the staple-materials-connecting-body 10*a* from lifting upward. Further, the staple conveying path 14 has a groove portion 14*b* through which a feed claw (will be described later) of the transport mechanism 6 protrudes into the staple conveying path 14.

The staple cartridge 11 includes a pair of openable stopper guides 15 at both left and right ends of the tip end side of the staple conveying path 14. The stopper guide 15 is one example of the tip end position guide part, and is made of a thin sheet-like metallic spring material to have an L-shape in this example. The stopper guide 15 is installed to shift between a protruding position and a retreated position at both left and right sides of the tip end portion of the staple conveying path 14.

The staple conveying path 14 is provided with a receiving table 16 for supporting a portion (corresponding to the crown portion 10*h*) of the staple 10 located at the leading end of the staple-materials-connecting-body 10*a* conveyed through the staple conveying path 14. The receiving table 16 is formed continuously from the staple conveying path 14, and protrudes forward from the tip end of the staple conveying path 14 by conforming to a width corresponding to an inner width of the crown portion 10*h* of the staple 10 and a length of one staple 10 in the short side direction, thereby supporting the staple 10 to be cut and formed by the cutting/forming mechanism 3.

The cartridge cover 13 is configured to cover the staple receiving portion 12*a* and the staple conveying path 14 of the cartridge body 12. The cartridge cover 13 has a pair of bosses 13*b* as a guide opening/closing part for opening and closing the stopper guide 15 by opening/closing operation of the cartridge body 12.

The cartridge cover 13 is provided with bosses 13*b* at positions in which the bosses are engaged with the stopper guides 15 when the cartridge body 12 is closed. The stopper guides protrude into the staple conveying path 14 from both left and right sides of the tip end portion of the staple conveying path 14, as illustrated in FIG. 13.

In the cartridge cover 13, when the cartridge body 12 is closed, the bosses 13*b* are engaged with the stopper guides 15, and an interval between the one pair of stopper guides 15 is extended by force. The stopper guides 15 are retreated outwardly from both left and right sides of the tip end portion of the staple conveying path 14, as illustrated in FIG. 12, thereby opening the tip end of the staple conveying path 14.

Accordingly, the tip end position of the staple-materials-connecting-body 10*a* can be determined by opening the cartridge cover 13, accommodating the staple-materials-connecting-body 10*a* wound in the roll shape into the staple receiving portion 12*a* of the cartridge body 12, and abutting the tip end of the staple-materials-connecting-body 10*a* against the stopper guides 15.

As the cartridge cover 13 is closed and the stopper guides 15 are retreated, the tip end position of the staple-materials-connecting-body 10*a* is determined in such a way that the staple-materials-connecting-body 10*a* can be conveyed, and then the staple-materials-connecting-body is accommodated in the staple cartridge 11.

The cartridge cover 13 is provided with a staple holding portion 17 at a position opposite to the receiving table 16 when the cartridge body 12 is closed. The staple holding portion 17 is made of a thin sheet-like metallic spring material in the example to push the staple material 10*m*, located at the leading end which is conveyed to the receiving table 16, in a direction of the receiving table 16, thereby suppressing displacement of the staple 10 when the staple 10 is cut and formed by the cutting/forming mechanism 3. In the staple cartridge 11, the cartridge cover 13 is provided a lock portion 13*c* for openably locking the cartridge cover 13, and the cartridge body 12 is provided with a pawl portion 12*b* which is engaged with the lock portion 13*c*.

If the staple cartridge 11 is mounted onto the cartridge receiving portion 81 of the stapler 1, as illustrated in FIG. 1, the staple conveying path 14 functions as a conveying path of the stapler 1. Also, the receiving table 16 protrudes toward the cutting/forming mechanism 3 to function as a receiving table of the staple 10 cut and formed by the cutting/forming mechanism 3. Also, in this embodiment, the stopper guides 15 and the bosses 13*b* are provided at both sides of the staple conveying path 14, but may be provided any one side of the staple conveying path 14.

<Exemplary Configuration of Penetrating Mechanism>

Figure 14:
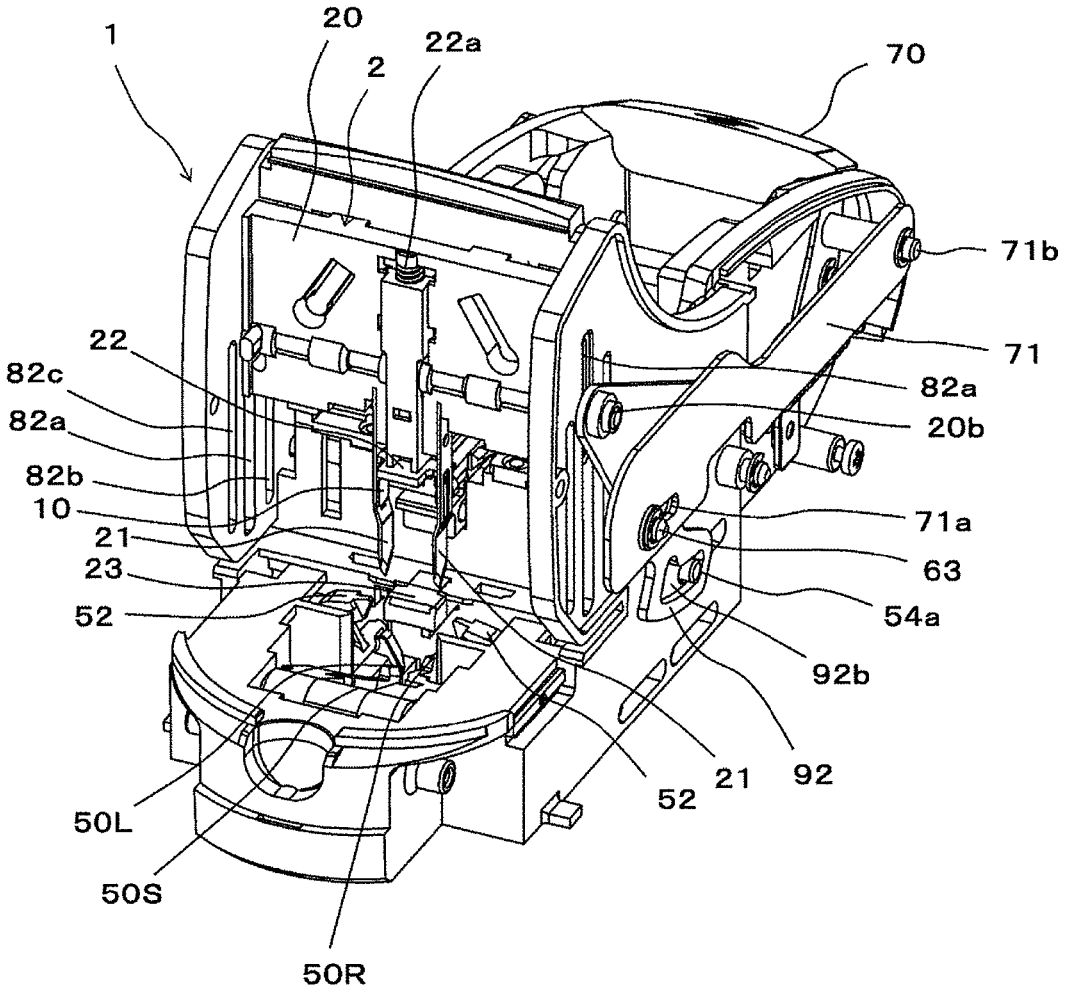
FIG. 14 is a perspective view illustrating one example of the internal configuration in a portion of the penetrating mechanism of the stapler according to this embodiment.
Figure 15:
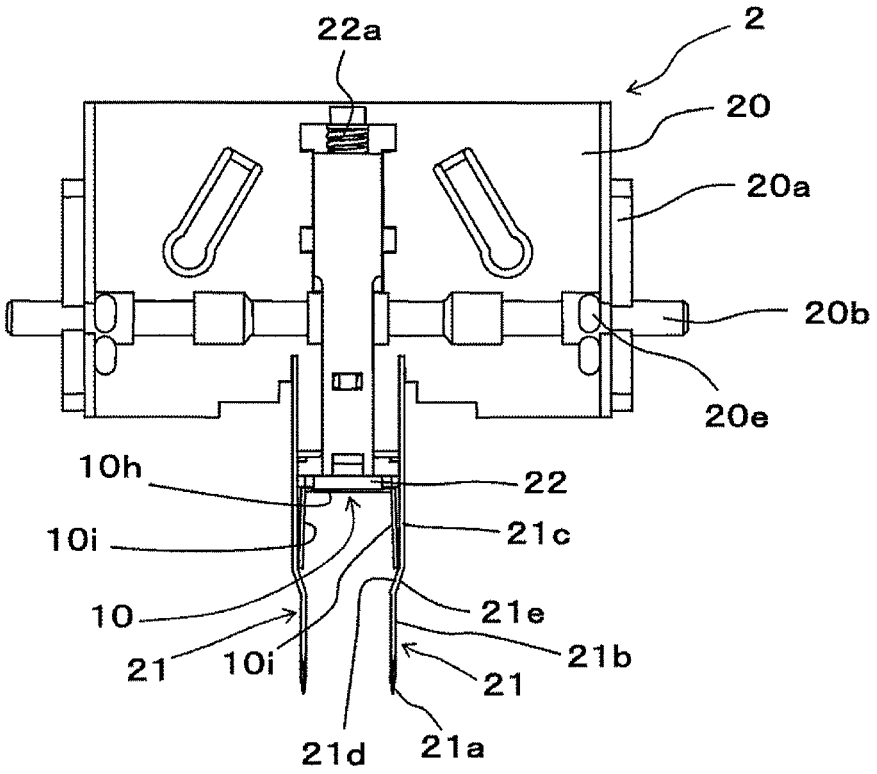
FIG. 15 is a front view illustrating one example of the penetrating mechanism.
Figure 16:
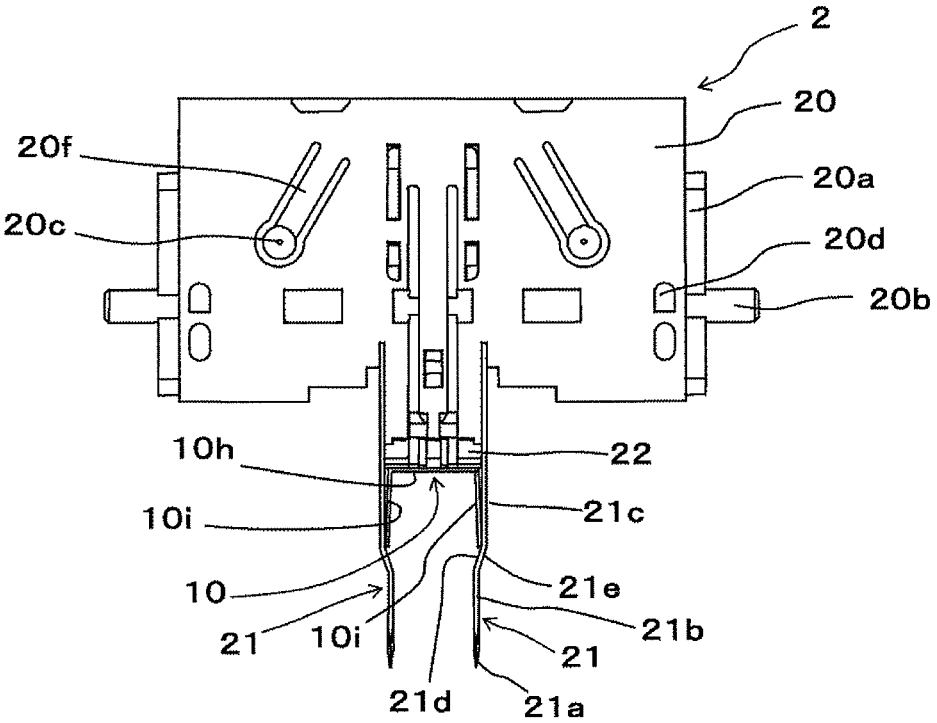
FIG. 16 is a rear view illustrating one example of the penetrating mechanism.
Figure 17:
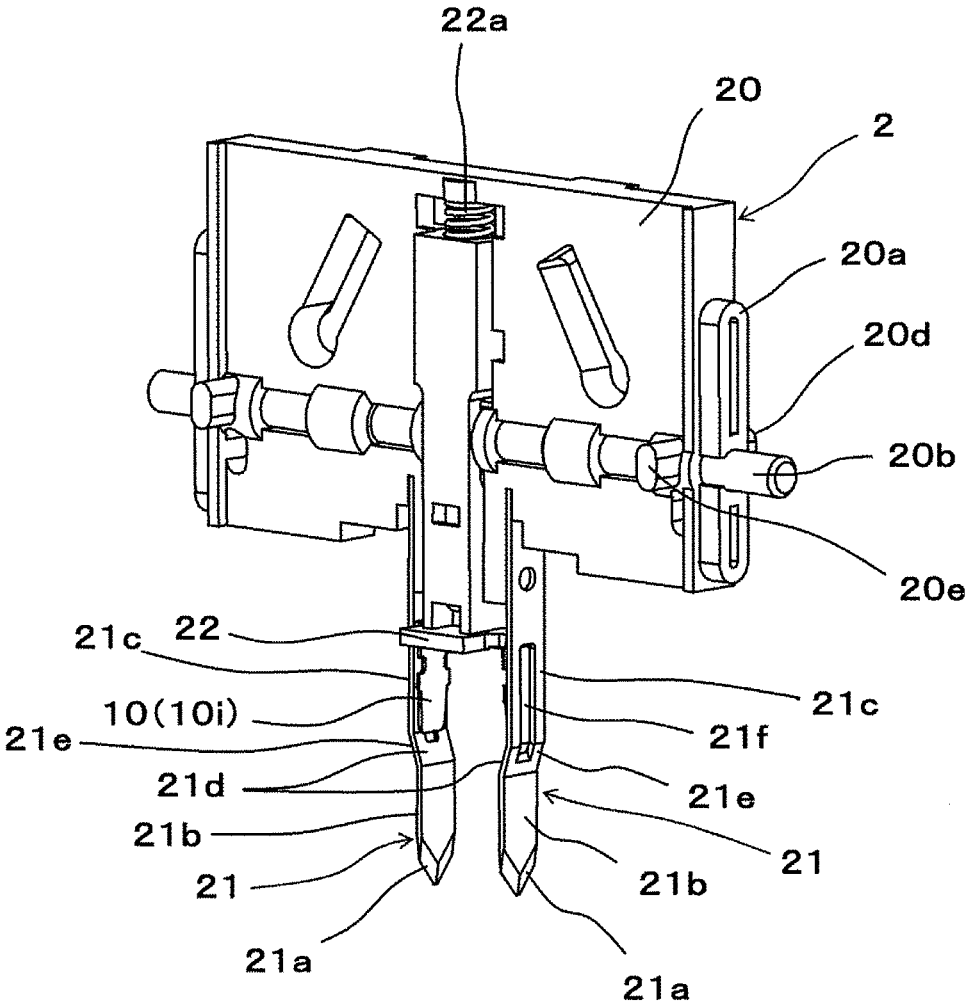
FIG. 17 is a perspective view illustrating one example of the penetrating mechanism.

FIG. 14 is a perspective view illustrating one example of the internal configuration in a portion of the penetrating mechanism of the stapler according to this embodiment. FIG. 15 is a front view illustrating one example of the penetrating mechanism. FIG. 16 is a rear view illustrating one example of the penetrating mechanism. FIG. 17 is a perspective view illustrating one example of the penetrating mechanism. The configuration of the penetrating mechanism will now be described with reference each drawing.

The penetrating mechanism 2 is one example of a penetrating part, and includes a penetrating mechanism body 20 transmitted with the operation of the operating handle 9, two sheets of cutting blades 21 for opening the holes in the paper sheets P by the operation of the penetrating mechanism body 20 and allowing the staple 10 to penetrate the paper sheets P, and a staple press-down portion 22 for driving the staple 10.

The penetrating mechanism body 20 has guide convex portions 20*a* for guiding the movement of the penetrating mechanism 2, a coupling shaft portion 20*b* connected with the operating handle 9, and a protruding pin 20*c* for transmitting the operation of the operating handle 9 to the cutting/forming mechanism 3. Also, the penetrating mechanism body 20 has a guide convex portion 20*d* for guiding the movement of the penetrating mechanism 2 and the cutting/forming mechanism 3, and a guide convex portion 20*e* for guiding the movement of the penetrating mechanism 2 and the paper holding mechanism 4.

The guide convex portions 20*a* protrude outwardly from both ends of the penetrating mechanism body 20 in a widthwise direction, and are engaged with the guide grooves 82*a* of the body section 8 which are provided in both sides of the body section 8 of the stapler 1 in the widthwise direction and are opened along the moving direction of the penetrating mechanism 2. The guide convex portions 20*a* are formed in an elliptical shape which is formed by connecting two semicircles with a straight line, to restrict a posture of the penetrating mechanism 2 in its rotating direction.

The coupling shaft portion 20*b* protrudes from both ends of the penetrating mechanism body 20 in the widthwise direction to the outside of the guide convex portions 20*a*, and is engaged with the elongated slot 91 provided in the operating handle 9.

The protruding pin 20*c* is configured to protrude from a rear surface, which is opposite to the cutting/forming mechanism 3, of the penetrating mechanism body 20 in a projecting/retracting manner. The protruding pin 20*c* is provided integrally with the penetrating mechanism body 20 made of a resin material via a support portion 20*f* in this example.

The protruding pin 20*c* is supported by the support portion 20*f* in a cantilever form, and is configured to be projected/retracted from/into the surface opposite to the cutting/forming mechanism 3 mainly by the resilient deformation of the support portion 20*f*. Accordingly, the protruding pin 20*c* which protrudes in a retractable manner can be configured, without installing a separate component such as a spring.

The guide convex portions 20*d* are formed by installing bosses at a rear surface of the penetrating mechanism body 20 opposite to the cutting/forming mechanism 3. The guide convex portions 20*e* are formed by installing bosses at a surface of the penetrating mechanism body 20 opposite to the paper holding mechanism 4.

The penetrating mechanism 2 includes two cutting blades 21 attached at an interval to a lower portion of the penetrating mechanism body 20. The two cutting blades 21 extend downward from the penetrating mechanism body 20 in a direction parallel to each other, and a tip end which is a lower end of each cutting blade 21 is formed with a blade portion 21*a*.

An interval of the two cutting blades 21 is narrow at the tip end provided with the blade portion 21*a*, and each cutting blade 21 is provided with a stepped portion formed to widen its outer width from the tip end to the rear end, that is, a base end, at an outer surface of the one pair of cutting blades 21, and a stepped portion formed to widen an inner width from the tip end to the base end.

That is, each cutting blade 21 is configured so that the interval of the two cutting blades 21 is equal to or slightly less than the inner width of the one pair of leg portions 10*i* which is the inner width of the crown portion 10*h* of the staple 10, in the range of the predetermined length at the tip end provided with the blade portion 21*a*, thereby forming a first penetrating portion 21*b*.

Also, each cutting blade 21 is configured so that the interval of the two cutting blades 21 is equal to or slightly more than the outer width of the one pair of leg portions 10*i* which is the outer width of the crown portion 10*h* of the staple 10, at the penetrating mechanism body 20, of which the upper portion rather than the first penetrating portion 21*b* becomes the base end, thereby forming a second penetrating portion 21*c*.

Each cutting blade 21 is bent in a substantial crank form at a predetermined intermediate position which becomes a boundary between the first penetrating portion 21*b* and the second penetrating portion 21*c*, and the first penetrating portion 21*b* and the second penetrating portion 21*c* extend in a substantially straight shape along the moving direction of the penetrating mechanism 2.

Accordingly, each cutting blade 21 is provided with a stepped portion, of which the inner width of the first penetrating portion 21*b* is slightly narrow, at the inside of the predetermined intermediate position which becomes the boundary between the first penetrating portion 21*b* and the second penetrating portion 21*c*, and a staple support portion 21*d* for supporting the leg portion 10*i* of the staple 10 is formed by the stepped portion formed at the inside opposite to each cutting blade 21.

Also, each cutting blade 21 is provided with a stepped portion, of which the outer width of the second penetrating portion 21*c* is wide, at the outside of the predetermined intermediate position which becomes the boundary between the first penetrating portion 21*b* and the second penetrating portion 21*c*, and a hole expansion portion 21*e* is formed by the stepped portion provided at the outside of each cutting blade 21 to outwardly expand the hole penetrating the paper sheets P by the penetrating operation of the cutting blade 21 with respect to the paper sheets P.

The staple support portion 21*d* has a gentle slope so that the inner surface shape of the cutting blade 21 is gradually narrowed from the second penetrating portion 21*c* to the first penetrating portion 21*b*. The staple support portion 21*d* is configured so that a variation in interval of the cutting blade 21 at the staple support portion 21*d* does not cause the cutting resistance to increase when the cutting blade 21 gets away from the paper sheets P.

Further, the hole expansion portion 21*e* has a gentle slope so that the outer surface shape of the cutting blade 21 is gradually widened from the first penetrating portion 21*b* to the second penetrating portion 21*c*. The hole expansion portion 21*e* is configured so that a variation in interval of the cutting blade 21 at the hole expansion portion 21*e* does not cause the penetrating resistance to increase when the cutting blade 21 penetrates the paper sheets P.

At the tip end of the first penetrating portion 21*b* rather than the staple support portion 21*d*, the inner surfaces of the one pair of cutting blades 21 extend in a straight shape in an insertion/withdrawal direction of the cutting blade 21, so that the inner surface of the cutting blade 21 is not provided with a stepped portion at the tip end rather than the staple support portion 21*d*. Also, at the tip end of the first penetrating portion 21*b* rather than the hole expansion portion 21*e*, the outer surfaces of the one pair of cutting blades 21 extend in a straight shape in the insertion/withdrawal direction of the cutting blade 21, so that the outer surface of the cutting blade 21 is not provided with a stepped portion at the tip end rather than the hole expansion portion 21*e*.

At the tip end of the second penetrating portion 21*c* rather than the staple support portion 21*d*, the inner surfaces of the one pair of cutting blades 21 extend in the straight shape in the insertion/withdrawal direction of the cutting blade 21, so that the inner surface of the cutting blade 21 is not provided with a stepped portion at the base end rather than the staple support portion 21*d*. Also, at the base end of the second penetrating portion 21*c* rather than the hole expansion portion 21*e*, the outer surfaces of the one pair of cutting blades 21 extend in the straight shape in the insertion/withdrawal direction of the cutting blade 21, so that the outer surface of the cutting blade 21 is not provided with a stepped portion at the base end rather than the hole expansion portion 21*e*.

Each cutting blade 21 is provided with ejecting holes 21*f* which penetrate front and back surfaces of the second penetrating portion 21*c*, and an ejecting member (will be described later) for bending the leg portions of the staple 10 penetrating the paper sheets P protrudes from the ejecting holes.

The staple press-down portion 22 is installed between the two cutting blades 21 provided in the width of the crown portion 10*h* of the staple 10. The staple press-down portion 22 is configured to move along the moving direction of the penetrating mechanism body 20, and is supported by the penetrating mechanism body 20 in the state in which it is urged downwardly by a spring 22*a*.

In the stapler 1, if the penetrating mechanism 2 moves down to a predetermined position, the bending mechanism 5 is operated to start the bending of the leg portions 10*i* of the staple 10 penetrating the paper sheets P. In order to bend the leg portions 10*i* of the staple 10 at a constant timing irrespective of the difference in the number of paper sheets P to be stapled to be stapled, the difference in the number of the paper sheets P is absorbed by the movement of the staple press-down portion 22, and the penetrating 2 is configured to move down to the predetermined position.

<Exemplary Configuration of Cutting Blade Guide>

FIG. 10 is a perspective view illustrating one example of the cutting blade guide. The configuration of the cutting blade guide will now be described with reference to the drawing. As described above, the cutting blade 21 is formed so that the first penetrating portion 21*b* of the tip end is offset inwardly with respect to the second penetrating portion 21*c* supported by the penetrating mechanism body 20.

For this reason, in the process in which the blade portion 21*a* of the cutting blade 21 penetrates the paper sheets P by the lowering movement of the penetrating mechanism 2, the force applied to the cutting blade 21 by the penetrating mechanism body 20 acts on the second penetrating portion 21*c*, so that a force is applied to the cutting blade 21 to be inclined inwardly.

The cutting blade guide 23 is projected or retracted between the one pair of cutting blades 21. As illustrated in FIG. 1 and so forth, the cutting blade guide 23 is provided under the paper placing base 80, and is installed to be projected or retracted between the one pair of cutting blades 21 penetrating the paper sheets P, while being urged by the spring 23*a*.

Although the mechanism for operating the cutting blade guide 23 will be described later, in the process in which the cutting blade 21 of the penetrating mechanism 2 penetrates the paper sheets P by the operation of the operating handle 9 and the leg portions 10*i* of the staple 10 penetrate the paper sheets P, the butting blade guide is projected between the one pair of cutting blades 21 to suppress the cutting blades 21 from being falling down. In the process of stapling the leg portions 10*i* of the staple 10 by the bending mechanism 5, the cutting blade guide is retracted between the one pair of cutting blades 21.

<Exemplary Operation of Penetrating Mechanism>

FIGS. 19 to 24 are operation chart illustrating an example of the operation of the penetrating mechanism. The inserting/withdrawing process of the cutting blade 21 with respect to the paper sheets P will be described with reference to each drawing.

Figure 19:
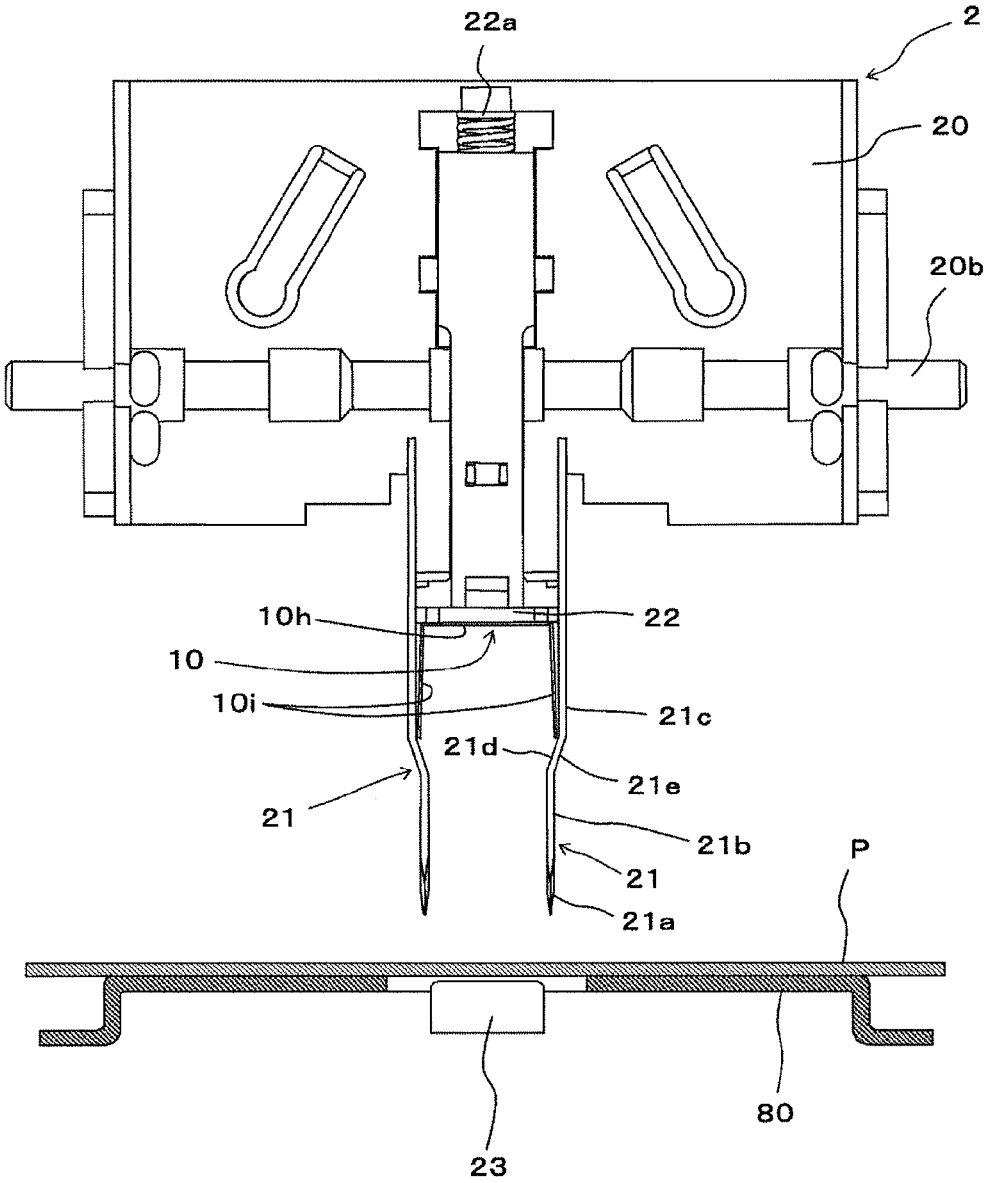
FIG. 19 is an operation chart illustrating an exemplary operation of the penetrating mechanism.

In a standby state, as illustrated in FIG. 19, in the state in which the crown portion 10*h* of the staple 10 is pushed down by the staple press-down portion 22 between the one pair of cutting blades 21, the leg portions 10*i* of the staple 10 are supported by the staple support portion 21*d*.

Figure 20:
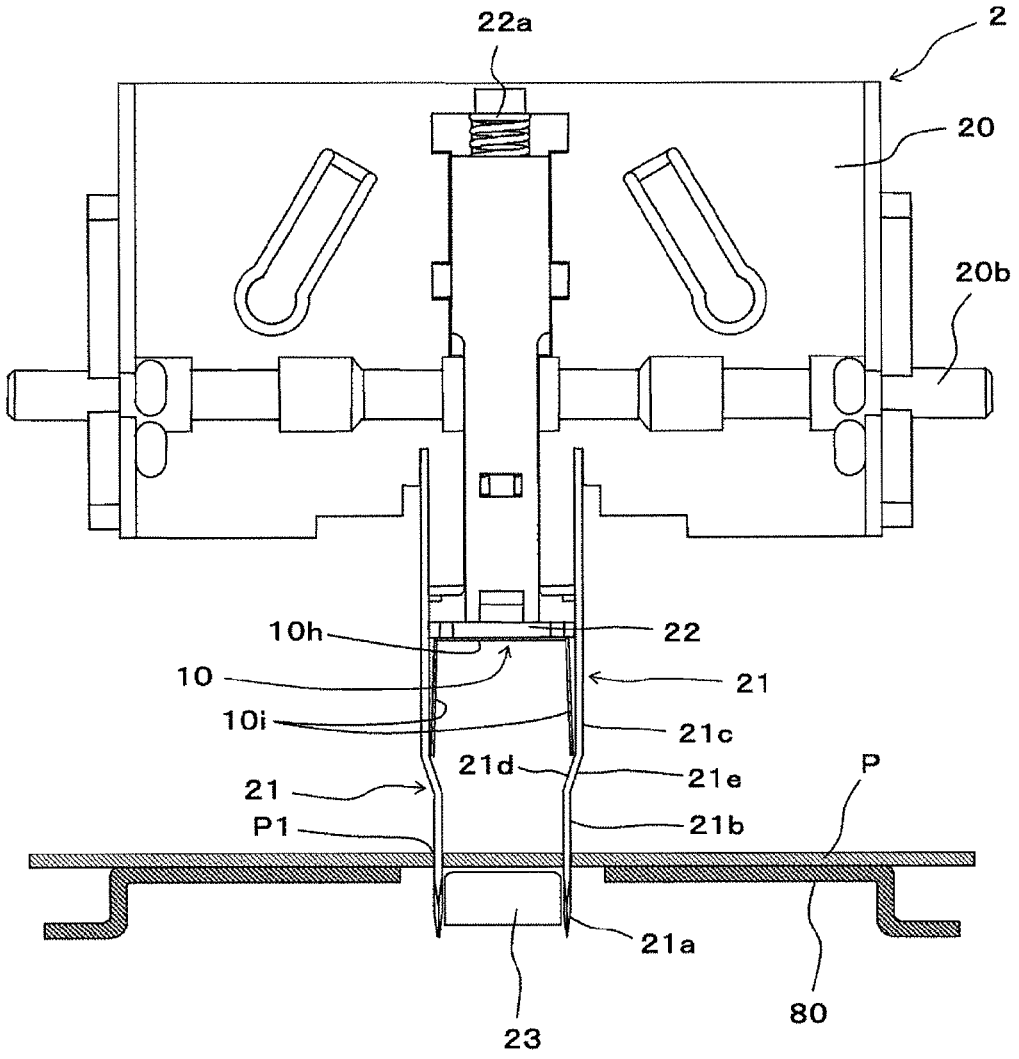
FIG. 20 is an operation chart illustrating an exemplary operation of the penetrating mechanism.

When the penetrating mechanism 2 is moved down by the operation of the operating handle 9 illustrated in FIG. 1 and so forth, and the blades portion 21*a* of the cutting blades 21 reach the paper sheets P placed in the paper placing base 80, the cutting blades 21 start penetrating the paper sheets P, and as illustrated in FIG. 20, holes P1 are opened in the paper sheets P.

According to the cutting blades 21, the first penetrating portions 21*b* having the narrow width of the one pair of cutting blades 21 first penetrate the paper sheets P. As described above, in the process in which the blade portion 21*a* of the cutting blade 21 penetrates the paper sheets, the force applied to the cutting blade 21 by the penetrating mechanism body 20 acts on the second penetrating portion 21*c* which is offset outwardly with respect to the first penetrating portion 21*b*, so that the cutting blade 21 is about to be inclined inwardly.

In this way, since the cutting blade guide 23 protrudes between the one pair of cutting blades 21 penetrating the paper sheets P, each cutting blade 21 is prevented from being inclined inwardly by the penetrating operation of the cutting blades 21 to the paper sheets P, so that the cutting blades 21 penetrates in a direction substantially perpendicular to the paper sheets P.

Figure 21:
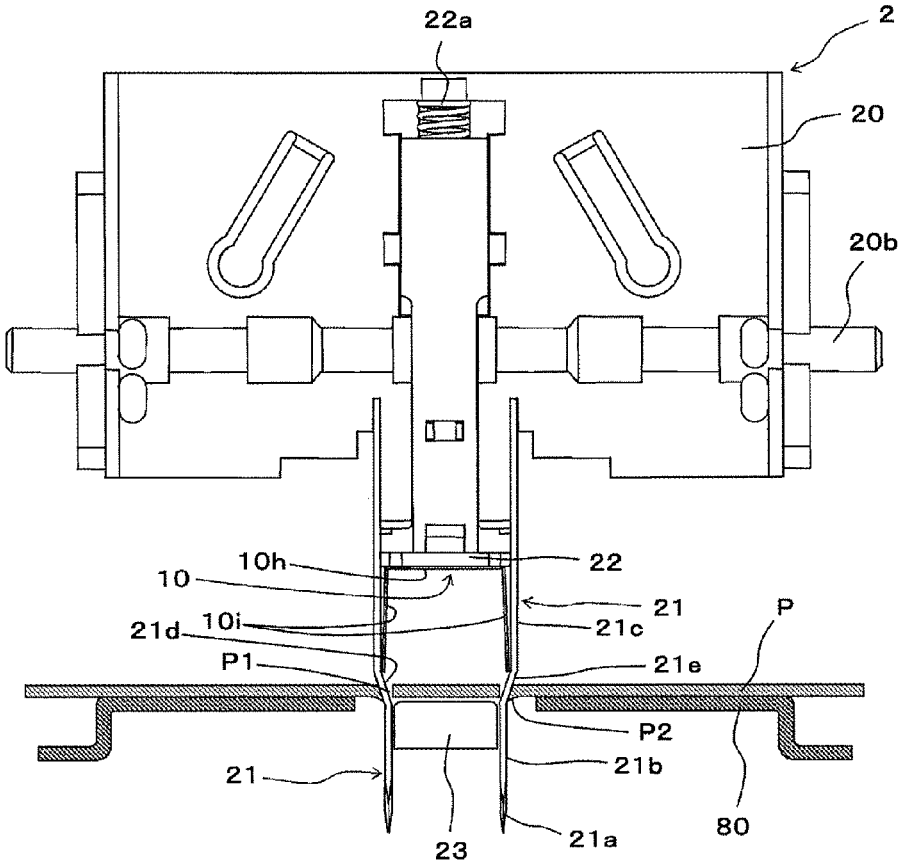
FIG. 21 is an operation chart illustrating an exemplary operation of the penetrating mechanism.

If the penetrating mechanism 2 is further moved down, as illustrated in FIG. 21, the hole expansion portion 21*e* of the cutting blade 21 reaches the paper sheets P. The hole expansion portion 21*e* has the gentle slope so that the outer surface shape of the cutting blade 21 is gradually widened from the first penetrating portion 21*b* to the second penetrating portion 21*c*. Therefore, when the hole expansion portion 21*e* of the cutting blade 21 penetrates the paper sheets P by the lowering movement of the penetrating mechanism 2, the burr P2 is formed at the outside of the hole P1 of the paper sheets P to face downward, so that the hole P1 is widened in an outward direction.

According to the penetrating mechanism 2, in the state in which the crown portion 10*h* of the staple 10 is pushed down by the staple press-down portion 22 between the one pair of cutting blades 21, the leg portion 10*i* of the staple 10 are supported by the staple support portion 21*d*. The staple support portion 21*d* is formed at the inner portion of the hole expansion portion 21*e* in the respective cutting blades 21 by the shape of the cutting blades 21 forming the hole expansion portion 21*e*.

In this way, when the hole expansion portion 21*e* of the cutting blade 21 penetrates the paper sheets P by the lowering movement of the penetrating mechanism 2, the leg portions 10*i* of the staple 10 supported by the staple support portion 21*d* penetrate the hole P1 of the paper sheets P.

Figure 22:
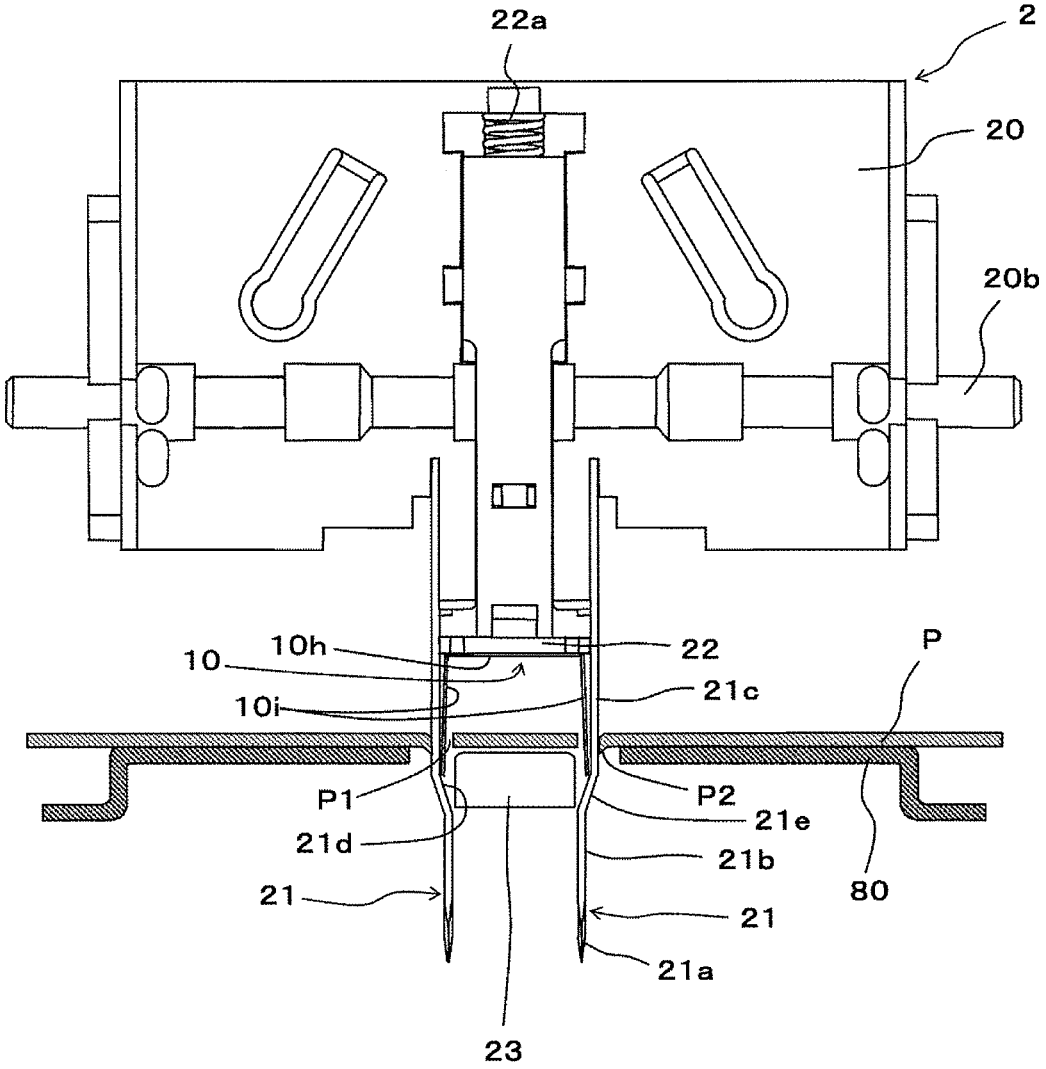
FIG. 22 is an operation chart illustrating an exemplary operation of the penetrating mechanism.

If the penetrating mechanism 2 is further lowered, as illustrated in FIG. 22, the second penetrating portions 21*c* of the cutting blades 21 penetrate the hole P1 of the paper sheets P, and the leg portions 10*i* of the staple 10 supported inside the second penetrating portions 21*c* penetrate the hole P1 of the paper sheets P.

In the process in which the second penetrating portions 21*c* penetrate the hole P1 of the paper sheets P, the force acting on the cutting blade 21 by the penetrating mechanism body 20 coincides with the second penetrating portion 21*c*, the force is not applied to the cutting blade 21 to be inclined inwardly. Therefore, the cutting blade guide 23 is configured to be retracted in the process in which the second penetrating portion 21*c* of the cutting blade 21 penetrates the hole P1 of the paper sheets P.

As described above, since the interval of the two cutting blades 21 is substantially equal to the inner width of the one pair of leg portions 10*i* of the staple 10 which are formed by the first penetrating portion 21*b*, the hole p1 of the paper sheets P formed by the first penetrating portion 21*b* substantially coincides with the position of the leg portion 10*i* of the staple 10.

The burr P2 is formed at the outside of the hole P1 of the paper sheets P to face downward by the stepped portion of the hole expansion portion 21*e* outside each cutting blade 21, so that the hole P1 is widened in the outward direction by the interval through which the overlapped cutting blade 21 and leg portion 10*i* of the staple 10 can pass.

The hole expansion portion 21*e* has the gentle slope so that the outer surface shape of the cutting blade 21 is gradually widened from the first penetrating portion 21*b* to the second penetrating portion 21*c*. Therefore, in the process in which the cutting blade 21 penetrates the paper sheets P, the increase in resistance is suppressed when the hole expansion portion 21*e* of the cutting blade 21 passes the hole P1 of the paper sheets P.

Accordingly, the force required to move the penetrating mechanism 2 down is small, and thus an operating load to push the operating handle 9 down is decreased.

Figure 23:
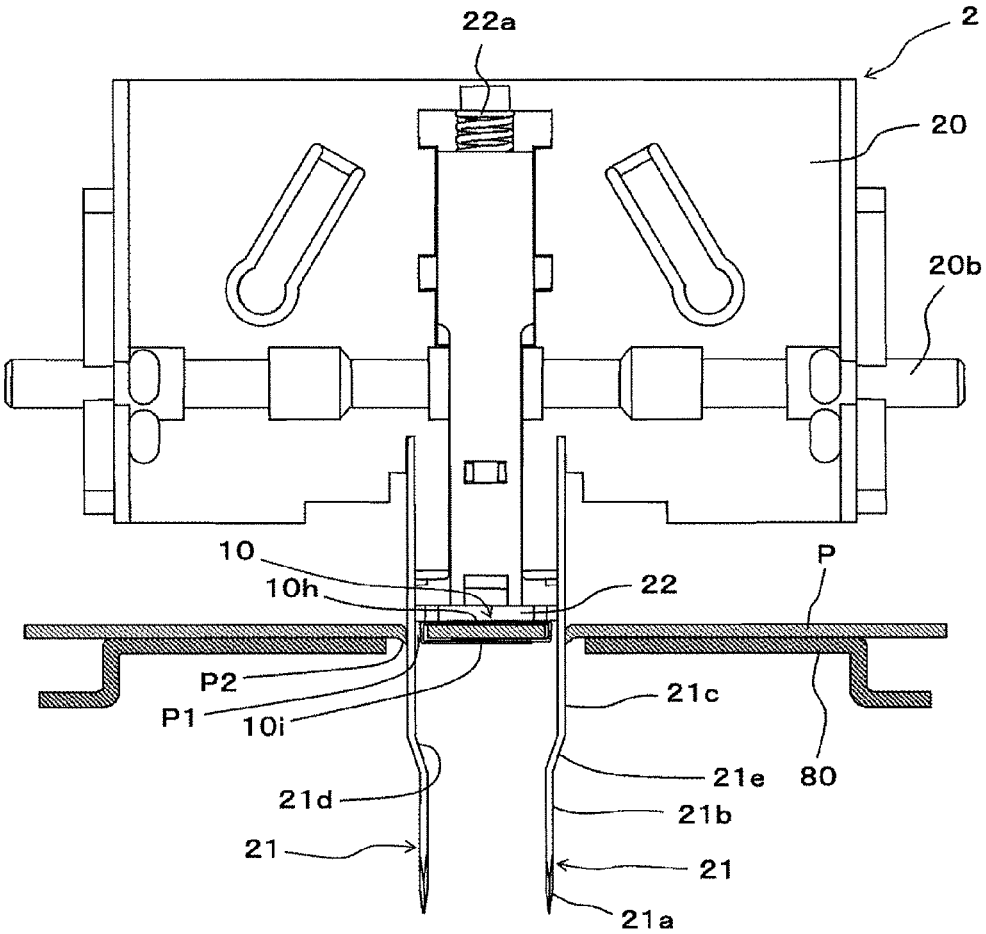
FIG. 23 is an operation chart illustrating an exemplary operation of the penetrating mechanism.

After the penetrating mechanism 2 is further lowered and the crown portion 10*h* of the staple 10 arrives at the paper sheets P, the leg portions 10*i* of the staple 10 are bent inwardly by the operation of the bending mechanism 5 which will be described later, and as illustrated in FIG. 23, the one pair of leg portions 10*i* are bonded.

Since the holes P1 formed in the paper sheets P by the cutting blades 21 are widened outwardly by the hole expansion portions 21*e* so that the overlapped cutting blades 21 and the leg portions 10*i* of the staple 10 can pass the holes, the burr is not formed in the hole P1. Accordingly, when the leg portions 10*i* of the staple 10 are bent inwardly, there is no convex portion to deform the leg portion 10*i*, and thus the appearance of the staple 10 stapling the paper sheets can be improved.

Figure 24:
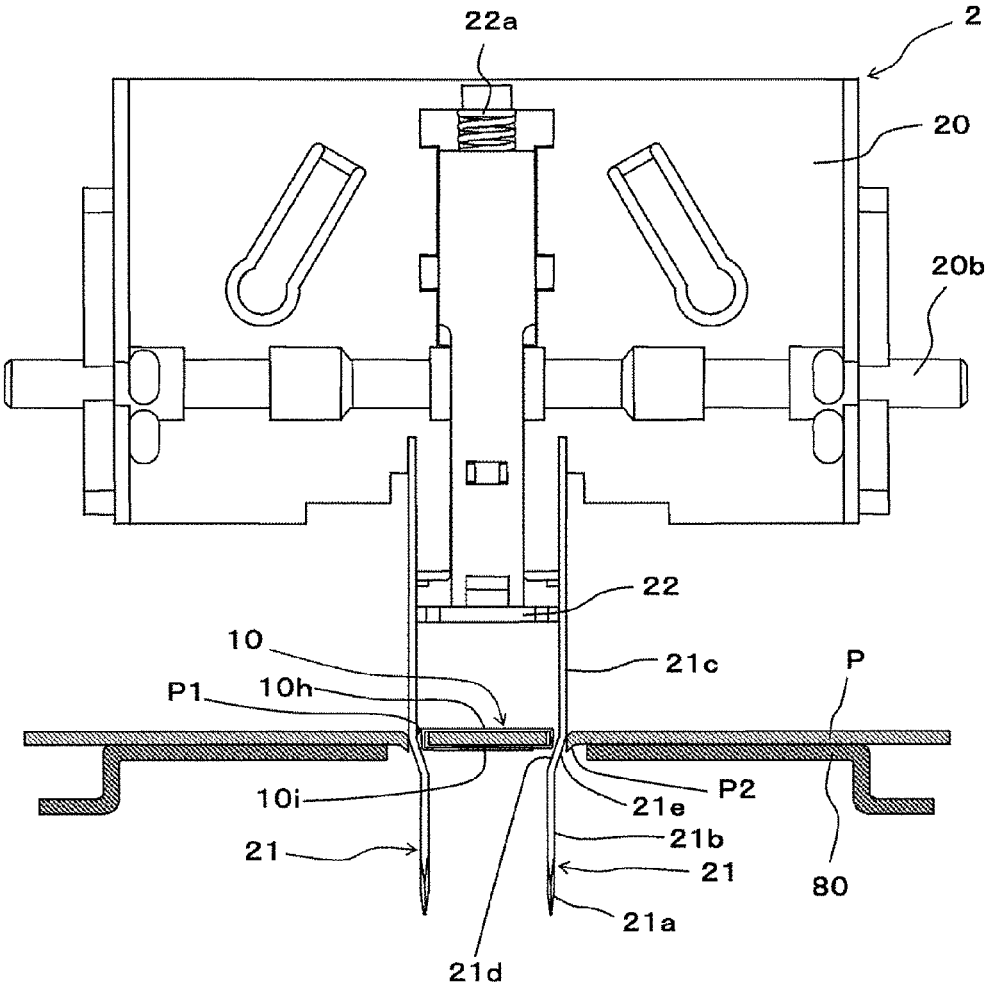
FIG. 24 is an operation chart illustrating an exemplary operation of the penetrating mechanism.

After the paper sheets P are stapled by the staple 10, if the penetrating mechanism 2 is moved up by upward returning of the operation handle 9, and as illustrated in FIG. 24, the staple support portion 21*d* of the cutting blade 21 arrives at the back surface of the paper sheets P.

The staple support portion 21*d* has the gentle slope so that the inner surface shape of the cutting blade 21 is gradually narrowed from the second penetrating portion 21*c* to the first penetrating portion 21*b*. Also, the hole P1 through which the staple 10 stapling the paper sheets P passes is widened outwardly.

When the staple support portion 21*d* is withdrawn from the paper sheets P, the force acts on the cutting blade 21 to widen the blade 21 outwardly. However, since the hole P1 formed by the cutting blade 21 is shaped to be widened outwardly, the resistance is suppressed when the staple support portion 21*d* of the cutting blade 21 passes the hole P1 of the paper sheets P in the process in which the cutting blade 21 is withdrawn from the paper sheets P.

Accordingly, the force required to move the penetrating mechanism 2 up is small, and thus an operating load to return the operating handle 9 is decreased.

Figure 25A:
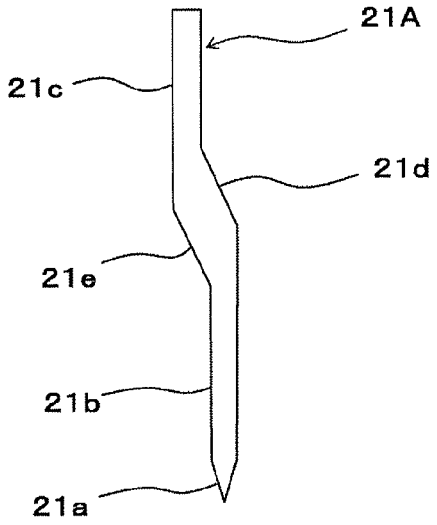
FIG. 25(*a*) is an explanatory diagram illustrating a variation of the cutting blade.
Figure 25B:
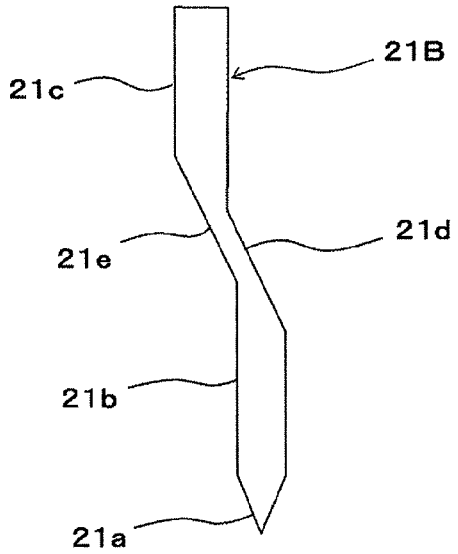

FIG. 25 is an explanatory diagram illustrating a variation of the cutting blade. The cutting blade 21 of the above embodiment is bent in the substantial crank form at the predetermined intermediate position which becomes the boundary between the first penetrating portion 21*b* and the second penetrating portion 21*c*, with the blade thickness being substantially constant. The interval between the two cutting blades 21 is narrow at the tip end provided with the blade portion 21*a*. The hole expansion portion 21*e* is formed by the stepped portion, of which the outer width is widened from the tip end to the base end, at the outer surface of the one pair of cutting blades 21. The staple support portion 21*d* is formed by the stepped portion, of which the inner width is widened from the tip end to the base end, at the inner surface of the one pair of cutting blades 21.

Whereas, like a cutting blade 21A according to a variation illustrated in FIG. 25(*a*), the blade thickness may be thickened at the predetermined intermediate position which becomes the boundary between the first penetrating portion 21*b* and the second penetrating portion 21*c*. Thus, the hole expansion portion 21*e* may be formed by the stepped portion, of which the outer width is widened from the tip end to the base end, at the outer surface of the one pair of cutting blades 21, and the staple support portion 21*d* may be formed by the stepped portion, of which the inner width is widened from the tip end to the base end, at the inner surface of the one pair of cutting blades 21.

Further, like a cutting blade 21B according to a variation illustrated in FIG. 25(*b*), the blade thickness may be thinned at the predetermined intermediate position which becomes the boundary between the first penetrating portion 21*b* and the second penetrating portion 21*c*, so that the staple support portion 21*d* is provided at the tip end with respect to the hole expansion portion 21*e*.

Figure 26:
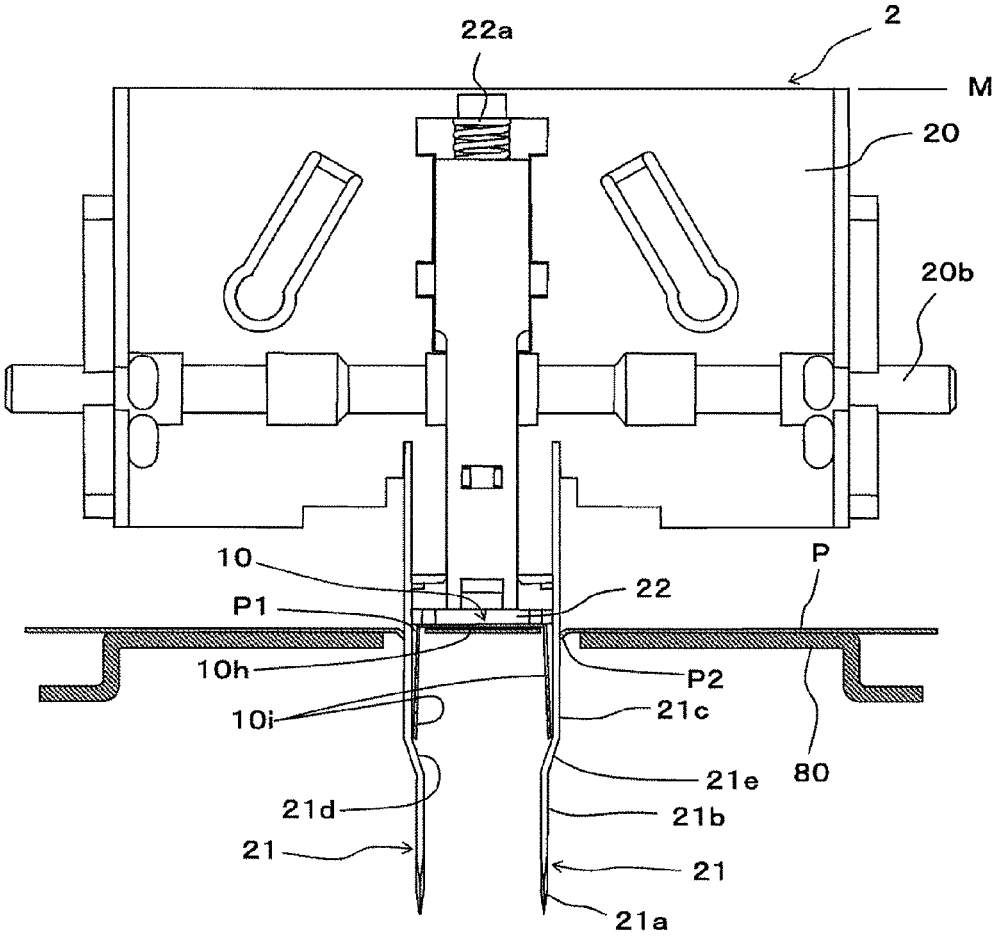
FIG. 26 is an operation chart illustrating an exemplary operation of the penetrating mechanism according to a difference in the number of paper sheets
Figure 27:
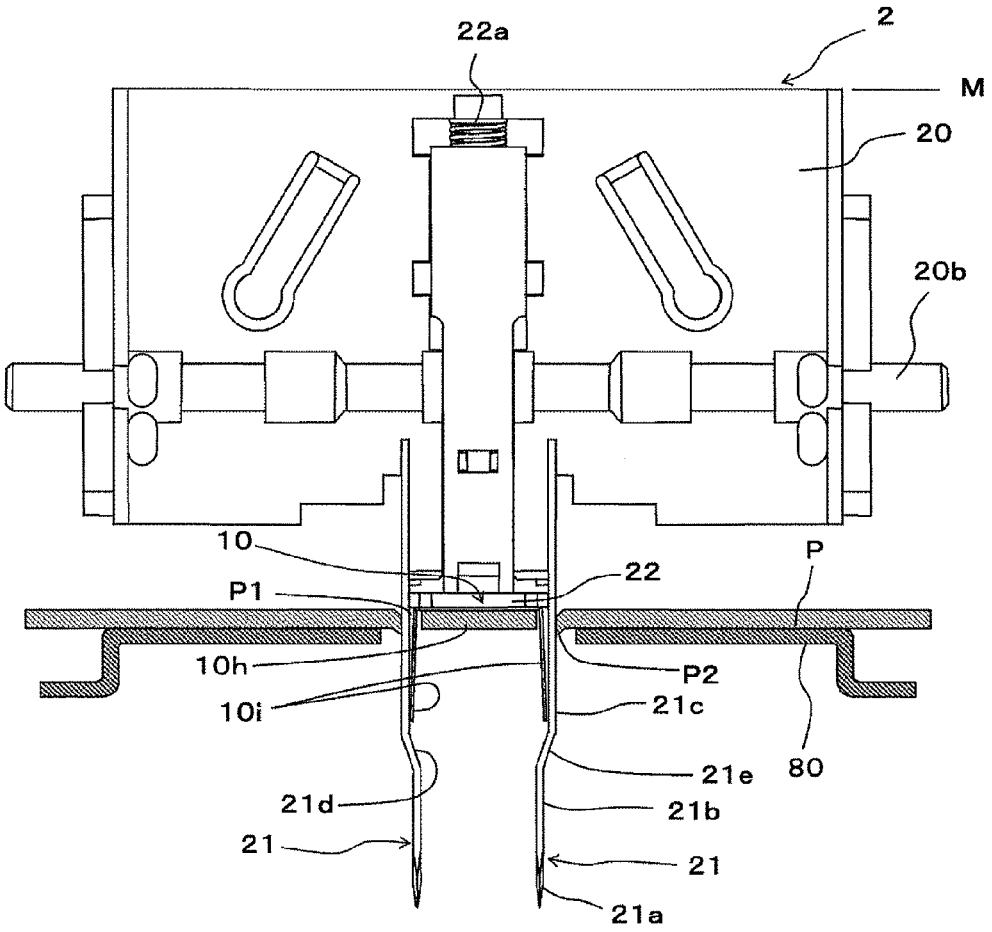
FIG. 27 is an operation chart illustrating an exemplary operation of the penetrating mechanism according to the difference in the number of paper sheets.

FIGS. 26 and 27 are operation charts illustrating an exemplary operation of the penetrating mechanism according to the difference in the number of the paper sheets. The stapler 1 is configured to bind the paper sheets P from n=2 sheets, which is the minimum number of sheets, to the predetermined maximum number of sheets N, for example, N=15 sheets.

After the penetrating mechanism 2 is lowered and the crown portion 10*h* of the staple 10 arrives at the paper sheets P, the operation of the bending mechanism 5 starts, and thus the leg portions 10*i* of the staple 10 are bent. The lifting movement of the penetrating mechanism 2 and the operation of the bending mechanism 5 are associated, so that the position of the penetrating mechanism 2 to start the operation of the bending mechanism 5 is referred to as a bending mechanism operating position M.

As illustrated in FIG. 26, in the state in which the paper sheets P having the minimum number of stapled sheets n is placed in the paper placing base 80, when the penetrating mechanism 2 is lowered to the bending mechanism operating position M, the staple press-down portion 22 comes into contact with the crown portion 10*h* of the staple 10 at a predetermined lower end position, and thus the crown portion 10*h* presses the paper sheets P.

Meanwhile, as illustrated in FIG. 27, in the state in which the paper sheets P having the maximum number of stapled sheets N are placed in the paper placing base 80, when the penetrating mechanism 2 is lowered to the bending mechanism operating position M, the staple press-down portion 22 compresses the spring 22*a*, and then the spring 22*a* is pushed up to a predetermined upper end position. The staple press-down portion 22 comes into contact with the crown portion 10*h* of the staple 10, and thus the crown portion 10*h* presses the paper sheets P.

In this way, in the penetrating mechanism 2 which pushes down the staple 10 to penetrate the paper sheets P, the staple press-down portion 22 pushing down the crown portion 10*h* of the staple 10 is able to move in the vertical direction in accordance with the moving direction of the penetrating mechanism 2, and is urged downwardly by the spring 22*a*, thereby maintaining the bending mechanism operating position M at a constant height, irrespective of the number of the paper sheets P.

In the case where the staple press-down portion 22 is stationary, the operating position of the bending mechanism is set to the minimum number of paper sheets, and then the maximum number of paper sheets is stapled, the penetrating mechanism is not lowered to the bending mechanism operating position, so that the bending mechanism probably is not operated. Also, in the case where the bending mechanism operating position is set to the maximum number of sheets of paper sheets and then the minimum number of paper sheets is stapled, the crown portion of the staple is not sufficiently pressed.

Whereas, since the staple press-down portion 22 is operated, the penetrating mechanism is lowered to the bending mechanism operating position M, irrespective of the number of paper sheets, and thus the crown portion 10*h* of the staple 10 is sufficiently pressed to operate the bending mechanism 5.

<Exemplary Configuration of Cutting/Forming Mechanism>

Figure 28:
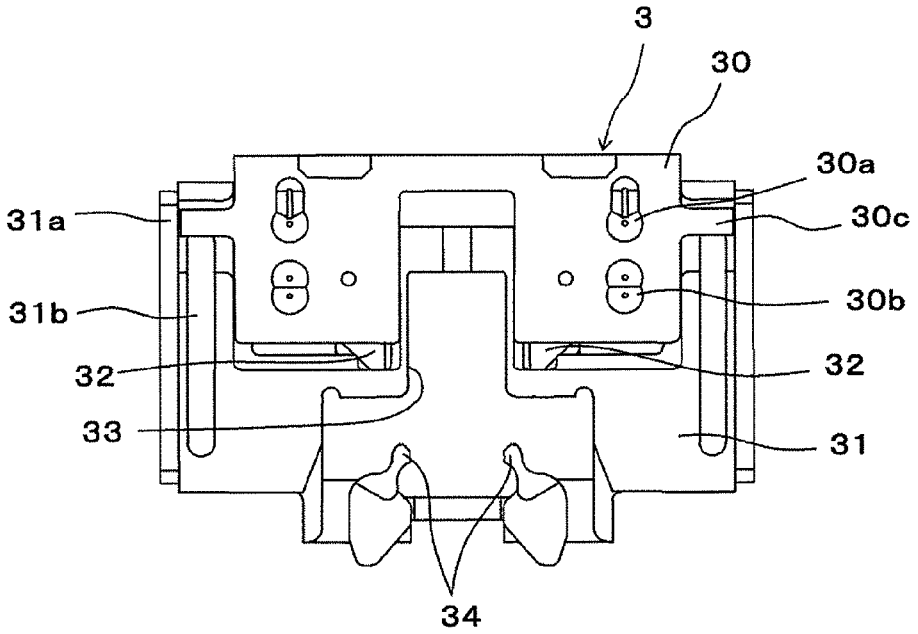
FIG. 28 is a front view illustrating one example of the cutting/forming mechanism.
Figure 29:
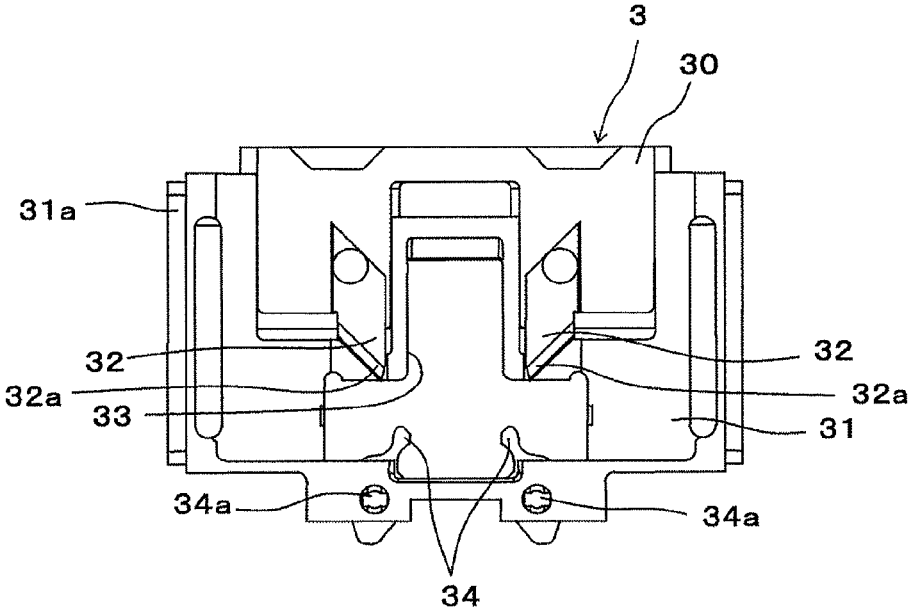
FIG. 29 is a rear view illustrating one example of the cutting/forming mechanism.
Figure 30:
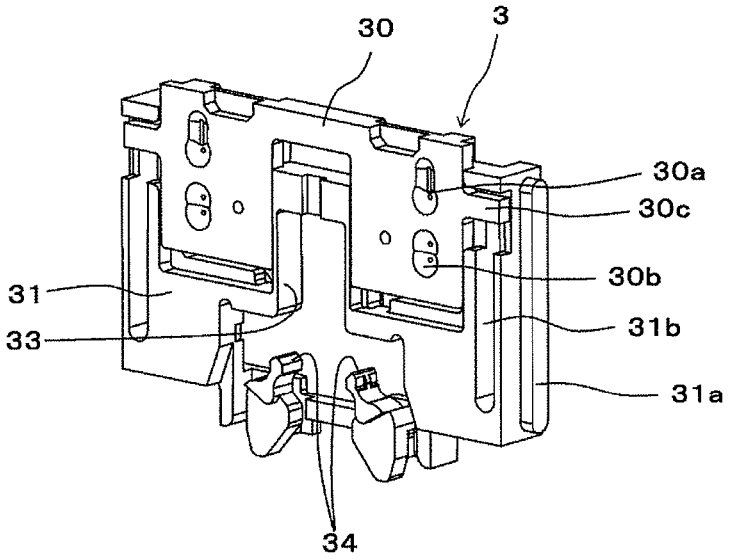
FIG. 30 is a perspective view of the cutting/forming mechanism when seen from a front.
Figure 31:
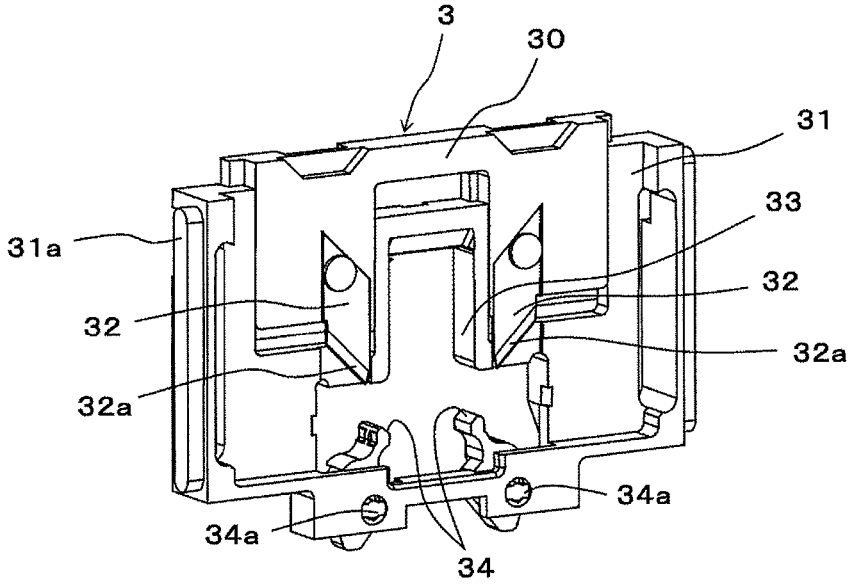
FIG. 31 is a perspective view of the cutting/forming mechanism when seen from a rear.

FIG. 28 is a front view illustrating one example of the cutting/forming mechanism. FIG. 29 is a rear view illustrating one example of the cutting/forming mechanism. FIG. 30 is a perspective view of the cutting/forming mechanism when seen from a front. FIG. 31 is a perspective view of the cutting/forming mechanism when seen from a rear. The configuration of the cutting/forming mechanism 3 will now be described with reference to each drawing.

The cutting/forming mechanism 3 is one example of a cutting/forming part, and includes a cutter plate 30 for cutting the staple-materials-connecting-body 10*a*, and a forming plate 31 for forming the staple material 10 cut by the cutter plate 30 to be the formed staple 10.

The cutter plate 30 has two cutting blades 32, and first groove portions 30*a*, second groove portions 30*b* and convex portions 30*c* which are transmitted with a driving force from the penetrating mechanism 2. The cutter plate 30 is attached to the forming plate 31 in a vertically movable manner.

The cutting blade 32 is one example of a connecting portion cutting blade, and each cutting blade 32 is provided with a blade portion 32*a* which is inclined to its tip end becoming the tip end. Each cutting blade 32 is attached to the cutter plate 30 in a state in which the inclined blade portions 32*a* are faced outwardly.

In each cutting blade 32, an interval between blade edges of the inclined blade portions 32*a* conforms to an interval between the one pair of holes 10*d* of the staple-materials-connecting-body 10*a*. Further, a length of the blade portion 32*a* is set to be longer than that of the connecting portion 10*c* of the staple-materials-connecting-body 10*a*.

In the cutting/forming mechanism 3, the cutting blade 32 is positioned at the rear side of the forming plate 31, and at the retracted position in which the cutter plate 30 is raised with respect to the forming plate 31, the cutting blade 32 is retracted from the forming plate 31, so that the cutting blade 32 is not exposed. At the cutting position in which the cutter plate 30 is lowered with respect to the forming plate 31, the cutting blade 32 protrudes from the forming plate 31.

The first groove portion 30*a* and the second groove portion 30*b* are installed at a predetermined interval in a vertical direction along the moving direction of the penetrating mechanism 2 and the cutting/shaping mechanism 3. The convex portions 30*c* protrude outwardly from both ends of the cutter plate 30 in the widthwise direction.

The first groove portion 30*a* and the second groove portion 30*b* are formed in a desired shape so that the protruding pin 20*c* provided on the penetrating mechanism 2 is fitted into the groove portions. A lower end side of the first groove 30*a* is formed deeply as compared to an upper end side thereof. In the state in which the protruding pin 20*c* is positioned at the lower end side of the first groove portion 30*a*, substantially the entire protruding pin 20*c* is fitted into the first groove portion 30*a*. Further, in the state in which the protruding pin 20*c* is positioned at the upper end side of the first groove portion 30*a*, a portion of the protruding pin 20*c* is fitted into the first groove portion 30*a*.

The second groove portion 30*b* is configured to have the same depth as that of the lower end side of the first groove portion 30*a*, so that substantially the entire protruding pin 20*c* is fitted into the second groove portion 30*b*.

The forming plate 31 has a staple forming portion 33 for forming the staple 10, and opening retaining members 34 for maintaining the shape of the staple 10 formed by the staple forming portion 33. Also, the forming plate 31 has guide convex portions 31*a* for guiding the movement of the cutting/forming mechanism 3, and guide groove portions 31*b* for guiding the movement of the penetrating mechanism 2 and the cutting/shaping mechanism 3.

The staple forming portion 33 is formed in such a way that a length of a depth direction is substantially equal to a width of a short-side direction of the staple 10. The staple forming portion 33 is provided with a convex opening formed by combining an opening which is wider that the width of the staple of a substantially straight type in the longitudinal direction, and an opening which is slightly wider than the outer width of the crown portion 10*h* of the staple 10. The receiving table 16 of the staple cartridge 11 illustrated in FIG. 12 or the like protrudes into the opening of the staple forming portion 33 when the staple cartridge 11 is mounted onto the stapler 1.

The forming plate 31 is provided with one pair of opening retaining members 34 opposite to each other below the staple forming portion 33. The opening retaining members 34 are attached to the forming plate 31 in such a way that they are rotatable around a shaft 34*a*. In association with the vertical movement of the cutting/forming mechanism 3, the opening retaining members 34 are rotated between a position which they are opposite to each other at an interval substantially equal to the outer width of the one pair of leg portions 10*i* of the staple 10 formed by the staple forming portion 33, and a position in which they are opposite to each other at an interval wider than the outer width of the one pair of leg portions 10*i* of the staple 10 formed by the staple forming portion 33.

The guide convex portions 31*a* protrude outwardly from both ends of the forming plate 31 in the widthwise direction, and are engaged with the guide grooves 82*b* which are provided at both sides of the body section 8 of the stapler 1 in the widthwise direction and opened along the moving direction of the cutting/forming mechanism 3. The guide convex portions 31*a* are formed in an elliptical shape which is formed by connecting two semicircles with a straight line, to restrict a posture of the cutting/forming mechanism 3 from being changed in its rotating direction.

The guide groove portions 31*b* are formed by installing grooves, along which the guide convex portions 20*d* provided on the penetrating mechanism 2 are movable, on the surface of the forming plate 31, which is opposite to the penetrating mechanism 2, along the moving direction of the penetrating mechanism 2 and the cutting/forming mechanism 3. The convex portions 30*c* provided on the cutter plate 30 protrude into the guide groove portions 31*b*. The guide convex portions 20*d* provided on the penetrating mechanism 2 abut against the convex portions 30*c*, and thus the cutter plate 30 is pushed up with respect to the forming plate 31 by the lifting movement of the penetrating mechanism 2.

<Exemplary Operation of Cutting/Forming Mechanism>

FIGS. 32 to 36 are operation charts illustrating the exemplary operation of the cutting/forming mechanism. The process of cutting the staple material 10*m* from the staple-materials-connecting-body 10*a* and forming the staple 10 will now be described with reference to each drawing.

As illustrated in FIG. 1 and so forth, as the staple cartridge 11 is mounted in the cartridge receiving portion 81 of the stapler 1, the receiving table 16 protrudes the staple forming portion 33 of the cutting/forming mechanism 3.

Figure 32:
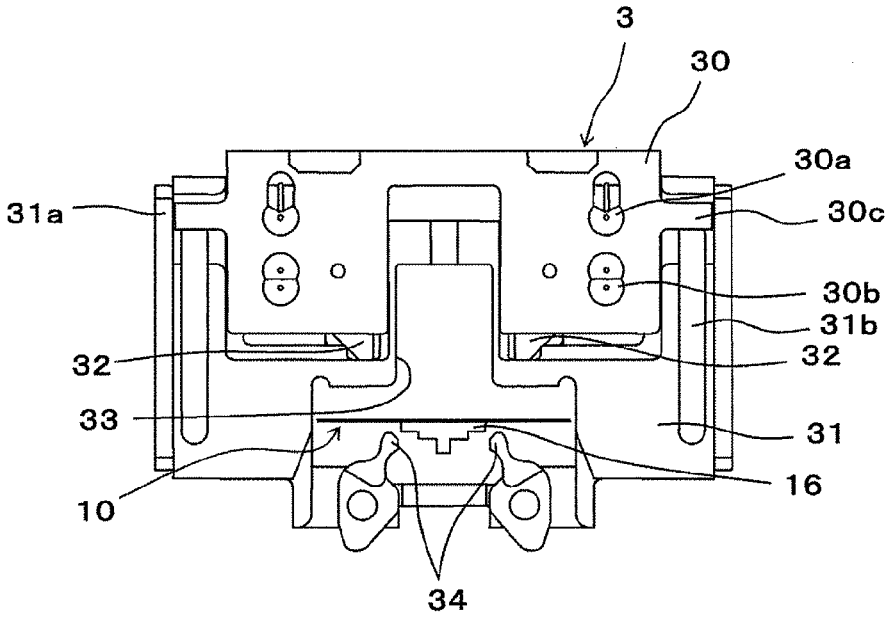
FIG. 32 is an operation chart illustrating an exemplary operation of the cutting/forming mechanism.

In the standby state, as illustrated in FIG. 32, the cutter plate 30 is positioned at the retracted position lifted with respect to the forming plate 31, and the cutting blade 32 is retracted from the forming plate 31, so that the cutting blade 32 is not exposed to the staple forming portion 33.

Further, the staple-materials-connecting-body 10*a* is conveyed to the cutting/forming mechanism 3, and the non-cut staple material 10*m* located at the leading end of the staple-materials-connecting-body 10*a* is supported on the receiving table 16 of the staple cartridge 11 by the staple holding portion 17 in the held state.

In the standby state of the cutting/forming mechanism 3, since the cutting blade 32 is not exposed to the staple forming portion 33, as illustrated in FIG. 6, even though the staple cartridge 11 is disengaged from the stapler 1, the cutting blade 32 is not exposed, thereby securing the high safety.

In the cutting/forming mechanism 3, the lowering movement of the penetrating mechanism 2 which is moved down by the operation of the operating handle 9 illustrated in FIG. 1 and so forth is transmitted to the cutter plate 30 by engagement of the protruding pin 20*c* provided on the penetrating mechanism 2 and the first groove portion 30*a* provided on the cutter plate 30.

Figure 33:
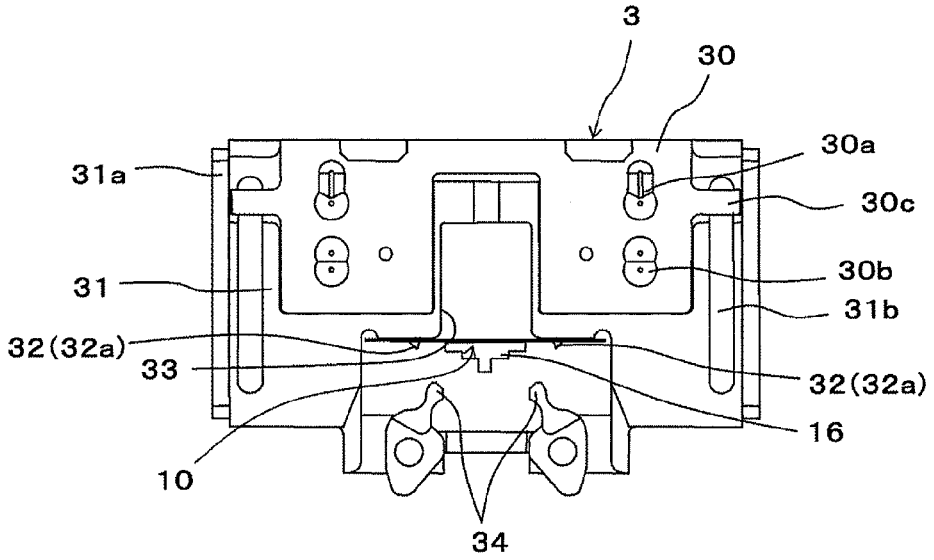
FIG. 33 is an operation chart illustrating an exemplary operation of the cutting/forming mechanism.

Accordingly, the cutter plate 30 is moved to the cutting position lowered with respect to the forming plate 31, and as illustrated in FIG. 33, the cutting blade 32 protrudes from the staple forming portion 33 of the forming plate 31. When the cutting blade 32 protrudes into the staple forming portion 33, the connecting portion 10*c* between the non-cut staple material 10*m* located at the leading end and the next staple material 10*m* is cut by the cutting blade 32 at the staple-materials-connecting-body 10*a* supported by the receiving table 16.

Figure 37A:
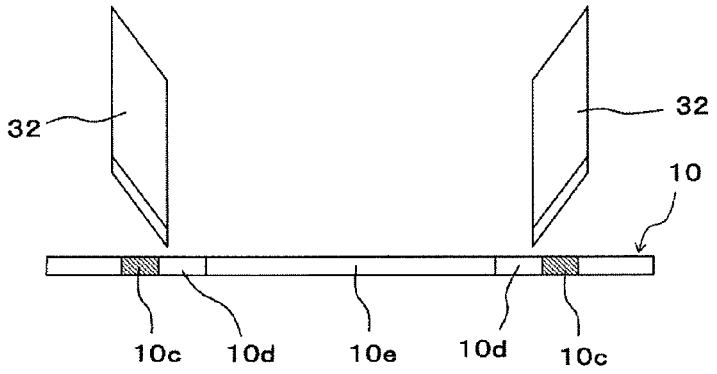
FIGS. 37(*a*), 37(*b*) and 37(*c*) illustrate an operation of cutting the staple-materials-connecting-body.
Figure 37B:
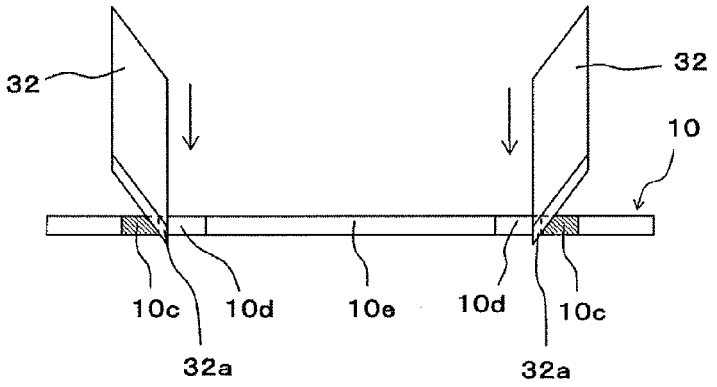
Figure 37C:
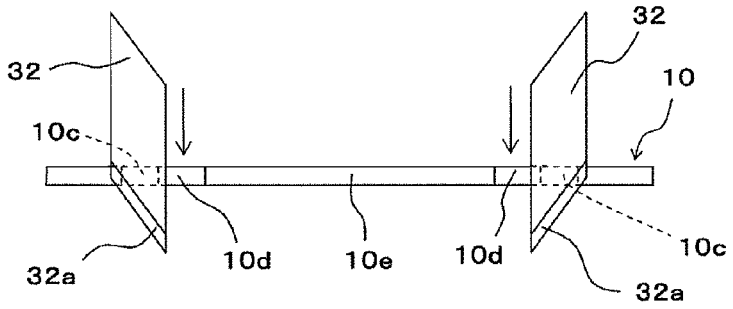

FIG. 37 is an operation chart illustrating the operation of cutting the staple-materials-connecting-body, and shows the cutting of the staple-materials-connecting-body 10*a* by the cutting blade 32 in time series. As illustrated in FIGS. 37(*a*) to 37(*c*), as the one pair of left and right cutting blades 32 are lowered with respect to the staple-materials-connecting-body 10*a*, the blade portion 32*a* of the tip end of each cutting blade 32 is inserted into the hole 10*d*, and thus each connecting portion 10*c* is cut in the hole 10*d*.

As the blade portions 32*a* each inclined outwardly are pushed to the one pair of left and right connecting portions 10*c*, the force is respectively applied the staple material 10*m* to be cut and the next staple material 10*m* in an opposite direction from the inside to the outside along the longitudinal direction, thereby cutting the connecting portion 10*c*. The inner portion of the connecting portions 10*c* between the holes 10*d* is cut by the slit portion 10*e* in advance, and it is not necessary to cut the center portion of the staple material 10*m* which becomes a portion of the leg portion 10*i* and the crown portion 10*h*.

Accordingly, it is not necessary to support the staple material 10*m* to be cut and the next staple material 10*m* in the wide range, and it is possible to cut the staple material 10*m* with high precision by the simple configuration of holding the staple with the staple holding portion 17.

Figure 34:
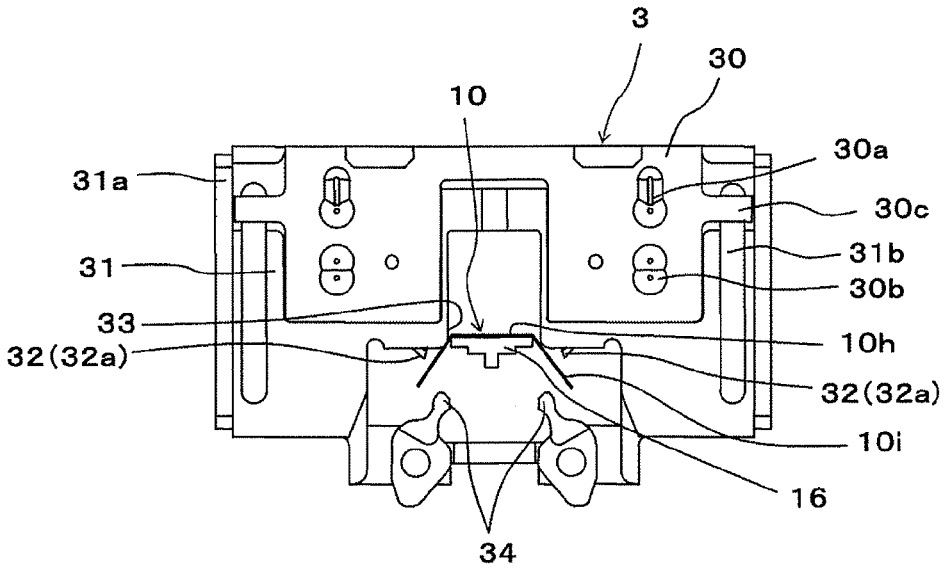
FIG. 34 is an operation chart illustrating an exemplary operation of the cutting/forming mechanism.

If the cutter plate 30 is moved to the cutting position, in association with the lowering movement of the penetrating mechanism 2, the forming plate 31 is lowered together with the cutter plate 30. If the forming plate 31 is lowered, the portion, corresponding to the crown portion 10*h*, of the cut staple material 10*m* located at the leading end, is supported by the receiving table 16, and as illustrated in FIG. 34, the portions corresponding to the leg portions 10*i* start bending in the first direction.

Figure 35:
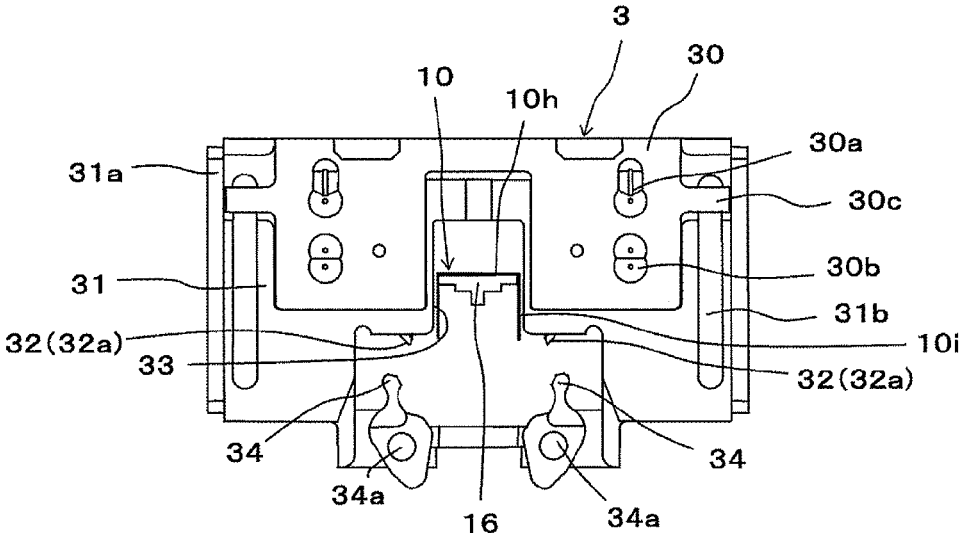
FIG. 35 is an operation chart illustrating an exemplary operation of the cutting/forming mechanism.

If the forming plate 31 is further lowered, as illustrated in FIG. 35, the staple material 10*m* located at the leading end is bent in the first direction so that the one pair of leg portions 10*i* are substantially parallel to each other, thereby forming the crown portion 10*h* and the leg portions 10*i*. Thus, the staple 10 having the crown portion 10*h* and bent leg portions 10*i* is formed. Also, as the forming plate 31 is lowered, in association with the bending operation of the leg portions 10*i* of the staple material 10*m* in the first direction, the opening retaining members 34 are rotated around the shaft 34*a* to be opened.

After the forming of the staple 10 by the cutting/forming mechanism 3 is completed, the penetrating mechanism 2 is further lowered while the cutting/forming mechanism 3 is stationary, and thus the protruding pin 20*c* provided on the penetrating mechanism 2 is away from the first groove portion 30*a* provided on the cutter plate 30 and is engaged into the second groove portion 30*b*.

In the cutting/forming mechanism 3, the movement of the penetrating mechanism 2 which is moved up by the upward returning movement of the operating handle 9 is transmitted to the cutter plate 30 by the engagement of the protruding pin 20*c* provided on the penetrating mechanism 2 and the second groove portion 30*b* provided on the cutter plate 30.

Accordingly, after the cutter plate 30 is moved to the retracted position lifted with respect to the forming plate 31, the forming plate 31 is lifted together with the cutter plate 30. If the forming plate 31 is lifted, the formed staple 10 is withdrawn from the staple forming portion 33. Also, as the forming plate 31 is lifted, the opening retaining members 34 are rotated around the shaft 34*a* to be closed.

As the forming plate 31 is lifted, the leg portions 10*i* may be deformed in the opening direction by the resilience of the material of the staple 10 while the formed staple 10 is withdrawn from the staple forming portion 33. If the interval between the opening retaining members 34 is constant, the opening retaining members collide with the leg portions 10*i* deformed in the opening direction, as the forming plate 31 is lifted.

Figure 36:
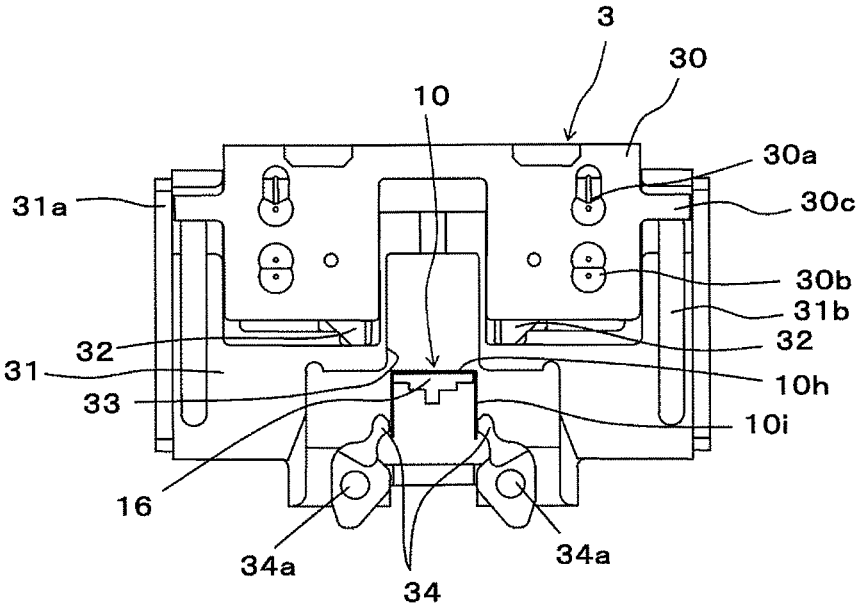
FIG. 36 is an operation chart illustrating an exemplary operation of the cutting/forming mechanism.

Since the opening retaining members 34 are able to be opened or closed by the lifting movement of the forming plate 31, as illustrated in FIG. 36, when the forming plate 31 is lifted and the formed staple 10 is withdrawn from the staple forming portion 33, the opening retaining members 34 are lifted in the open state to the outsides of the one pair of leg portions 10*i*, and thus the opening retaining members 34 are closed, so that the leg portions 10*i* are maintained in the state being bent in the first direction.

Accordingly, there is no operation failure due to that the opening retaining members 34 collide with the leg portions 10*i* of the staple 10 by the lifting movement of the forming plate 31. The staple 10 formed in the desired shape by the cutting/forming mechanism 3 can be conveyed to the penetrating mechanism 2.

<Exemplary Configuration of Paper Holding Mechanism>

The configuration of the paper holding mechanism 4 will now be described with reference to each drawing. The paper holding mechanism 4 is one example of a paper holding part, and includes a paper holding plate 40 for holding the paper sheets P placed in the paper placing base 80 illustrated in FIG. 1 and so forth, and a spring 41 for biasing the paper holding plate 40. Also, the paper holding mechanism 4 includes guide convex portions 42*a* for guiding the movement of the paper holding plate 40, and guide groove portions 42*b* for guiding the movement of the penetrating mechanism 2 and the paper holding mechanism 4.

The guide convex portions 42*a* protrude outwardly from both ends of the paper holding plate 40 in the widthwise direction, and are engaged with the guide grooves 82*c* which are provided at both sides of the body section 8 of the stapler 1 in the widthwise direction and opened along the moving direction of the paper holding mechanism 4. The guide convex portions 42*a* are formed in an elliptical shape which is formed by connecting two semicircles with a straight line, to restrict a posture of the paper holding mechanism 4 from being changed in its rotating direction.

The guide groove portions 42*b* are formed by installing grooves, along which the guide convex portions 20*e* provided on the penetrating mechanism 2 are movable, on the rear surface of the paper holding plate 40, which is opposite to the penetrating mechanism 2, along the moving direction of the penetrating mechanism 2 and the paper holding mechanism 4.

In the paper holding mechanism 4, the guide convex portions 20*e* of the penetrating mechanism 2 abut against the guide groove portions 42*b* to restrict the movement of the paper holding plate 40, and in association with the lowering movement of the penetrating mechanism 2, the paper holding plate 40 is urged downwardly by the spring 41, and thus protrudes into the paper placing base 80 to hold the paper sheets P.

The guide convex portions 20*e* of the penetrating mechanism 2 abut against the guide groove portions 42*b* by the lifting movement of the penetrating mechanism 2, and the paper holding plate 40 is pushed up by the lifting movement of the penetrating mechanism 2, and thus is retracted from the paper placing base 80.

<Exemplary Configuration of Bending Mechanism>

The configuration of the bending mechanism 5 for bending the leg portions 10*i* of the staple 10 penetrating the paper sheets P will now be described with reference to each drawing.

The bending mechanism 5 is one example of a bending part, and includes a first bending member 50R for bending the one leg portion 10*i* of the staple 10 penetrating the paper sheets P, a second bending member 50L for bending the other leg portion 10*i* of the staple 10 penetrating the paper sheets P, and a bonding member 50S for bonding the one leg portion 10*i* and the other leg portion 10*i*.

The first bending member 50R, the second bending member 50L, and the bonding member 50S are provided to the body section 8, and are moved up and down by rotating movement around a shaft 50*a* in this example.

Also, the bending mechanism 5 includes a push-up member 51 for pushing up the first bending member 50R, the second bending member 50L, and the bonding member 50S. The push-up member 51 is provided to a base portion 83, and by rotating movement of the body section 8 with respect to the base portion 83, the first bending member 50R, the second bending member 50L, and the bonding member 50S are relatively pushed up in corporation with the spring 51*a*.

The bending mechanism 5 is configured so that, as the body section 8 is rotated, the first bending member 50R is pushed up by the push-up member 51, the second bending member 50L is pushed up, and then the bonding member 50S is pushed up. Further, in the process in which the first bending member 50R and the second bending member 50L are pushed up, an interval between the first bending member 50R and the second bending member 50L is widened outwardly, and then is narrowed inwardly.

Also, the bending mechanism 5 includes ejecting members 52 performing the operation of inwardly bending the leg portions 10*i* of the staple 10 penetrating the paper sheets P, before the first bending member 50R and the second bending member 50L start the operation of bending the leg portions 10*i* of the staple 10.

The ejecting members 52 are urged by the spring 52*b* in accordance with its rotating movement around the shaft 52*a*, and thus protrude inwardly from the ejecting hole 21*f* provided in the cutting blade 21 to inwardly bend the leg portions 10*i* of the staple 10 supported by the cutting blades 21.

Also, the bending mechanism 5 includes a clutch mechanism 53 for restricting and releasing the rotating movement of the body section 8 with respect to the base portion 83, and operating the ejecting member 52, in association with the operation of the penetrating mechanism 2 lifted by operation of the operating handle 9.

The clutch mechanism 53 has a slide member 54 transmitted with the operation of the operating handle 9, a spring 55*a* for urging the slide member 54, and a receiving member 55*b* abutting against the slide member 54 to restrict the rotation of the body section 8.

The slide member 54 has a pin 54*a* engaged with the link 92 to which the operation of the operating handle 9 is transmitted, a guide portion 54*b* for operating the ejecting member 52, and an operating convex portion 54*c* for operating cutting blade guide 23, and is attached to the body section 8 in a horizontally sliding manner. The slide member 54 constitutes a guide driving part for operating the cutting blade guide 23 in association with the operation of the penetrating mechanism 2.

As illustrated in FIG. 3, the link 92 connected to the operating handle 9 is provided with an elongated slot 92*b* to which the pin 54*a* of the slide member 54 is engaged. In the displacement of the link 92 caused by the operating handle 9 which is pushed down and then is rotated around the shaft 90, the driving force is not transmitted to the pin 54*a* due to the shape of the elongated slot 92*b*, until the operating handle 9 is pushed down to the predetermined position. As a result, the slide member 54 is not displaced.

If the operating handle 9 is pushed down to the predetermined position, the pin 54*a* is pushed backward, and thus the slide member 54 is moved backward. Also, in the displacement of the link 92 caused by the operating handle 9 which is pushed up and then is rotated around the shaft 90, the slide member 54 is urged by the spring 55*a* and thus is moved forward.

Figure 18:
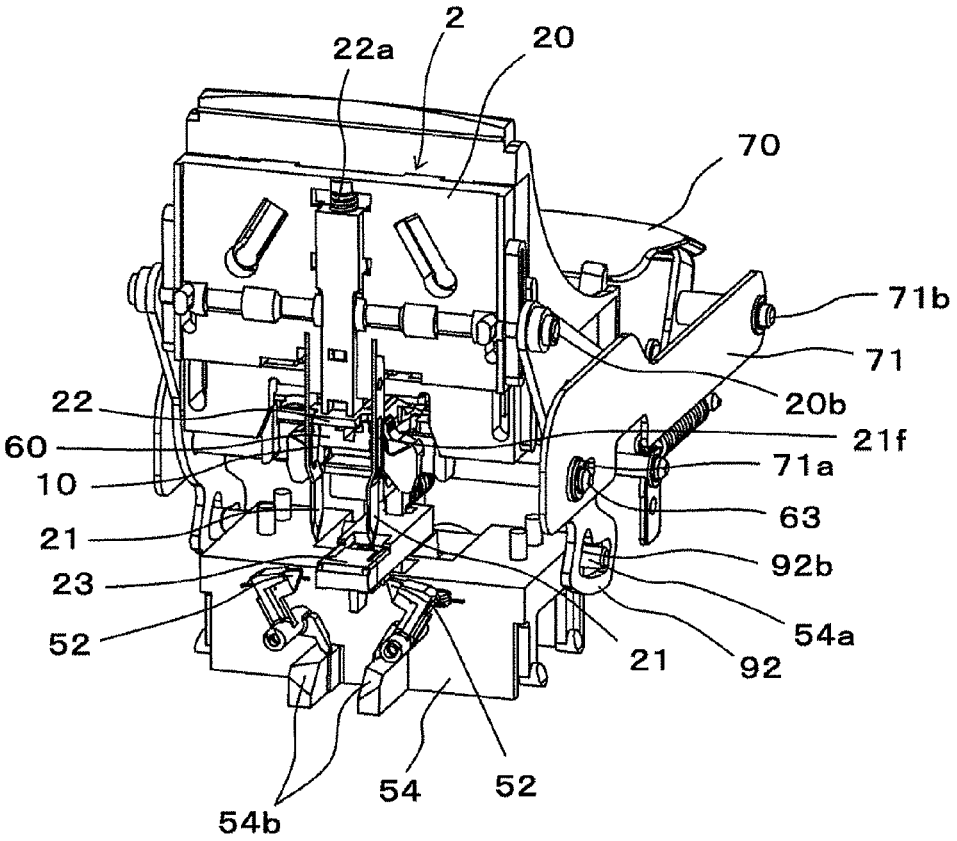
FIG. 18 is a perspective view illustrating one example of a cutting blade guide.

The guide portion 54*b* has a guide surface abutting against the ejecting member 52, as illustrated in FIG. 18, to open or close the ejecting member 52 in accordance with the sliding movement of the slide member 54. The operating convex portion 54*c* abuts against the cutting blade guide 23, as illustrated in FIG. 1 and so forth, to move the cutting blade guide 23 forward and backward in accordance with the sliding movement of the slide member 54.

The operation of the operating handle 9 is transmitted to the clutch mechanism 53 via the link 92, and the penetrating mechanism 2 penetrates the paper sheets P by the operation of the operating handle 9. Simultaneously, the slide member 54 is moved backward in accordance with the operation of the cutting/forming mechanism 3 cutting and forming the next staple material 10*m*.

As the slide member 54 is moved back, the ejecting member 52 is guided by the guide surface of the guide portion 54*b* and thus is rotated in the closing direction. And, the ejecting member 52 protrudes into the ejecting hole 21*f* of the cutting blade 21 lowered to the predetermined position. Also, as the slide member 54 is moved back, the cutting blade guide 23 is pushed down and moved backward by the operating convex portion 54*c*, and thus is retracted between the cutting blades 21.

If the slide member 54 is moved to the predetermined release position to be away from the receiving member 55*b*, the body section 8 is rotated by the force of pushing down the operating handle 9.

Accordingly, by the rotating movement of the body section 8, the first bending member 50R is pushed up by the push-up member 51, the second bending member 50L is pushed up, and then the bonding member 50S is pushed up.

If the operating handle 9 is pushed up, the body section 8 is rotated upward, and the slide member 54 urged by the spring 55*a* is moved forward. If the slide member 54 is moved forward, the ejecting member 52 is guided by the guide surface of the guide portion 54*b*, and is rotated in the open direction to move back outwardly from the ejecting hole 21*f* of the cutting blade 21. Also, as the slide member 54 is moved forward, the cutting blade guide 23 is moved forward while being urged by the spring 23*a*, so that the cutting blade guide protrudes between the cutting blades 21.

<Exemplary Configuration of Conveying Mechanism>

The conveying mechanism 6 for conveying the staple-materials-connecting-body and the staple 10 cut and formed from the staple-materials-connecting-body 10*a* will now be described with reference to each drawing.

The conveying mechanism 6 is one example of a conveying part, and includes a pusher 60 for conveying the staple-materials-connecting-body and the staple 10 cut and formed from the staple-materials-connecting-body 10*a*, and a spring 60*a* for urging the pusher 60 forward.

The pusher 60 has a feed claw 61 which is engaged with the hole 10*d* of the staple-materials-connecting-body 10*a* to convey the staple-materials-connecting-body 10*a*, a staple pushing portion 62 for extruding the staple 10 cut and formed from the staple-materials-connecting-body 10*a*, and a pin 63 engaging with the link 92 to which the operation of the operating handle 9 is transmitted.

The link 92 connected with the operating handle 9 is provided with an elongated slot 92*a* to which the pin 63 of the pusher 60 is engaged. In the displacement of the link 92 caused by the operating handle 9 which is pushed down and then is rotated around the shaft 90, the pin 63 is pushed backward, and thus the pusher 60 is moved backward. Also, in the displacement of the link 92 caused by the operating handle 9 which is pushed up and then is rotated around the shaft 90, the pusher 60 is urged by the spring 60*a* and thus is moved forward.

The pusher 60 is made of a resin material in this example, and is formed integrally with the feed claw 61 and the staple pushing portion 62. The feed claw 61 is provided on the upper surface of the pusher 60, and is installed at two left and right positions corresponding to the one pair of holes 10*d* of the staple-materials-connecting-body 10*a*, as illustrated in FIG. 6. As illustrated in FIG. 1, if the staple cartridge 11 is mounted in the cartridge receiving portion 81 of the stapler 1, the feed claw 61 protrudes from the groove portion 14*b* formed on the bottom surface of the staple conveying path 14.

In the feed claw 61, a front surface along the conveying direction of the staple-materials-connecting-body 10*a* is substantially vertically formed as an engaging surface 61*a*, and a rear surface is formed in an inclined surface as a non-engaging surface 61*b*. The feed claw 61 is formed integrally with the pusher 60 by a support portion 61 extending backward from the rear surface thereof.

Since the pusher 60 is made of the resin material, the support portion 61*c* of the feed claw 61 can be resiliently deformed, and the shape of the feed claw 61 forms an evacuation part for appearing and disappearing the feed claw 61 through the hole 10*d* of the staple-materials-connecting-body 10*a* by the horizontal movement of the pusher 60.

That is, as the pusher 60 is moved forward, the engaging surface 61*a* of the feed claw 61 is engaged with the hole 10*d* of the staple-materials-connecting-body 10*a* to convey the staple-materials-connecting-body 10*a* forward. As the pusher 60 is moved backward, the shape of the inclined surface of the non-engaging surface 61*b* of the feed claw 61 generates the force to push the feed claw 61 down, and thus the feed claw 61 is moved backward from the hole 10*d* of the staple-materials-connecting-body 10*a* by the resilient deformation of the support portion 61*c*, so that the staple-materials-connecting-body 10*a* is maintained in the stationary state.

The staple pushing portion 62 is provided on the front surface of the pusher 60, and as illustrated in FIG. 10, is configured to push the so-called U-shaped formed staple 10 of which the leg portions 10*i* are formed at both ends of the crown portion 10*h*.

The staple pushing portion 62 protrudes into the cutting/forming mechanism 3 by the forward movement of the pusher 60 to convey the formed staple 10 to the penetrating mechanism 2. Since the feed claw 61 and the staple pushing portion 62 are formed integrally with the pusher 60, in accordance with the forward movement of the pusher 60, the staple-materials-connecting-body 10*a* is conveyed to the cutting/forming mechanism 3, and simultaneously, the staple 10 located at the leading end which is cut and formed from the staple-materials-connecting-body 10*a* is conveyed to the penetrating mechanism 2.

<Exemplary Configuration of Attaching/Detaching Mechanism>

Figure 38:
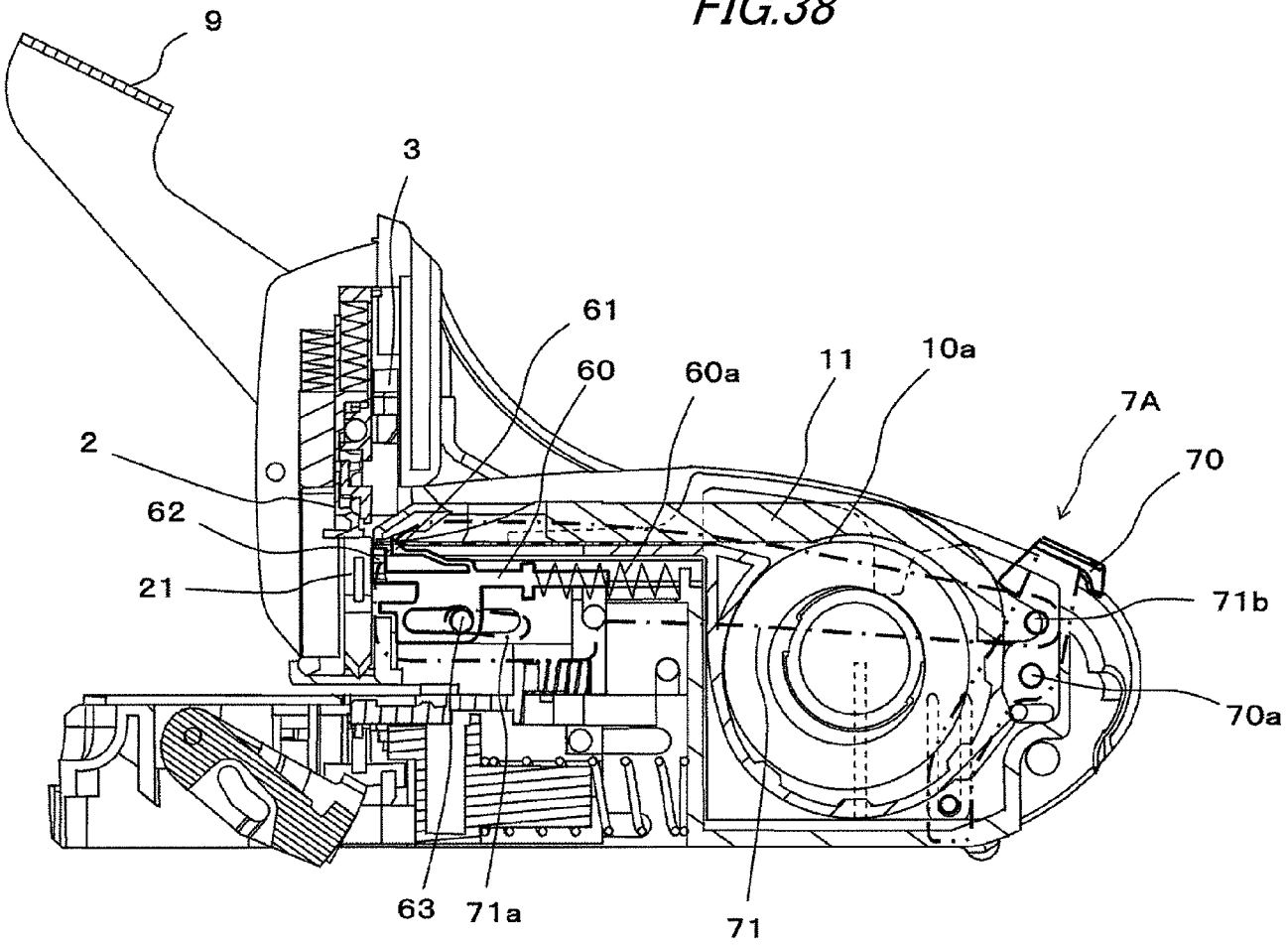
FIG. 38 is a side sectional view of major parts of the stapler illustrating one example of an attaching/detaching mechanism.

FIG. 38 is a side sectional view of major parts of the stapler illustrating one example of the attaching/detaching mechanism. It will now be described the configuration of the attaching/detaching mechanism 7A for conveying the staple-materials-connecting-body 10*a* received in the staple cartridge 11 to the predetermined position in association with the conveying mechanism 6 when the staple cartridge 11 is mounted.

The attaching/detaching mechanism 7A is one example of an attaching/detaching part, and includes an operating lever 70 and a link 71 for transmitting the operation of the operating lever 70 to the conveying mechanism 6. The operating lever 70 is provided at a rear side of the cartridge receiving portion 81 of the body section 8, and is rotated around a shaft 70*a*.

The link 71 is one example of an operating force transmitting part, and has a tip end side provided with an elongated slot 71*a* engaged with the pin 63 of the pusher 60, and a rear end side attached to the operating lever 70 in such a manner that it can rotate around a shaft 71*b*. The elongated slot 71*a* provided in the link 71 extends along the moving direction of the pusher 60 in accordance with the operation of the operating handle 71, so that the engagement of the pusher 60 and the link 71 does not interfere in the movement of the pusher 60 by the operation of the operating handle 9.

When the operating lever 70 is rotated backward around the shaft 70*a*, the link 71 connected with the shaft 71*b* is moved backward, and thus the pin 63 of the pusher 60 is pushed backward, thereby moving the pusher 60 backward. Also, when the operating lever 70 is rotated forward around the shaft 70*a*, the pusher 60 is urged by the spring 60*a*, and thus is moved forward.

<Exemplary Operation of Attaching/Detaching Mechanism>

Figure 39:
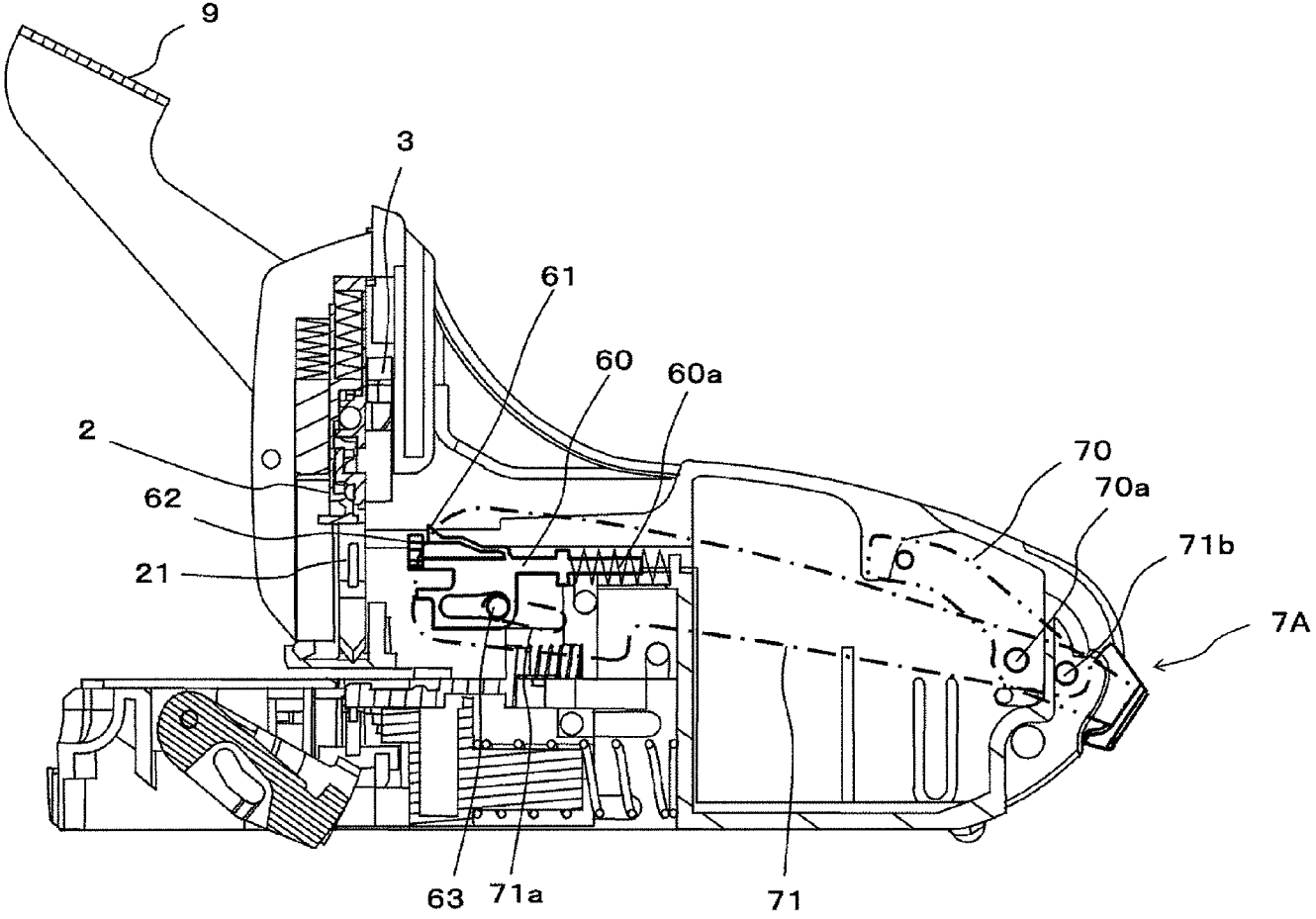
FIG. 39 is an operation chart illustrating an exemplary operation of the attaching/detaching mechanism.

FIGS. 39 to 42 are operation charts illustrating the exemplary operation of the attaching/detaching mechanism. The exemplary operation of the attaching/detaching mechanism 7A will now be described with reference to each drawing. First, in the staple cartridge 11 is detached, as illustrated in FIG. 39, the operating lever 70 is positioned at an attaching/detaching position where it is rotated backward around the shaft 70*a*. Accordingly, the link 71 connected to the shaft 71*b* is moved backward, and thus the pin 63 of the pusher 60 is pushed backward to move the pusher 60 backward, while compressing the spring 60*a*.

If the operating lever 70 is positioned at the attaching/detaching position, the shaft 71*b* of the link 71 connected to the operating lever 70 is positioned at a lower position with respect to the shaft 70*a* of the operating lever 70. The link 71 is applied by the forwardly urging force from the spring 60*a* of the pusher 60, but the operating lever 70 is not rotated forward from the positional relation between the shaft 70*a* of the operating lever 70 and the shaft 71*b* of the link 71, and thus is maintained at the attaching/detaching position.

Figure 40:
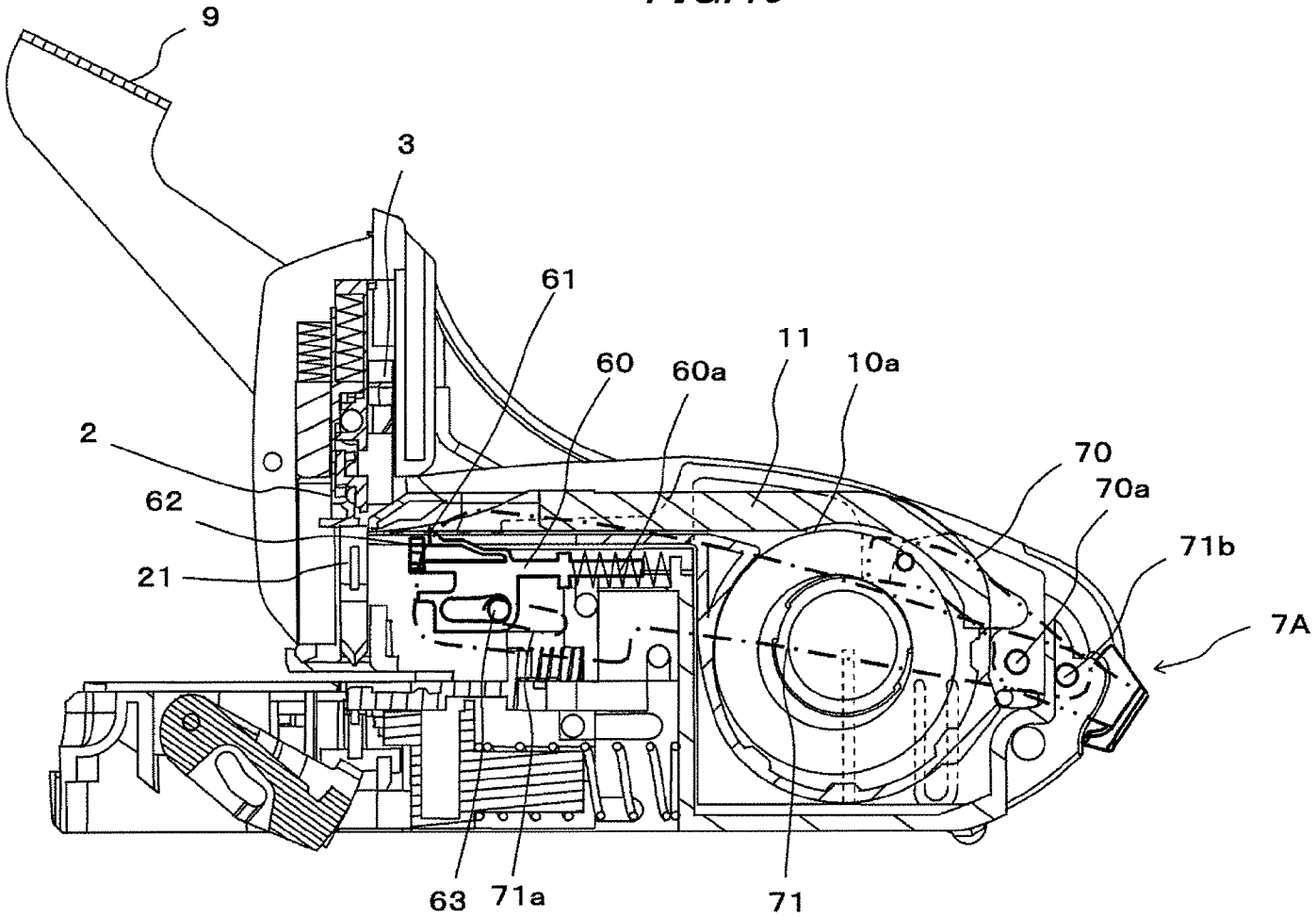
FIG. 40 is an operation chart illustrating an exemplary operation of the attaching/detaching mechanism.

As illustrated in FIG. 40, when the staple cartridge 11 is mounted in the cartridge receiving portion 81 of the stapler 1, the feed claw 61 of the pusher 60 protrudes into the staple conveying path 14 of the stapler cartridge 11 illustrated in FIG. 13, and is engaged with the hole 10*d* of the staple-materials-connecting-body 10*a* illustrated in FIG. 8.

Figure 41:
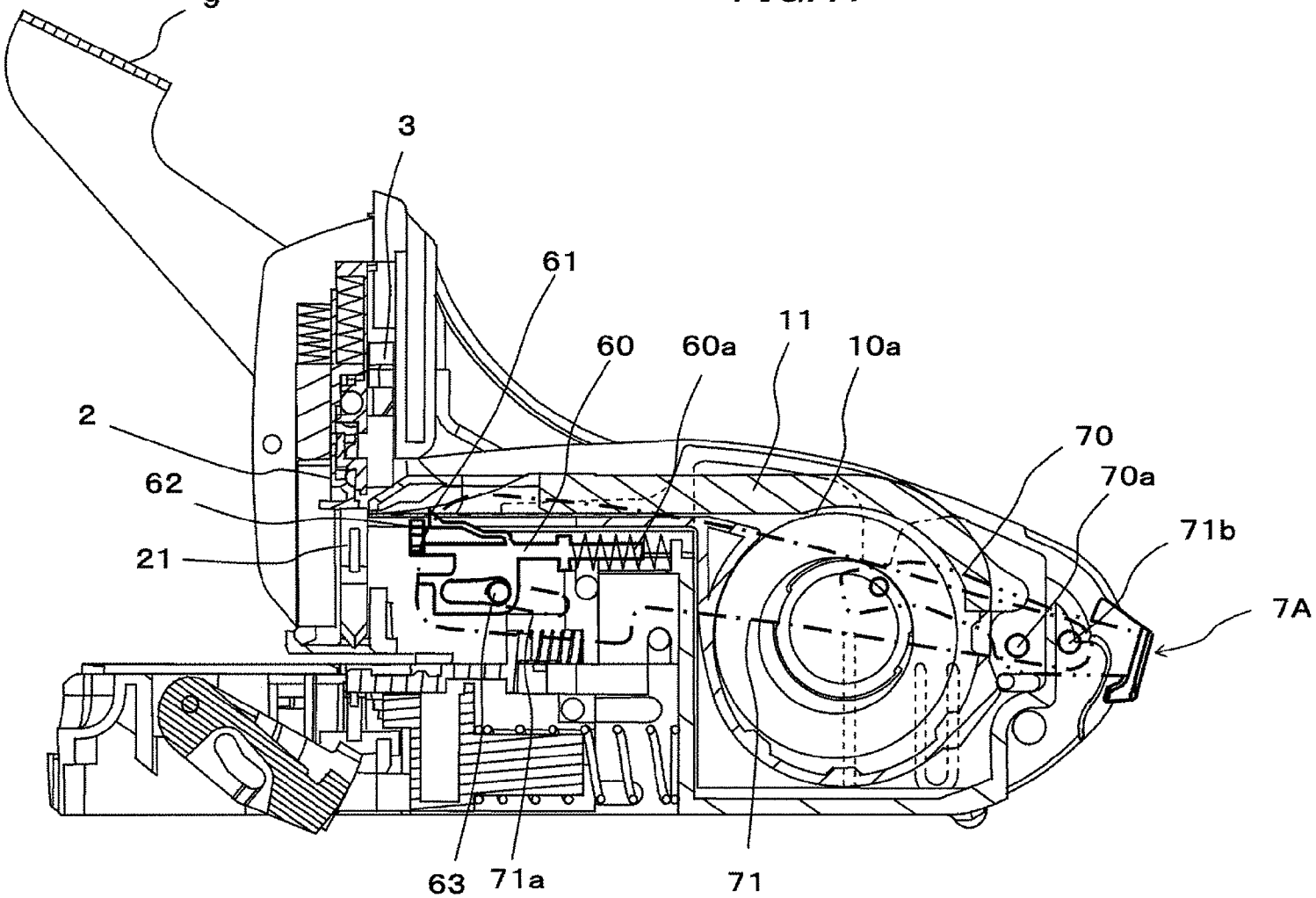
FIG. 41 is an operation chart illustrating an exemplary operation of the attaching/detaching mechanism.
Figure 42:
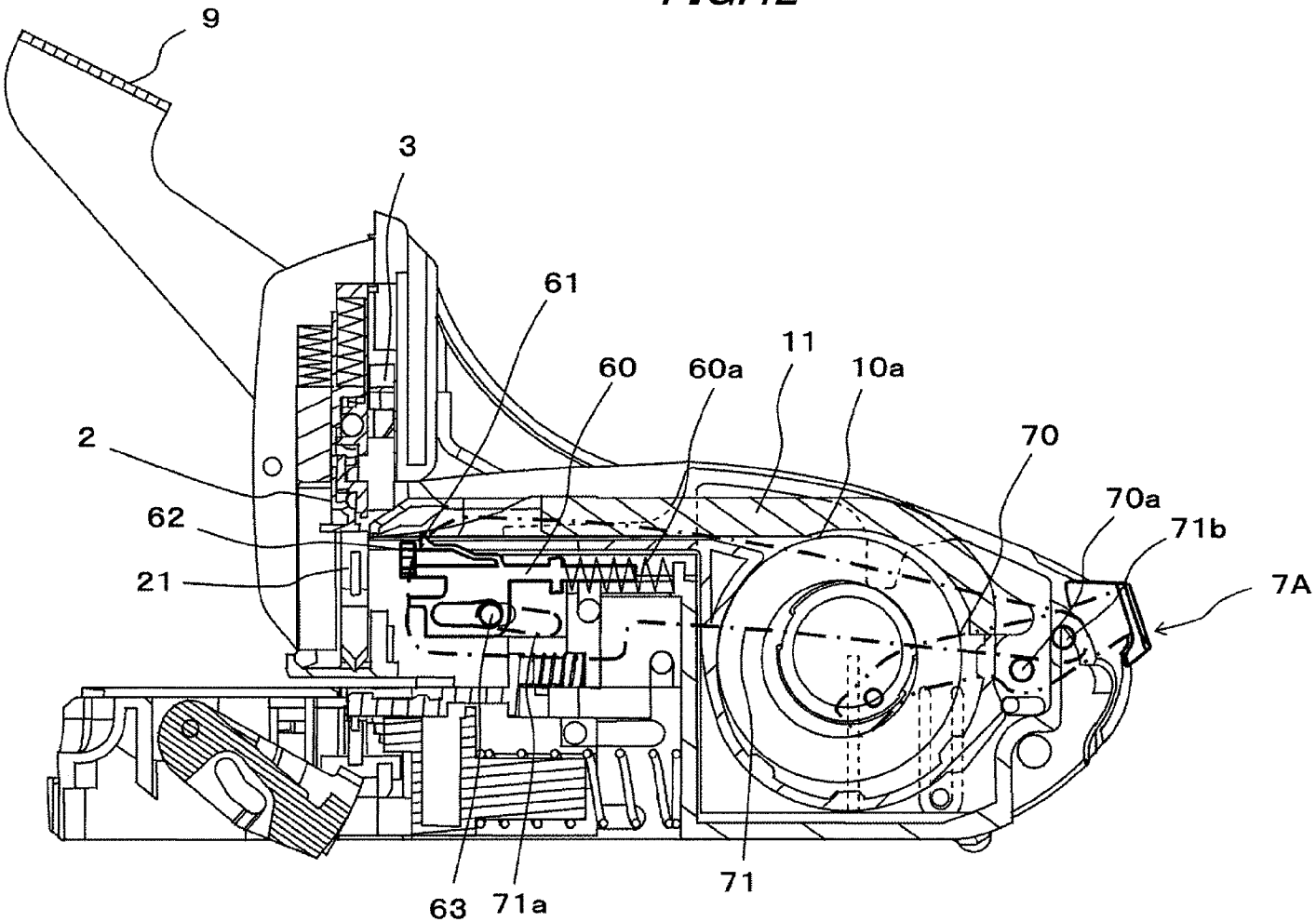
FIG. 42 is an operation chart illustrating an exemplary operation of the attaching/detaching mechanism.

As illustrated in FIG. 41, if the staple cartridge 11 is mounted and the operating lever 70 is rotated forward to move upwardly the shaft 71*b* connected to the operating lever 70 with respect to the shaft 70*a* of the operating lever 70, the link 71 is able to move forward by the urging force of the spring 60*a* of the pusher 60. Accordingly, as illustrated in FIG. 42, as the operating lever 70 is rotated forward, the pusher 60 is moved forward. When the operating lever 70 is rotated by the mounting position illustrated in FIG. 38, the operating lever 70 is engaged with the staple cartridge 11, so that the staple cartridge 11 cannot be detached without operating the operating lever 70.

Figure 43A:
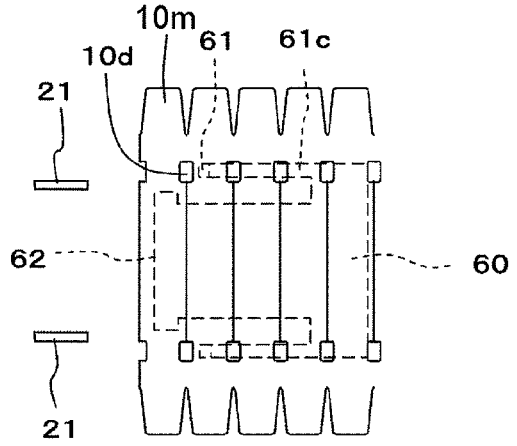
FIGS. 43(*a*), 43(*b*) and 43(*c*) illustrate an exemplary operation of conveying the staple-materials-connecting-body by an operation of the attaching/detaching mechanism.
Figure 43B:
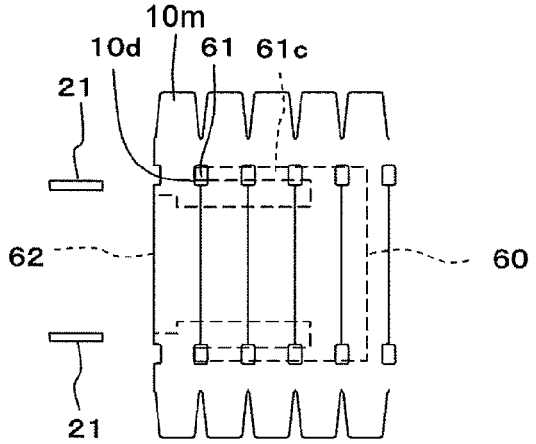
Figure 43C:
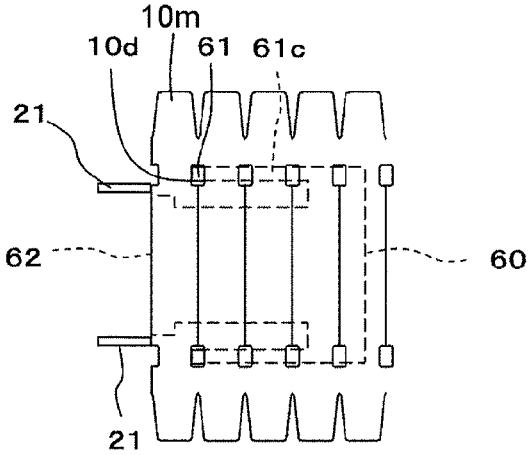

FIG. 43 is an operation chart illustrating an exemplary operation of conveying the staple-materials-connecting-body by the operation of the attaching/detaching mechanism. Since the feed claw 61 of the pusher 60 is engaged with the hole 10*d* of the staple-materials-connecting-body 10*a*, if the pusher 60 is moved forward, as illustrated in FIGS. 43(*a*) and 43(*b*), the staple-materials-connecting-body 10*a* is moved forward.

As illustrated in FIG. 38, if the operating lever 70 is rotated to the mounting position, as illustrated in FIG. 43(*c*), the staple-materials-connecting-body 10*a* is moved forward to the predetermined standby position. In this example, the position in which the tip end of the staple-materials-connecting-body 10*a* abuts against the cutting blade 21 of the penetrating mechanism 2 is referred to as the standby position.

As illustrated and described in FIGS. 12 and 13, when the staple-materials-connecting-body 10*a* is received in the staple cartridge 11, the tip end of the staple-materials-connecting-body 10*a* abuts against the stopper guide 15 to determine the tip end position of the staple-materials-connecting-body 10*a*.

The staple cartridge 11 is mounted in the stapler 1, and the staple-materials-connecting-body 10*a* is moved forward to the determined standby position by the operation of the attaching/detaching mechanism 7A. Therefore, when the staple cartridge 11 is attached or detached, the position of the staple-materials-connecting-body 10*a* can be reliably set to the determined standby position by the operation of the operating lever 70.

Further, when the staple cartridge 11 is removed, the operating lever 70 is rotated backward from the state illustrated in FIG. 38. If the pusher 60 is moved backward by rotating the operating lever 70 rotating backward, the feed claw 61 is moved backward from the hole 10*d* of the staple-materials-connecting-body 10*a* due to the shape of the feed claw 61, so that the staple-materials-connecting-body 10*a* is maintained in the stationary state.

If the operating lever 70 is rotated to the attaching/detaching position illustrated in FIG. 40, the staple cartridge 11 can be detached in the state in which the operating lever 70 is maintained in the attaching/detaching position.

When the staple cartridge 11 is detached in the state in which the staple-materials-connecting-body 10*a* is left due to jam or the like and the pusher 60 is moved forward, the stapler cartridge 11 is detached in the state in which the staple material 10*m* located at the leading end of the staple-materials-connecting-body 10*a* and the feed claw 61 of the pusher 60 are engaged, and the staple-materials-connecting-body 10*a* is withdrawn.

Whereas, this embodiment is configured so that the staple cartridge 11 cannot be detached without operating the operating lever 70. The pusher 60 is moved backward by operating the operating lever 70, and then the feed claw 61 is moved backward, so that the engaged state of the staple material 10*m* located at the leading end of the staple-materials-connecting-body 10*a* and the feed claw 61 of the pusher 60 are released to detach the staple cartridge 11. Therefore, it is possible to prevent the staple-materials-connecting-body 10*a* from being withdrawn.

<Variation of Attaching/Detaching Mechanism>

Figure 44:
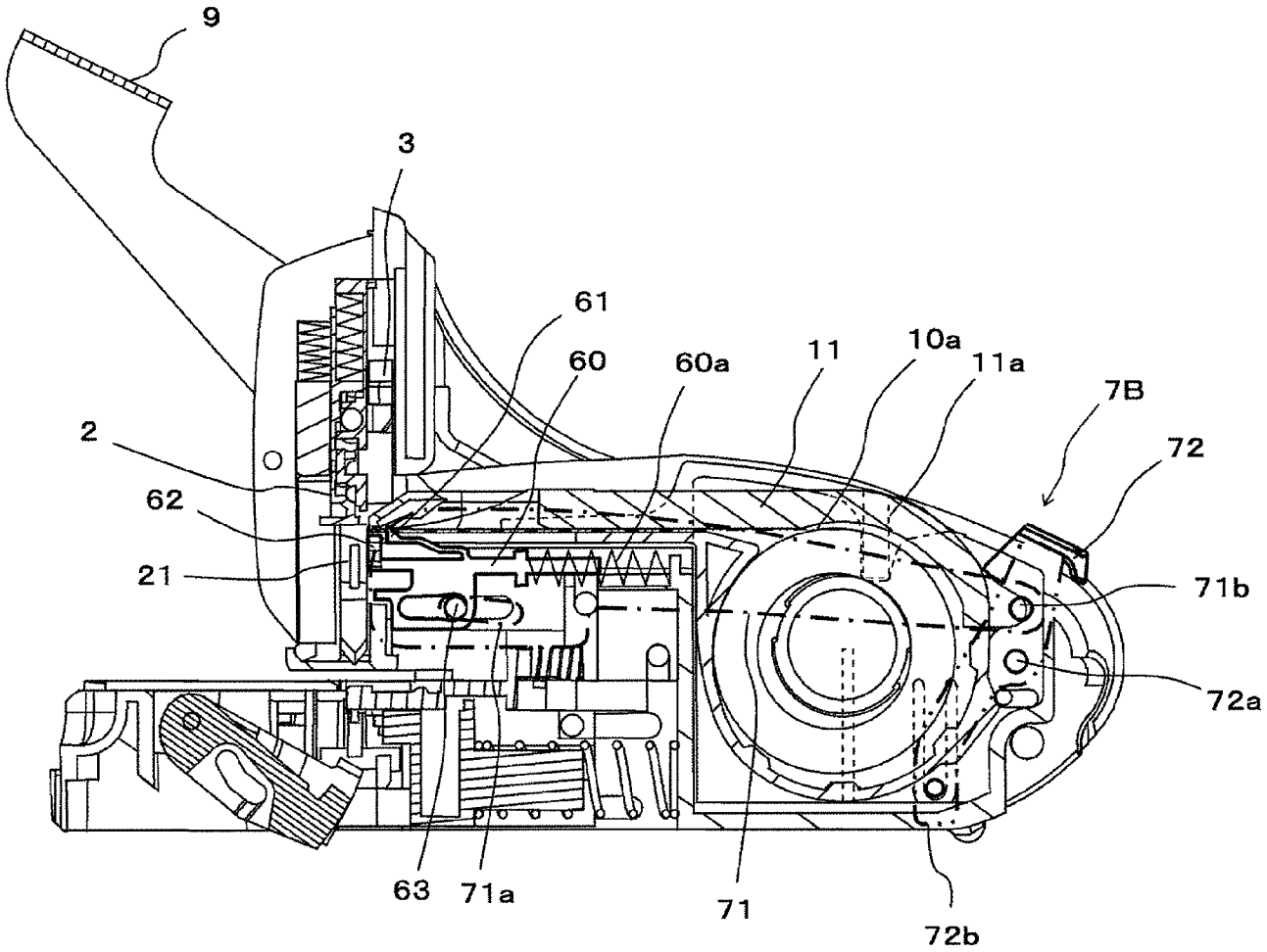
FIG. 44 is a side sectional view of major parts of the stapler illustrating a variation of the attaching/detaching mechanism.

FIG. 44 is a side sectional view of major parts of the stapler illustrating a variation of the attaching/detaching mechanism. An attaching/detaching mechanism 7B is one example of an attaching/detaching part, and includes an operating lever 72 and the link 71 for transmitting the operation of the operating lever 72 to the conveying mechanism 6. The operating lever 72 is provided at the rear side of the cartridge receiving portion 81 of the body section 8, and is rotated around a shaft 72*a*.

Also, the operating lever 72 has an operating lever 72*b* which abuts against an engaging convex portion 11*a* provided on the stapler cartridge 11 to press the staple cartridge 11 by mounting the staple cartridge 11, and pushes up the staple cartridge 11 by detaching the stapler cartridge 11.

The link 71 has the tip end side provided with the elongated slot 71*a* engaged with the pin 63 of the pusher 60, and the rear end side attached to the operating lever 72 in such a manner that it can rotate around the shaft 71*b*.

When the operating lever 70 is rotated backward around the shaft 72*a*, the link 71 connected with the shaft 71*b* is moved backward, and thus the pin 63 of the pusher 60 is pushed backward, thereby moving the pusher 60 backward. In the case where the staple cartridge 11 is mounted, the operating lever 72*b* abuts against the engaging convex portion 11*a* of the staple cartridge 11 by rotating the operating lever 72 backward, thereby pushing the staple cartridge 11 up.

Whereas, the operating lever 72*b* abuts against the engaging convex portion 11*a* of the staple cartridge 11 by mounting the staple cartridge 11, and thus the operating lever 72 is rotated forward around the shaft 72*a*. As a result, the pusher 60 is urged by the spring 60*a*, and thus is moved forward.

Figure 45:
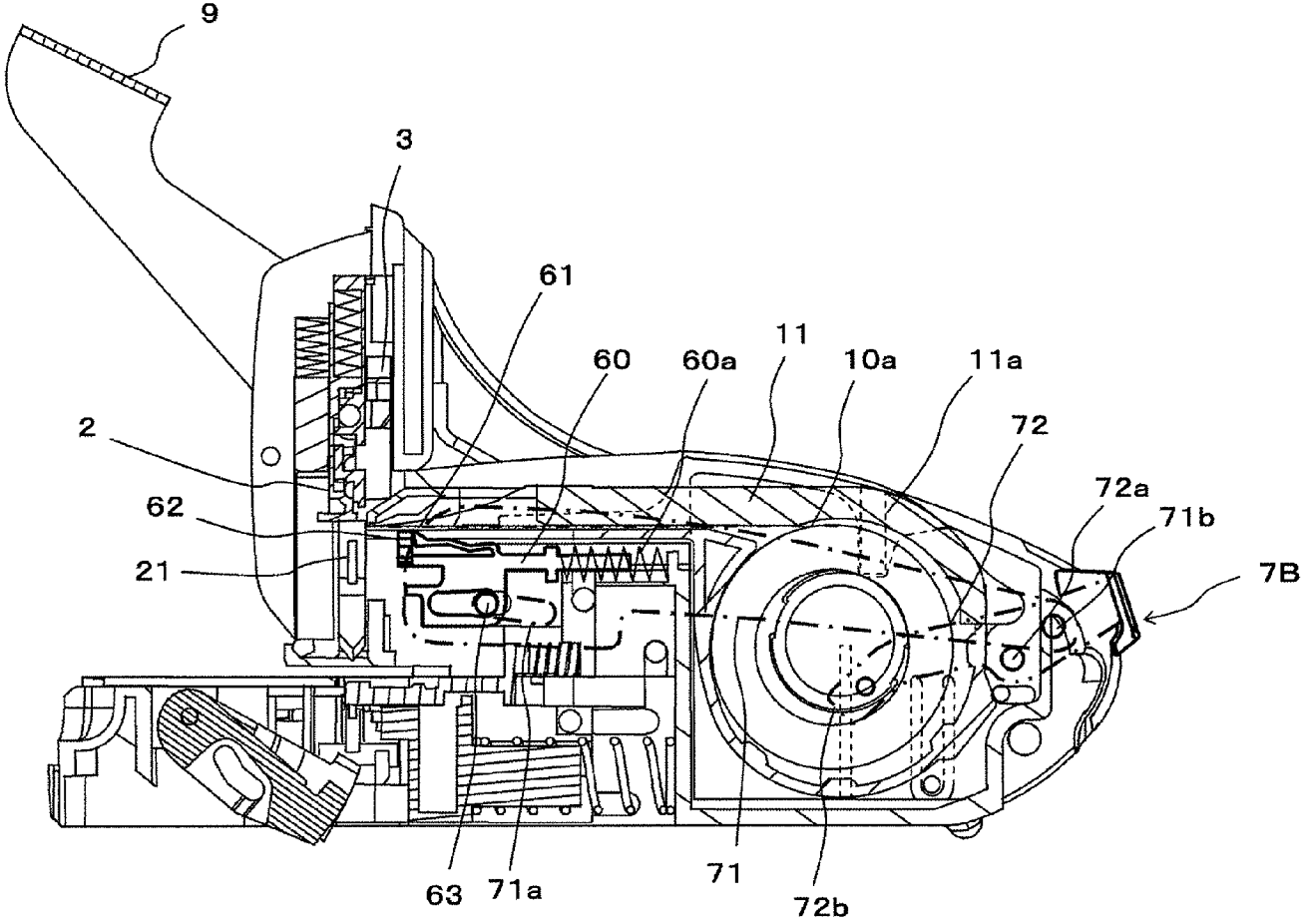
FIG. 45 is an operation chart illustrating an exemplary operation of the attaching/detaching mechanism according to a variation.
Figure 46:
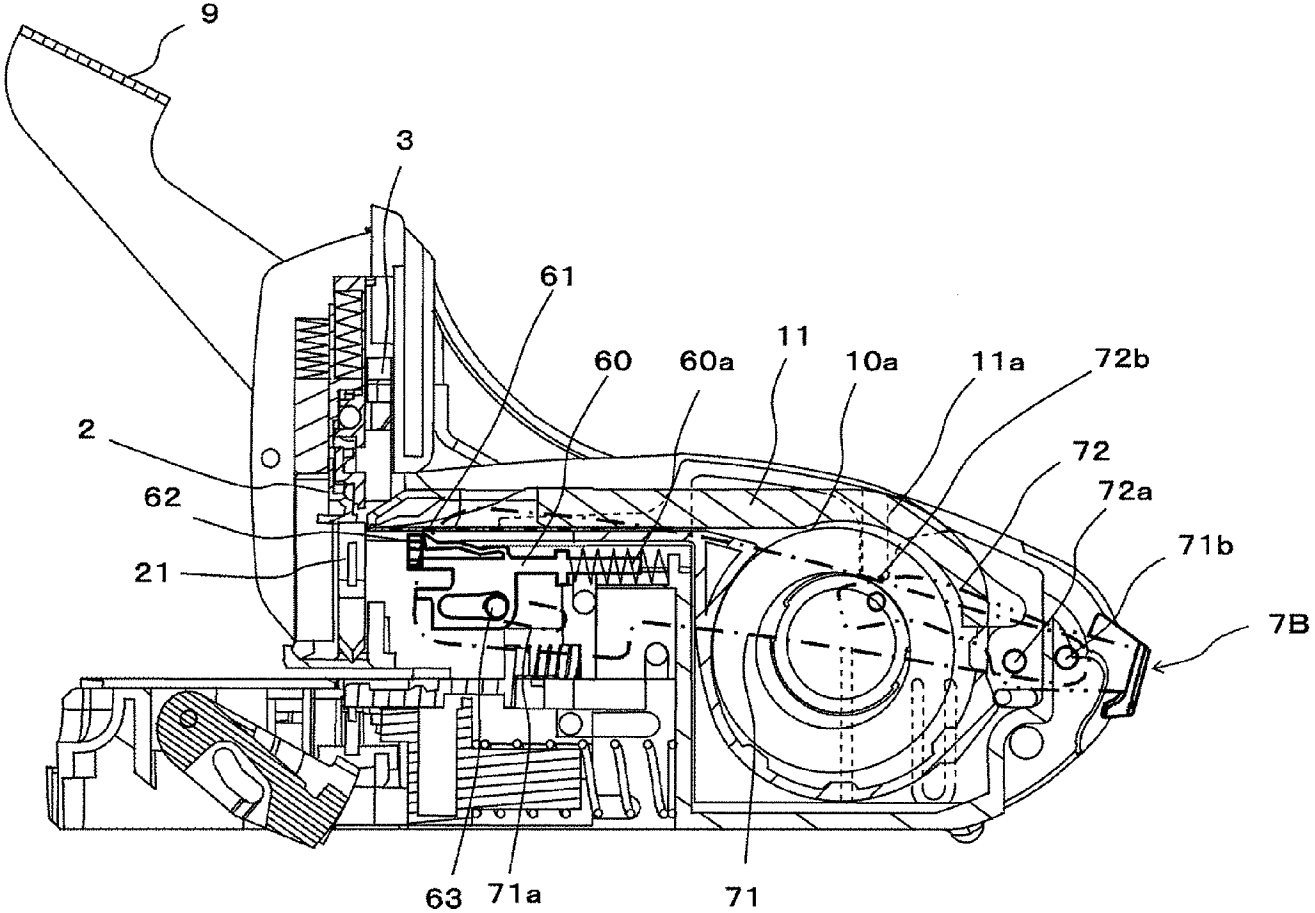
FIG. 46 is an operation chart illustrating an exemplary operation of the attaching/detaching mechanism according to a variation.
Figure 47:
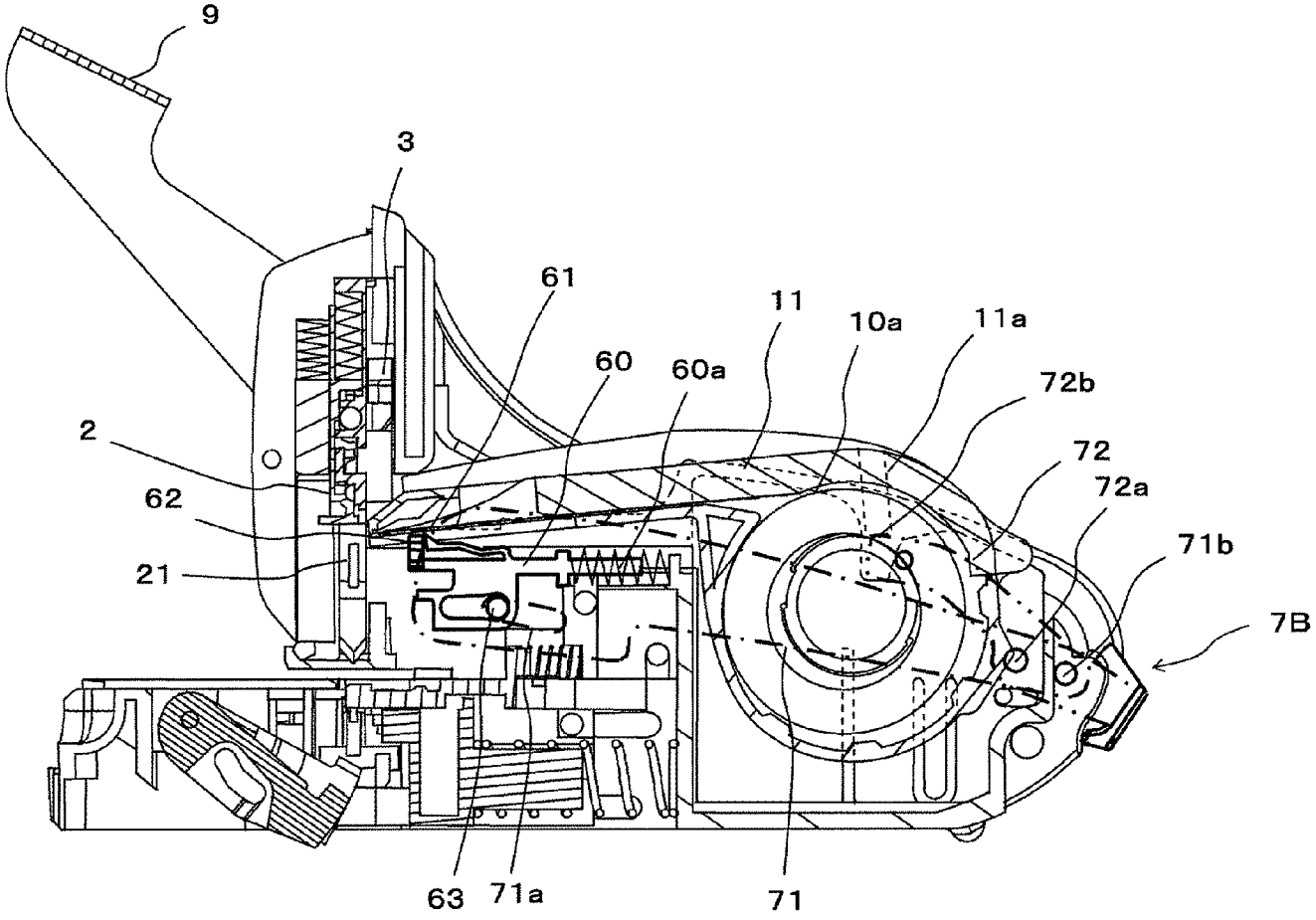
FIG. 47 is an operation chart illustrating an exemplary operation of the attaching/detaching mechanism according to a variation.

FIGS. 45 to 47 are operation charts illustrating the exemplary operation of the attaching/detaching mechanism according to the variation. The exemplary operation of attaching/detaching mechanism 7B will now be described with reference to each drawing. First, explaining the operation of detaching the staple cartridge 11, as illustrated in FIG. 45, the operating lever 72 is rotated backward from the mounting position illustrated in FIG. 44.

If the pusher 60 is moved backward by rotating the operating lever 70 backward, the feed claw 61 is moved backward from a hole of the staple-materials-connecting-body (not illustrated) due to the shape of the feed claw 61, so that the staple-materials-connecting-body is maintained in the stationary state.

If the operating lever 72 is rotated to the position illustrated in FIG. 46, the operating lever 72*b* abuts against the engaging convex portion 11*a* of the staple cartridge 11. Since the operating lever 72 is rotated to the attaching/detaching position, as illustrated in FIG. 47, the stapler cartridge 11 is pushed up. Accordingly, the stapler cartridge 11 can be easily detached. Also, if the operating lever 72 is positioned at the attaching/detaching position, the operating lever 72 is not rotated forward by the positional relation between the shaft 72*a* of the operating lever 72 and the shaft 71*b* of the link 71, thereby being maintained at the attaching/detaching position.

When the staple cartridge 11 is mounted, the staple cartridge 11 is pushed down from the state illustrated in FIG. 47. Accordingly, the engaging convex portion 11*a* of the staple cartridge 11 abuts against the operating lever 72*b*, and thus the operating lever 72 is rotated forward around the shaft 72*a*.

If the operating lever 72 is rotated forward, and as illustrated in FIG. 46, the shaft 71*b* of the link connected to the operating lever 72 is moved up with respect to the shaft 72*a* of the operating lever 72, the link 71 is moved forwardly by the urging force of the spring 60*a* of the pusher 60.

Accordingly, as illustrated in FIG. 45, the engaging convex portion 11*a* of the staple cartridge 11 is detached from the operating lever 72*b*, the operating lever 72 is rotated forward, and the pusher 60 is moved forward. As a result, the operating lever 72 is rotated to the mounting position illustrated in FIG. 44, and thus the staple-materials-connecting-body is conveyed to the determined standby position.

<Exemplary Overall Operation of Stapler>

FIGS. 48 to 51 are operation charts illustrating the exemplary operation of the operating handle. FIGS. 52 to 70 are operation charts illustrating the exemplary operation of the entire stapler. FIGS. 71 to 89 are operation charts illustrating the exemplary operation of the penetrating mechanism and the bending mechanism. FIGS. 90 to 97 are operation charts illustrating the exemplary operation of the cutting/forming mechanism. The exemplary overall operation of the entire stapler 1 according to this embodiment will now be described with reference to each drawing.

<Standby State>

In the standby state illustrated in FIGS. 48, 52, 71, 90, and so forth, the staple 10 located at the leading end which is cut and formed from the staple-materials-connecting-body 10*a* is positioned in the penetrating mechanism 2. Also, the next staple 10 (staple material 10*m*) of the staple-materials-connecting-body 10*a* is positioned in the cutting/forming mechanism 3.

The staple-materials-connecting-body 10*a* conveyed to the cutting/forming mechanism 3 is conveyed to the determined standby position in which it abuts against the cutting blade 21 of the penetrating mechanism 2 by the operation of the above-described attaching/detaching mechanisms 7A and 7B. Also, in the cutting/forming mechanism 3, the cutter plate 30 is positioned at the retracted position raised with respect to the forming plate 31, and the cutting blade 32 is not exposed.

<Operation Start of Cutting Blade>

Figure 48:
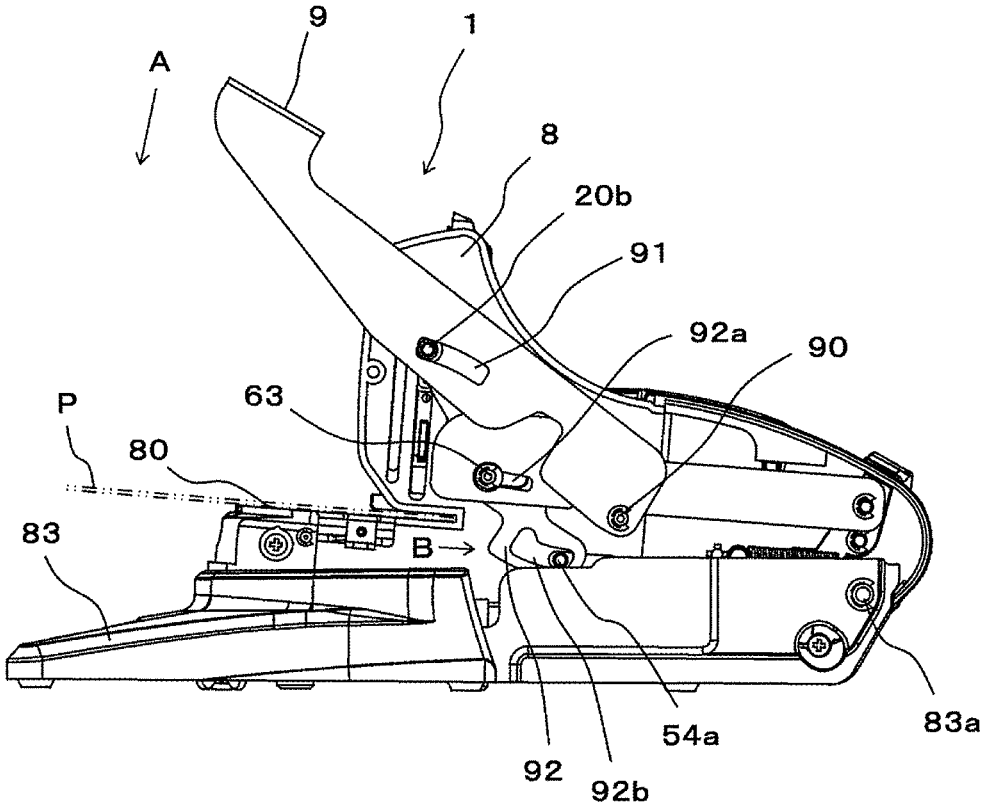
FIG. 48 is an operation chart illustrating an exemplary operation of an operating handle portion.
Figure 53:
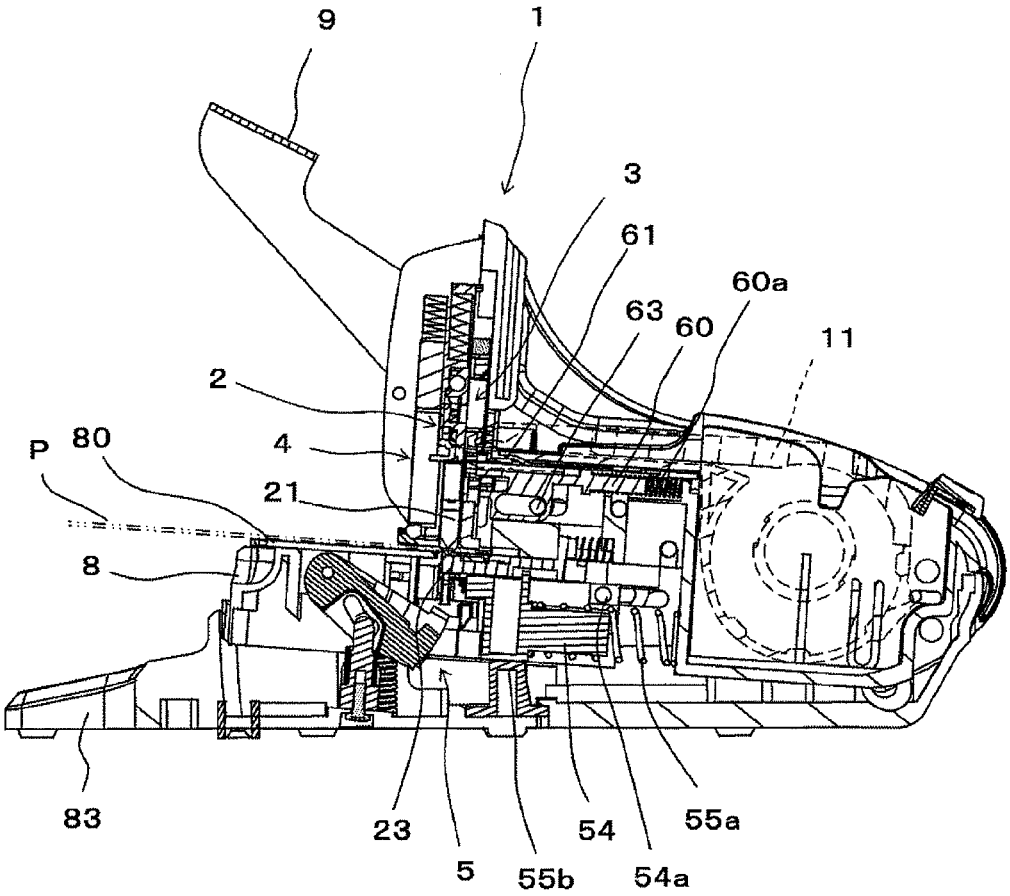
FIG. 53 is an operation chart illustrating an exemplary operation of the entire stapler.

If the operating handle 9 is pushed in a downward direction indicated by the arrow A from the standby state illustrated in FIG. 48, the link 92 connected with the operating handle 9 at the coupling shaft portion 20*b* of the penetrating mechanism 2 is rotated around the coupling shaft portion 20*b* in a direction indicated by the arrow B. Accordingly, as illustrated in FIG. 53, the pusher 60 starts moving backward. As the pusher 60 is moved backward, as described above, the feed claw 61 is spaced apart from the staple-materials-connecting-body 10*a*, and thus the staple-materials-connecting-body 10*a* is maintained in the stationary state.

Figure 72:
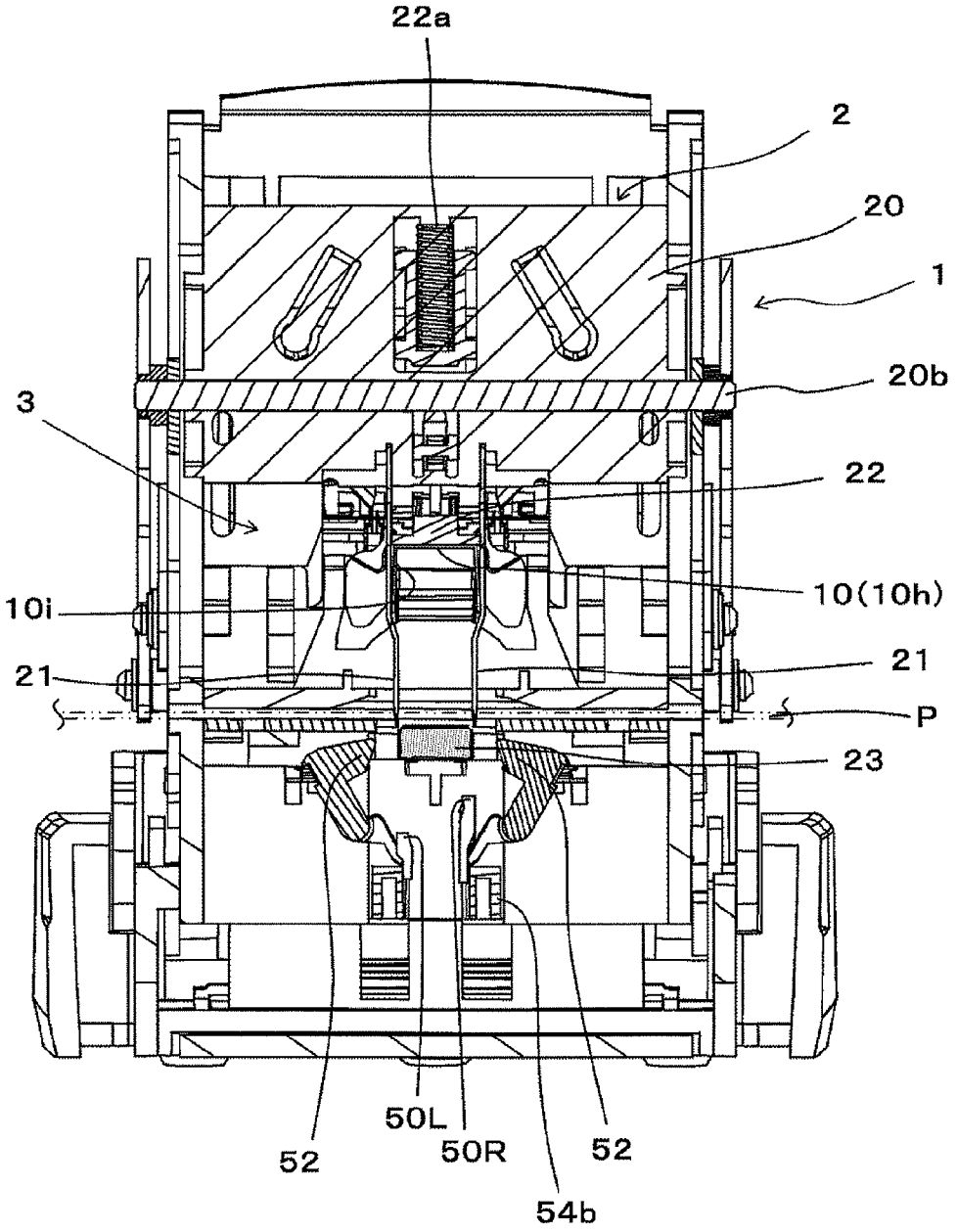
FIG. 72 is an operation chart illustrating an exemplary operation of the penetrating mechanism and the bending mechanism.
Figure 91:
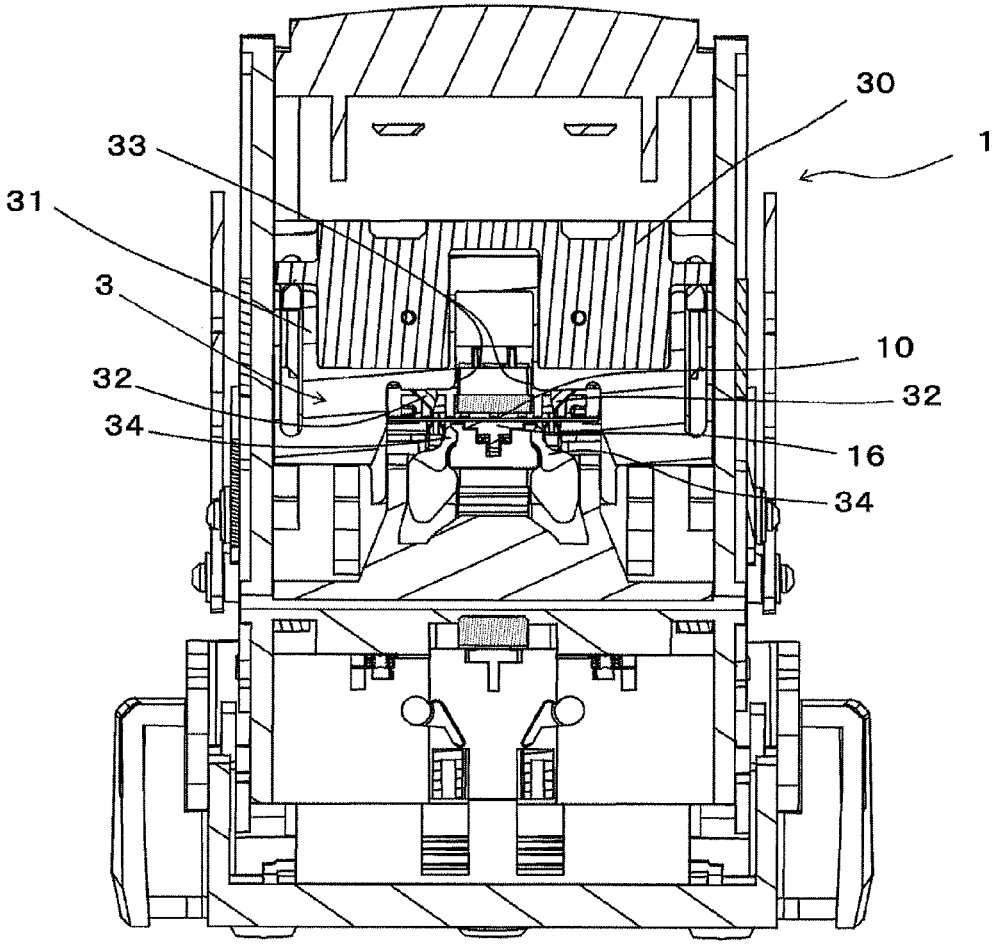
FIG. 91 is an operation chart illustrating an exemplary operation of the cutting/forming mechanism.

Further, as the operating handle 9 pushes the connecting shaft portion 20*b* down, the penetrating mechanism 2 starts lowering, and the paper holding plate 40 of the paper holding mechanism 4 is urged by the spring 41, in association with the operation of the penetrating mechanism 2, so that the paper sheets P placed in the paper placing base 80 are held. In the penetrating mechanism 2, as illustrated in FIG. 72, the blade portion 21*a* of the cutting blade 21 pierces the paper sheets P. In the cutting/forming mechanism 3, as illustrated in FIG. 91, the cutting blade 32 protrudes from the staple forming portion 33 of the forming plate 31.

<Forming Start>

Figure 54:
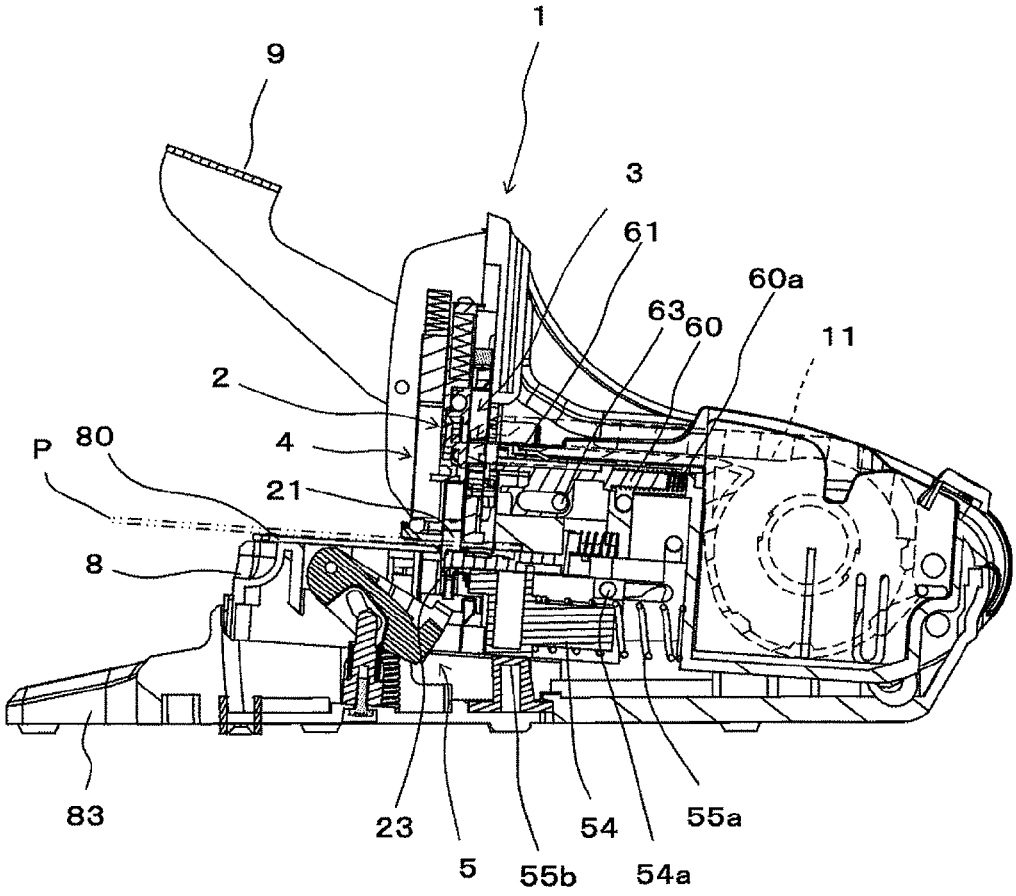
FIG. 54 is an operation chart illustrating an exemplary operation of the entire stapler.
Figure 73:
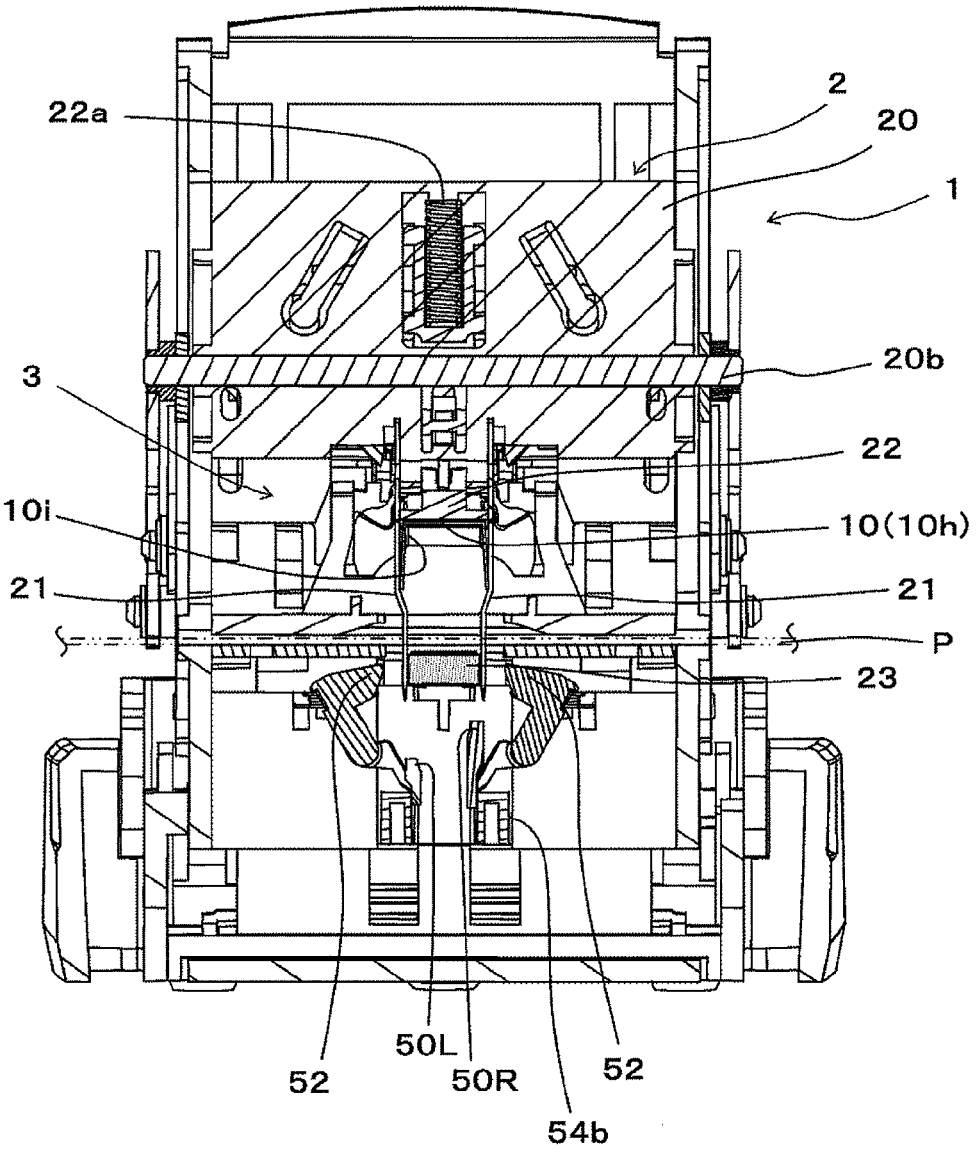
FIG. 73 is an operation chart illustrating an exemplary operation of the penetrating mechanism and the bending mechanism.

If the operating handle 9 is pushed down at the position illustrated in FIG. 54, the retreating operation of the pusher 60 is continuously performed. In the penetrating mechanism 2, as illustrated in FIG. 73, the first penetrating portion 21*b* of the cutting blade 21 penetrates the paper sheets P. The one pair of cutting blades 21 prevents the tip end side of the cutting blade 21 from being inclined inwardly, while the cutting blade guide 23 protrudes inside the first penetrating portion 21*b* penetrating the paper sheets P.

Figure 92:
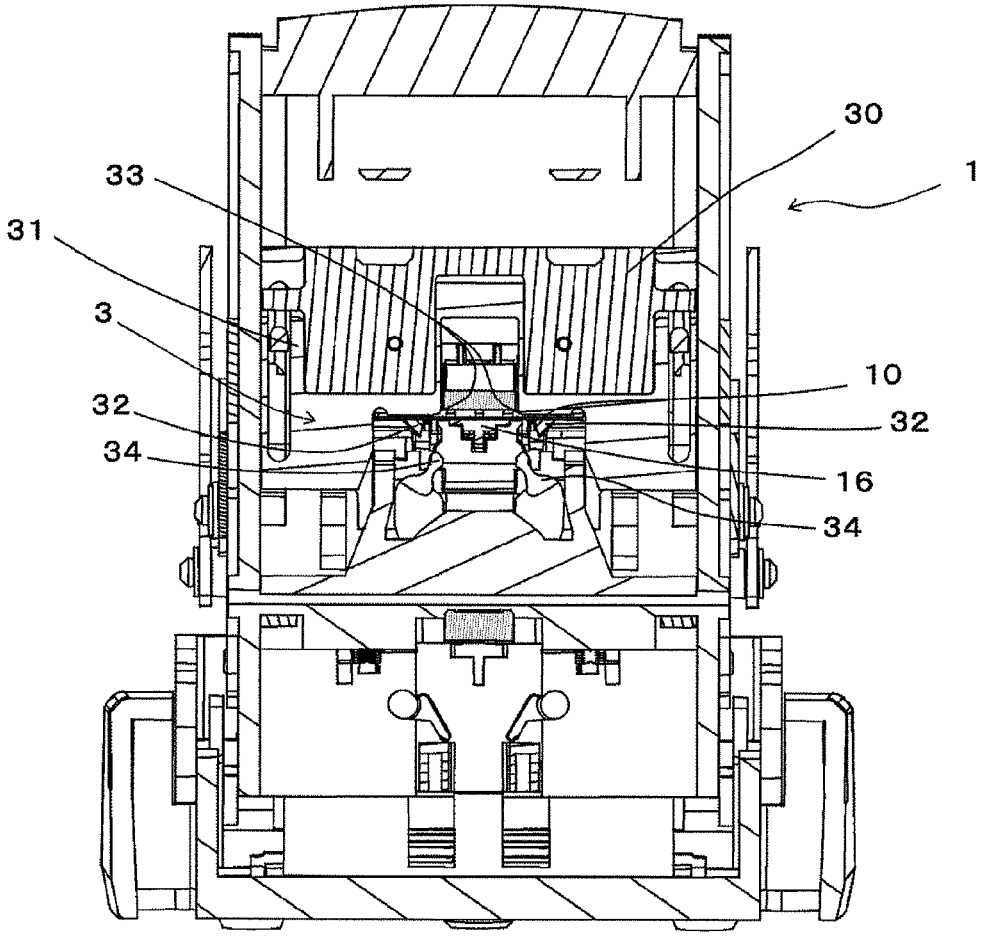
FIG. 92 is an operation chart illustrating an exemplary operation of the cutting/forming mechanism.

In the cutting/forming mechanism 3, as illustrated in FIG. 92, the cutter plate 30 and the forming plate 31 are lowered as one body, and as illustrated in FIG. 37, the staple material 10*m* located at the leading end of the staple-materials-connecting-body 10*a* is cut by the cutting blade 32. In addition, the staple forming portion 33 of the forming plate 31 abuts against the cut staple 10 to start the forming of the staple 10.

<Operation Start of Slide Member>

Figure 49:
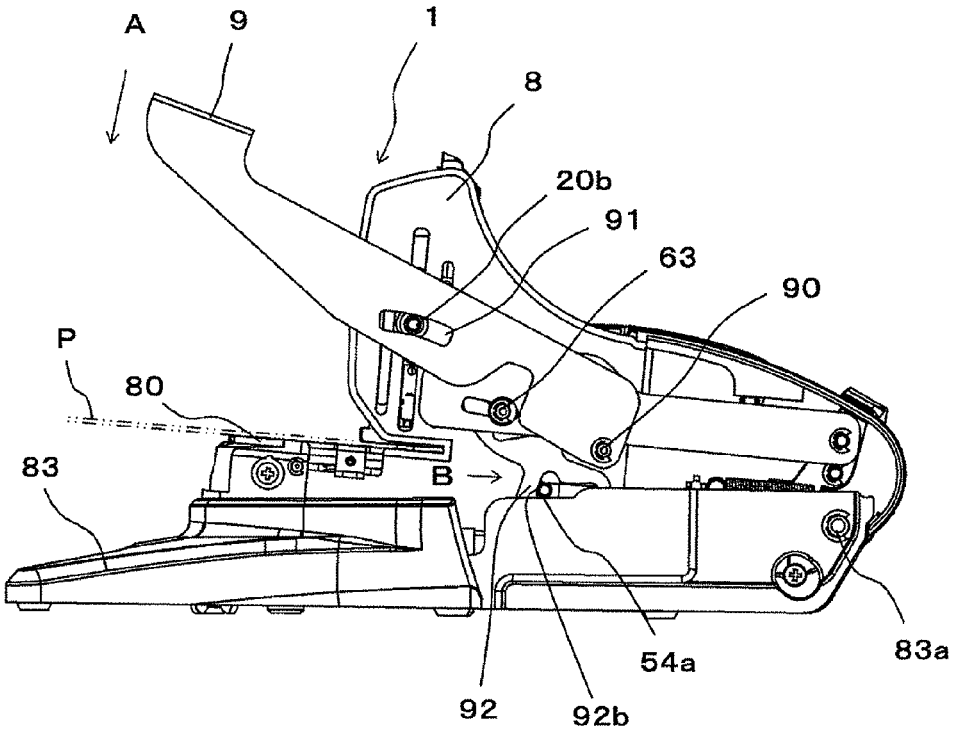
FIG. 49 is an operation chart illustrating an exemplary operation of the operating handle portion.
Figure 55:
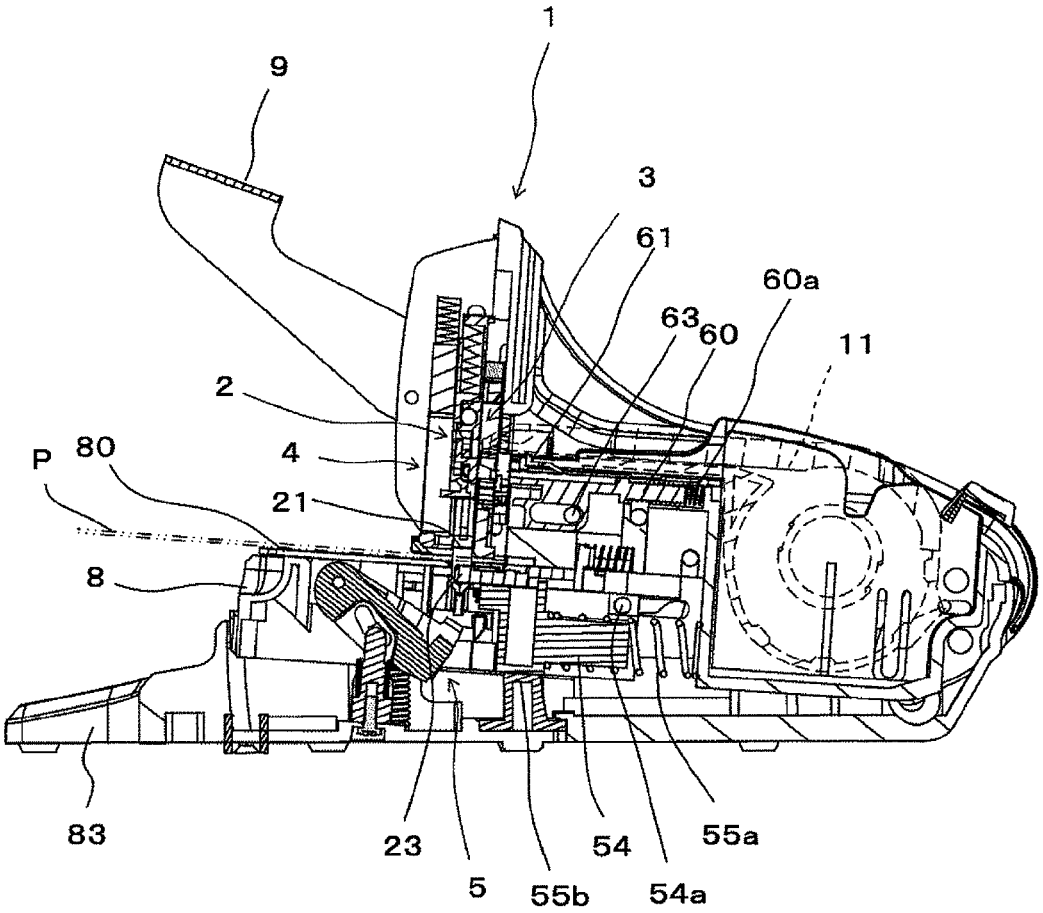
FIG. 55 is an operation chart illustrating an exemplary operation of the entire stapler.

If the operating handle 9 is pushed down at the position illustrated in FIG. 55, the retreating operation of the pusher 60 is continuously performed. Further, as illustrated in FIG. 49, the elongated slot 92*b* of the link 92 abuts against the pin 54*a* of the slide member 54, and thus, as illustrated in FIG. 55, the retreat of the slide member 54 starts.

Figure 74:
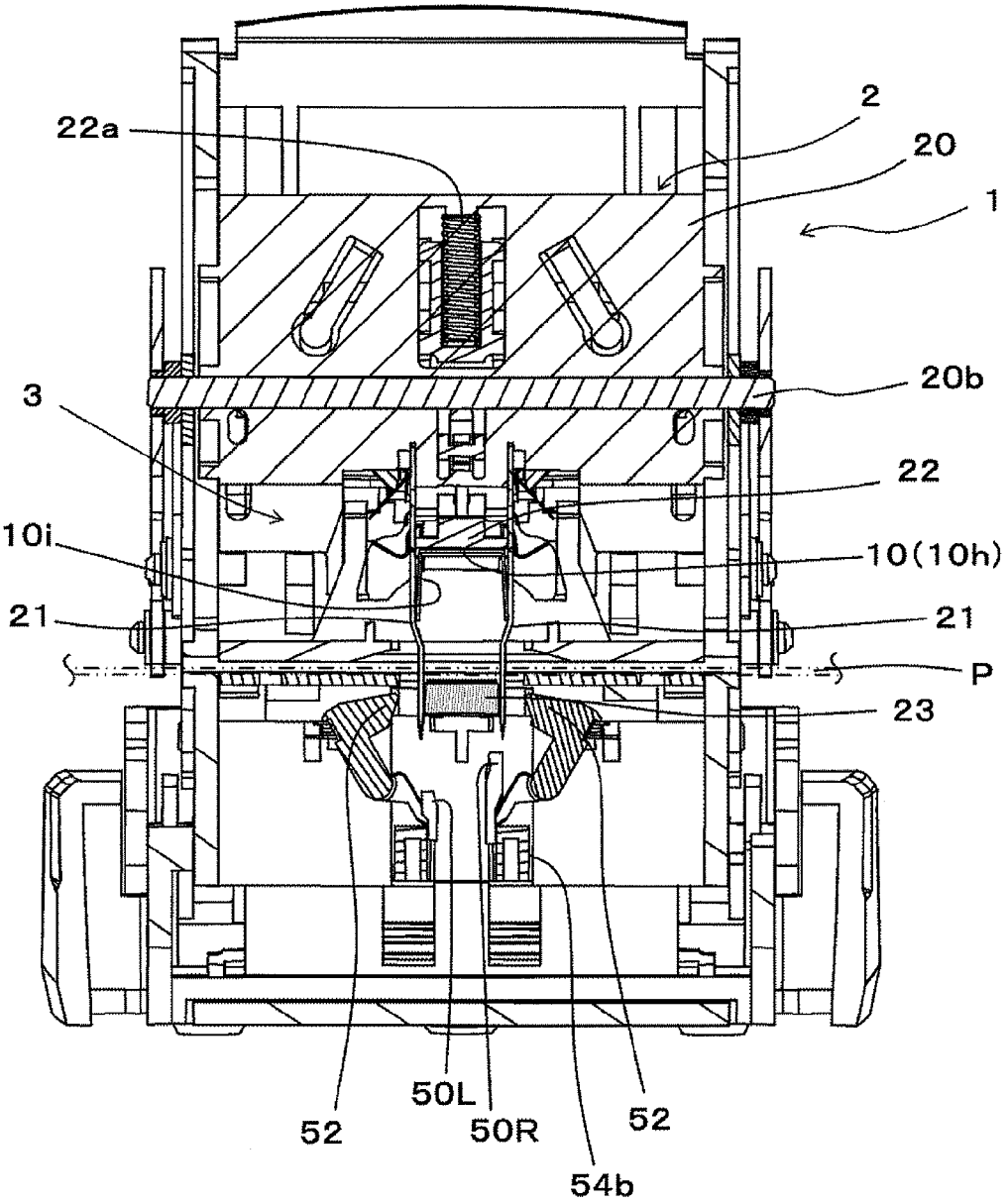
FIG. 74 is an operation chart illustrating an exemplary operation of the penetrating mechanism and the bending mechanism.
Figure 93:
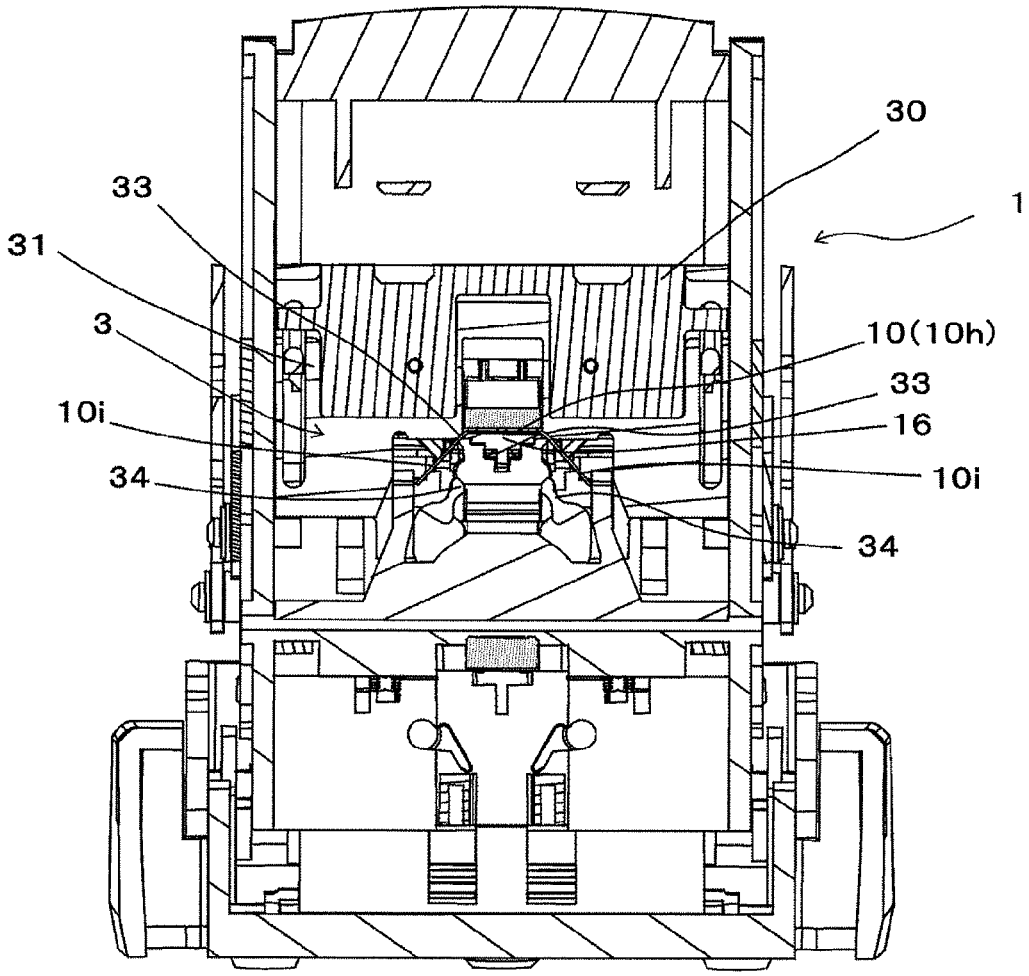
FIG. 93 is an operation chart illustrating an exemplary operation of the cutting/forming mechanism.

In the penetrating mechanism 2, as illustrated in FIG. 74, the first penetrating portion 21*b* of the cutting blade 21 penetrates the paper sheets P. In the cutting/forming mechanism 3, as illustrated in FIG. 93, the leg portions 10*i* of the staple 10 are gradually bend by the staple forming portion 33.

<Expansion Start of Hole>

Figure 56:
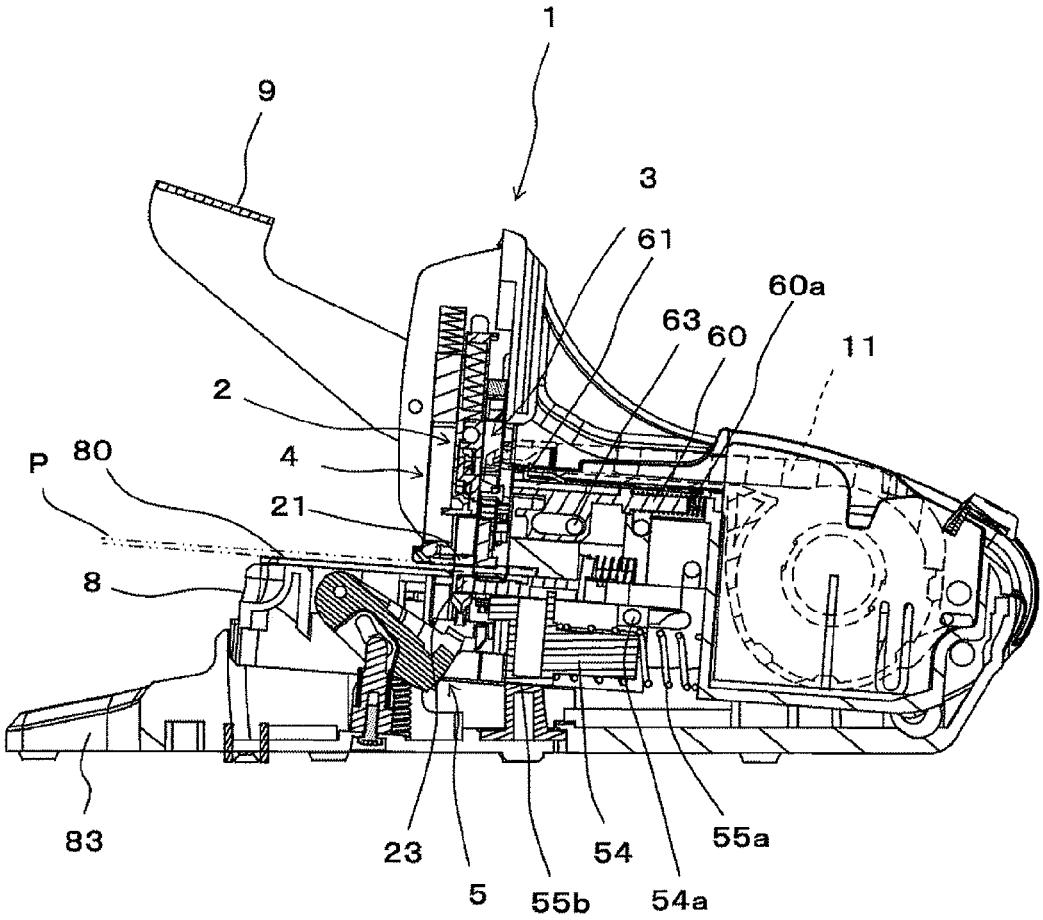
FIG. 56 is an operation chart illustrating an exemplary operation of the entire stapler.
Figure 75:
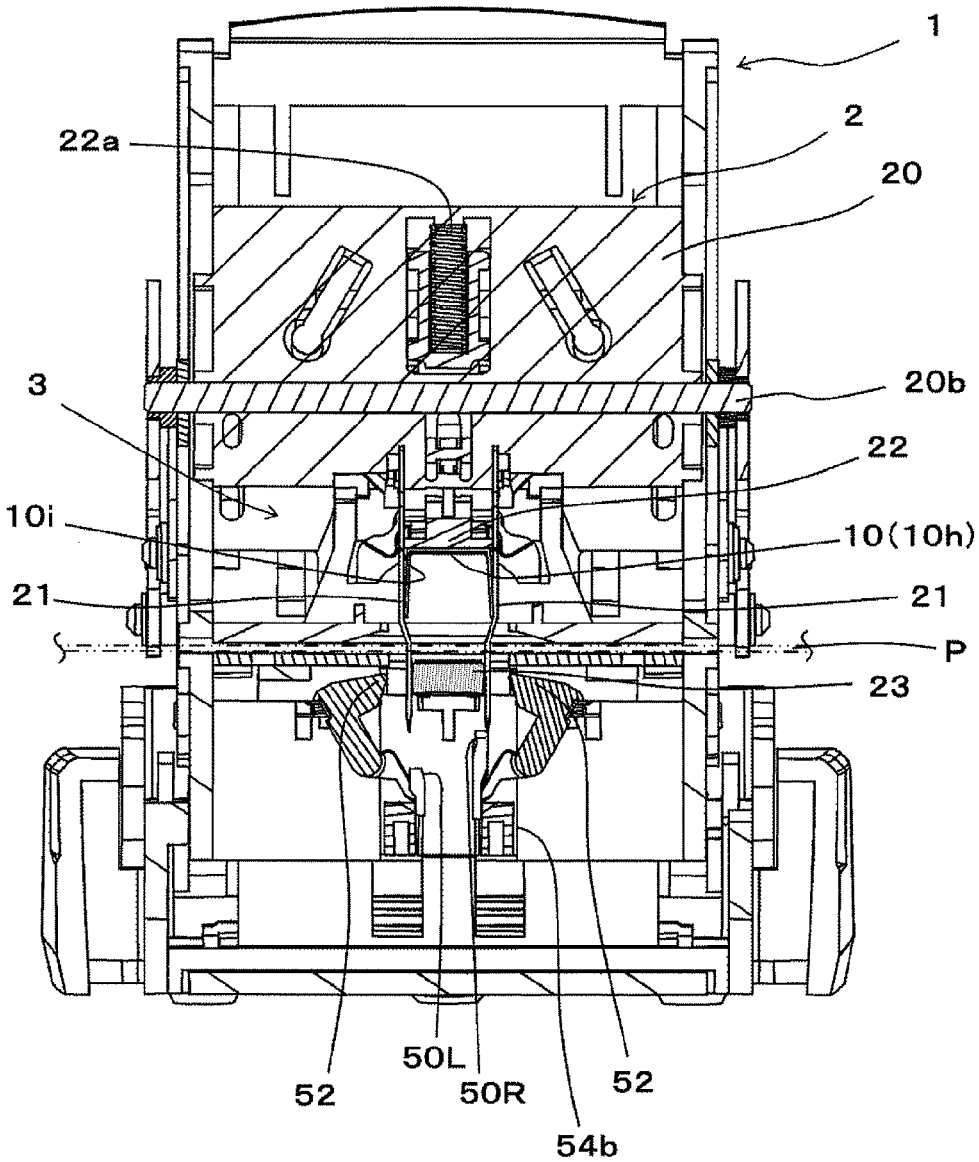
FIG. 75 is an operation chart illustrating an exemplary operation of the penetrating mechanism and the bending mechanism.

If the operating handle 9 is pushed down at the position illustrated in FIG. 56, the retreating operation of the pusher 60 and the slide member 54 is continuously performed. In the penetrating mechanism 2, as illustrated in FIGS. 21 and 75, the hole expansion portion 21*e* of the cutting blade 21 arrives at the paper sheets P, and the hole P1 opened in the paper sheets P is winded in the outward direction. The forming of the staple by the cutting/forming mechanism 3 is continuously performed, which is not illustrated.

<Operation Start of Opening Retaining Member>

Figure 57:
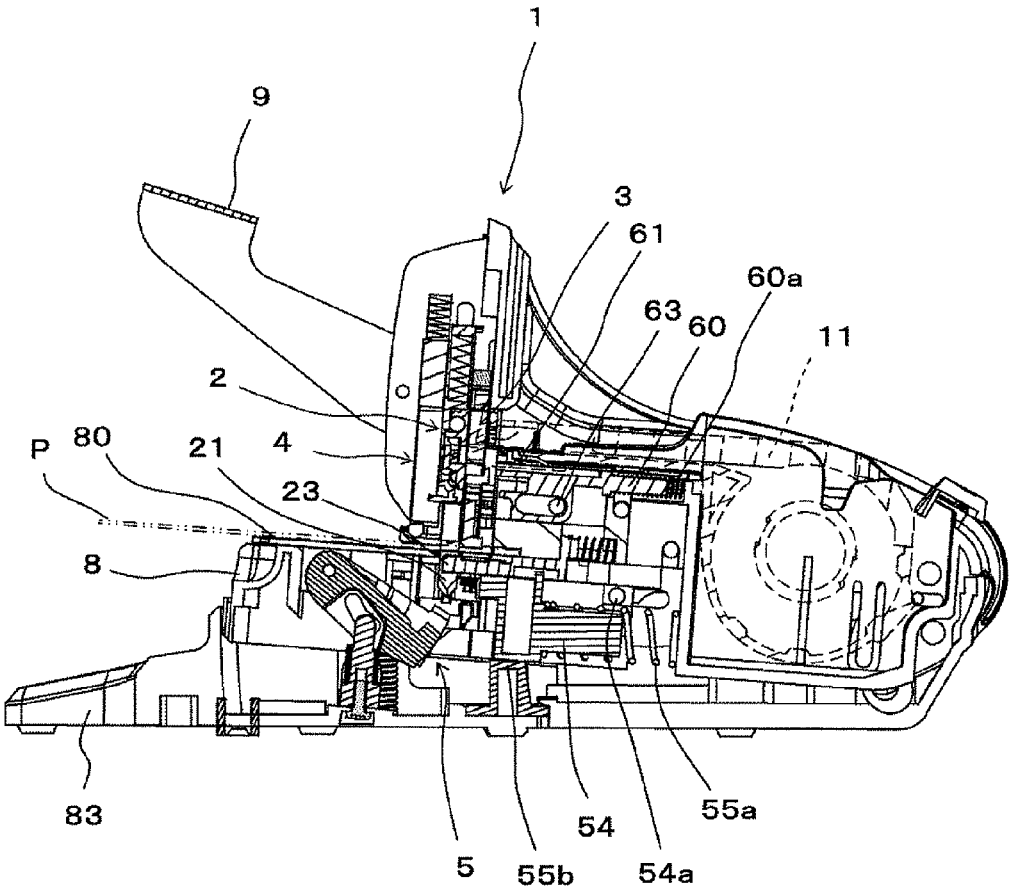
FIG. 57 is an operation chart illustrating an exemplary operation of the entire stapler.
Figure 76:
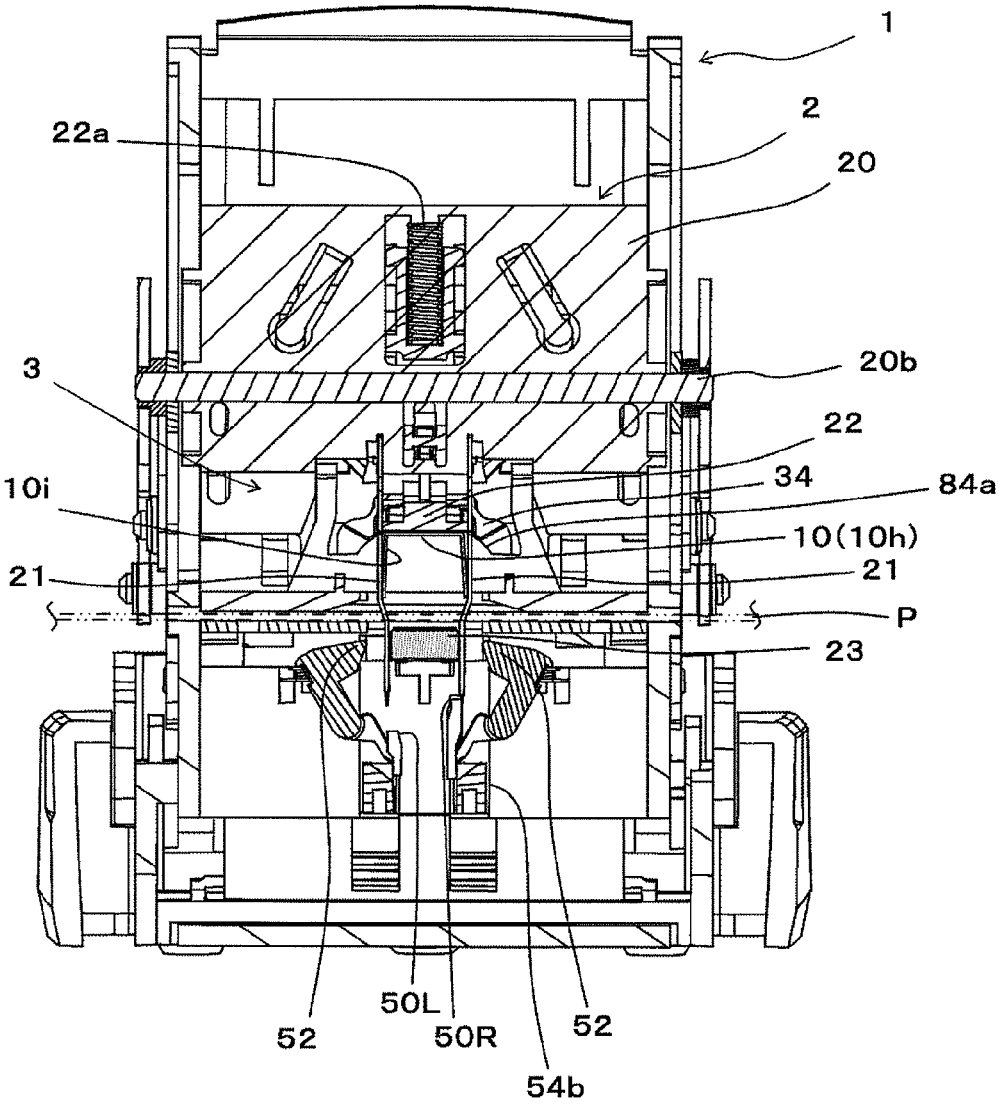
FIG. 76 is an operation chart illustrating an exemplary operation of the penetrating mechanism and the bending mechanism.
Figure 94:
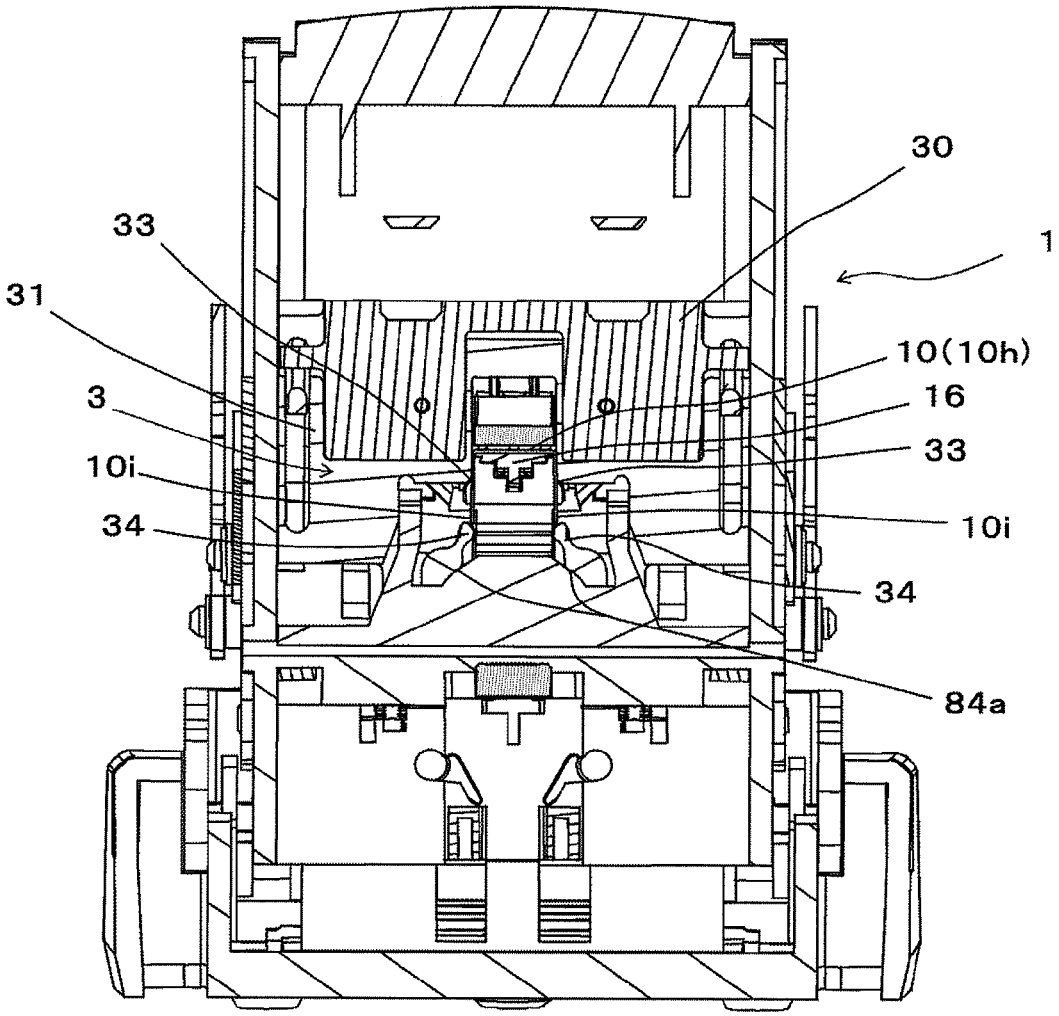
FIG. 94 is an operation chart illustrating an exemplary operation of the cutting/forming mechanism.

If the operating handle 9 is pushed down at the position illustrated in FIG. 57, the retreating operation of the pusher 60 and the slide member 54 is continuously performed. In the penetrating mechanism 2, as illustrated in FIG. 76, the hole expansion portion 21*e* of the cutting blade 21 penetrates the paper sheets P. In the cutting/forming mechanism 3, as illustrated in FIG. 94, as the cutter plate 30 and the forming plate 31 are lowered, the opening retaining members 34 abut against open cam surfaces 84*a* formed on the body section 8, and thus starts opening outwardly.

<Operation End of Opening Retaining Member>

Figure 58:
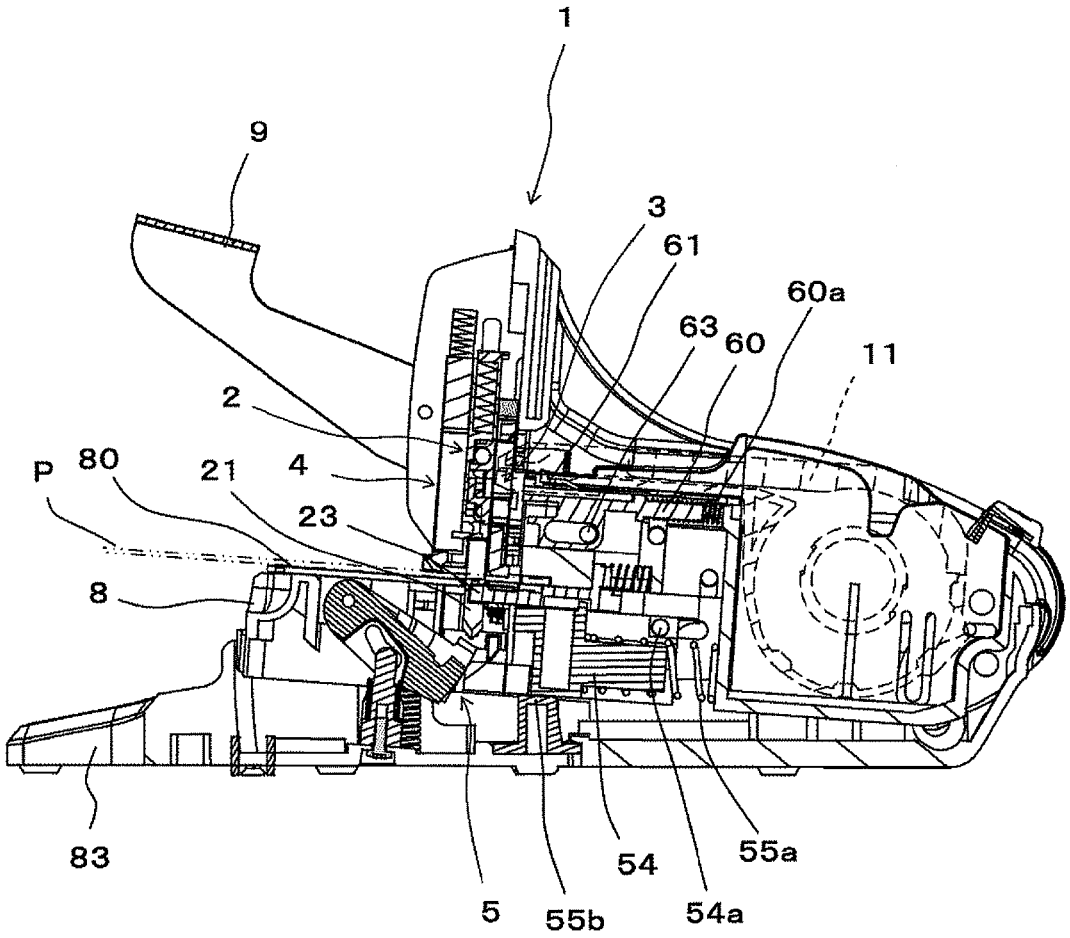
FIG. 58 is an operation chart illustrating an exemplary operation of the entire stapler.
Figure 77:
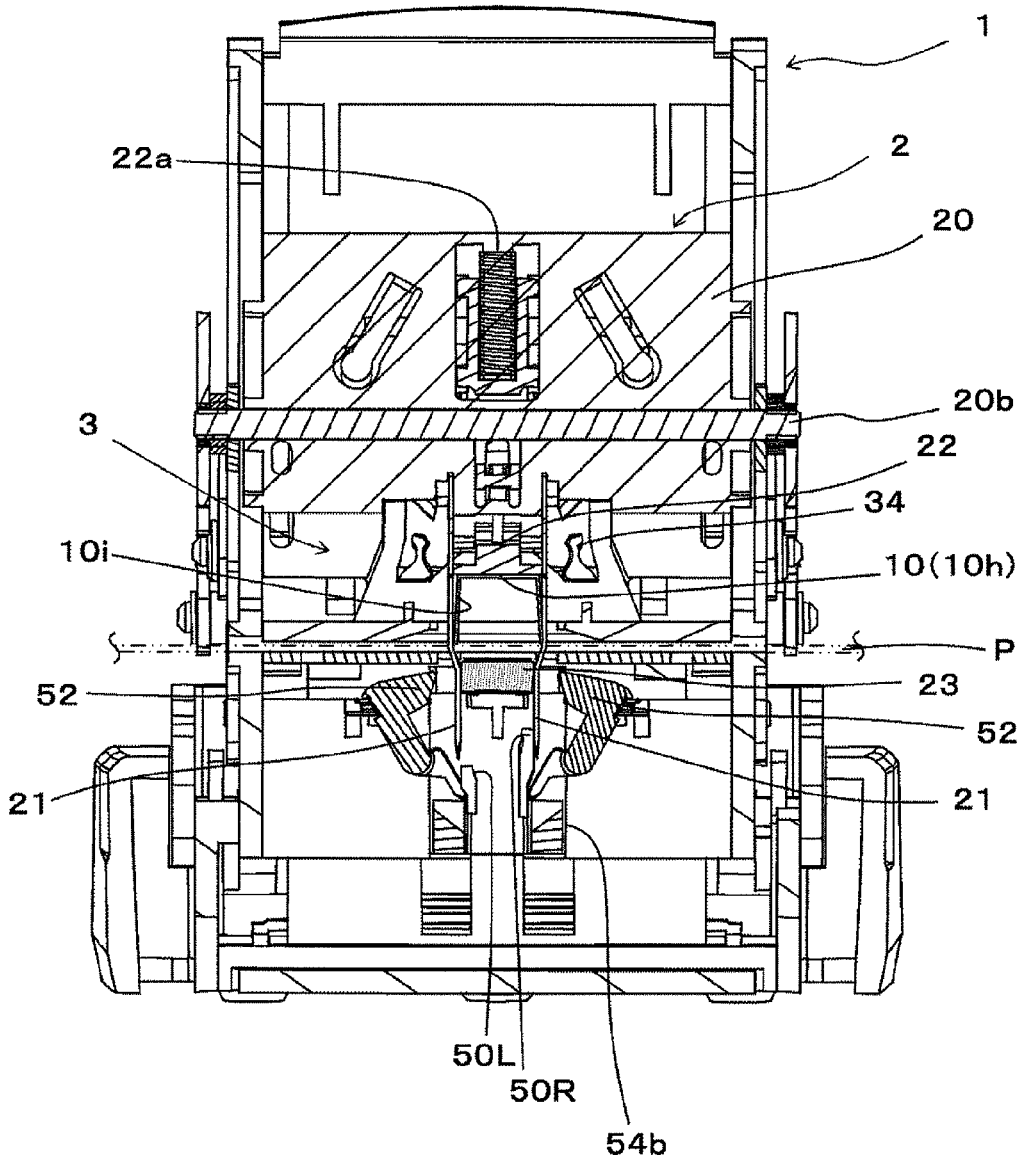
FIG. 77 is an operation chart illustrating an exemplary operation of the penetrating mechanism and the bending mechanism.

If the operating handle 9 is pushed down at the position illustrated in FIG. 58, the retreating operation of the pusher 60 and the slide member 54 is continuously performed. In the penetrating mechanism 2, as illustrated in FIG. 77, the second penetrating portion 21*c* of the cutting blade 21 penetrates the paper sheets P, and thus the staple 10 held inside the cutting blades 21 starts penetrating the paper sheets P.

Figure 95:
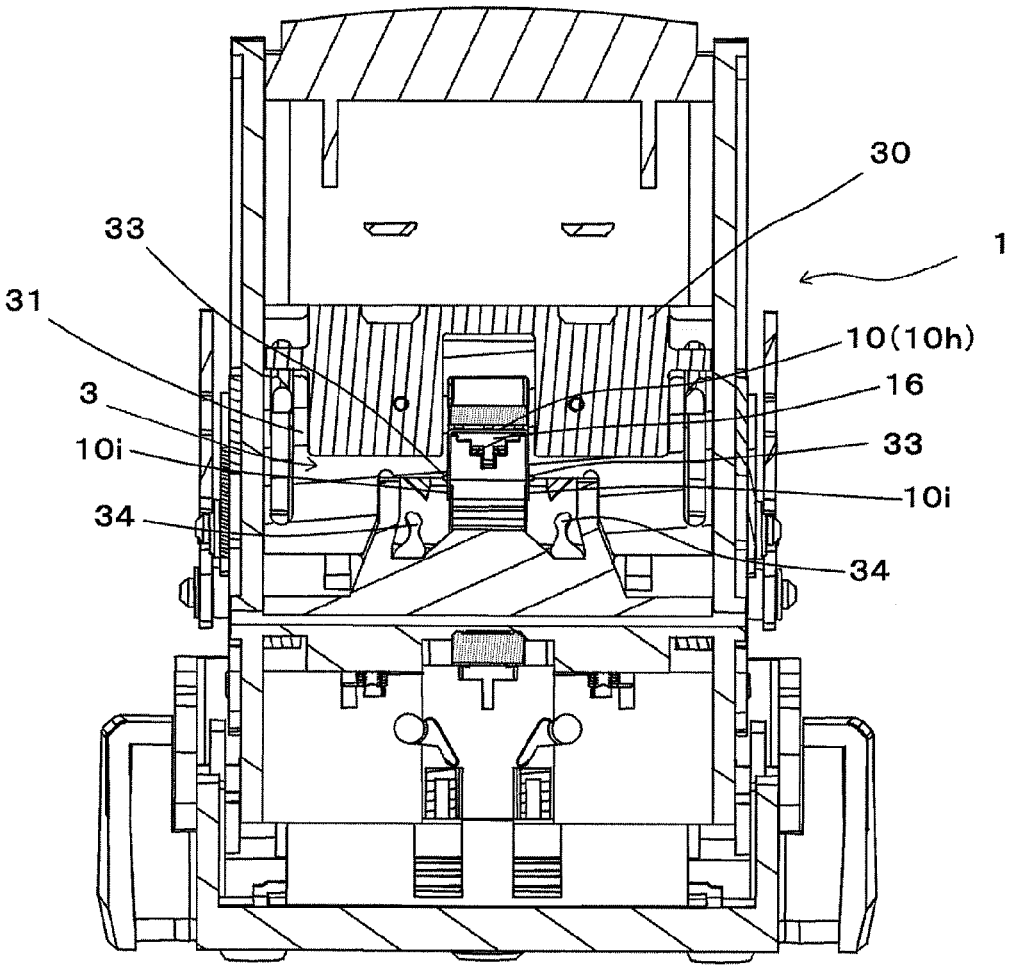
FIG. 95 is an operation chart illustrating an exemplary operation of the cutting/forming mechanism.

In the cutting/forming mechanism 3, as illustrated in FIGS. 35 and 95, as the cutter plate 30 and the forming plate 31 are lowered, the staple 10 is bent in the first direction so that the one pair of leg portions 10*i* are substantially parallel to each other, thereby forming the crown portion 10*h* and the leg portions 10*i*. As a result, the forming is terminated. Also, opening retaining members 34 are opened, and then the operation is terminated.

<Operation Start of Cutting Blade Guide>

Figure 59:
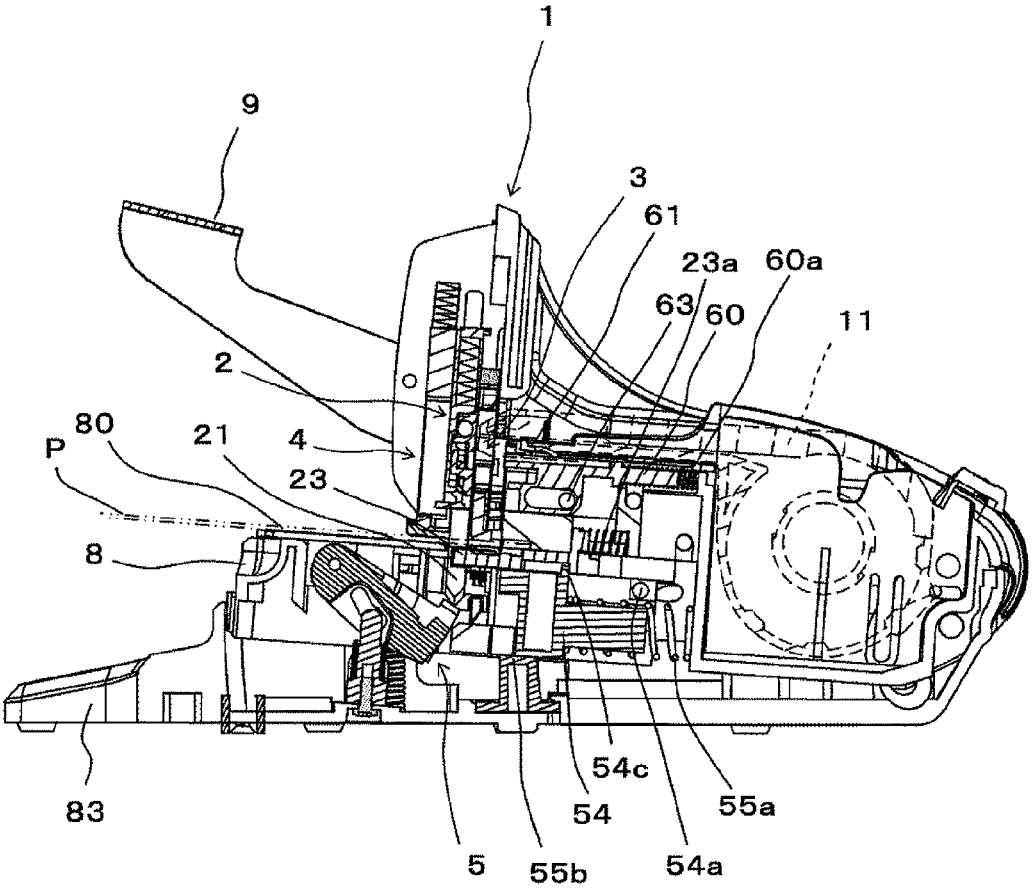
FIG. 59 is an operation chart illustrating an exemplary operation of the entire stapler.

If the operating handle 9 is pushed down at the position illustrated in FIG. 59, the retreating operation of the pusher 60 and the slide member 54 is continuously performed, and the operating convex portion 54*c* of the slide member 54 abuts against the cutting blade guide 23. The spring 23*a* is compressed, and the cutting blade guide 23 starts retreating.

Figure 78:
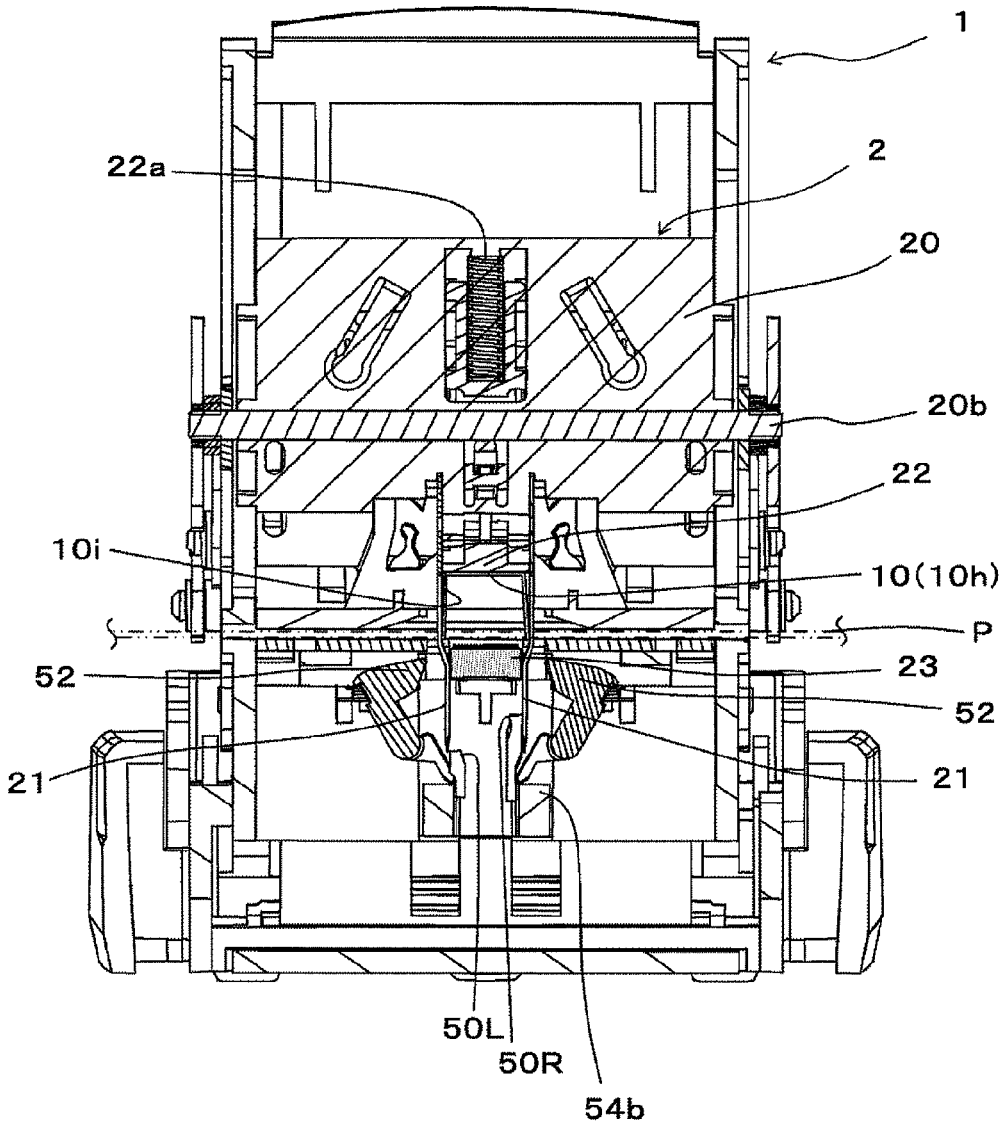
FIG. 78 is an operation chart illustrating an exemplary operation of the penetrating mechanism and the bending mechanism.

In the penetrating mechanism 2, as illustrated in FIG. 78, the second penetrating portion 21*c* of the cutting blade 21 penetrates the paper sheets P, and the staple 10 held inside the cutting blades 21 penetrates the paper sheets P. The tip end of each cutting blade 21 is guided by the first bending member 50R and the second bending member 50L. As a result, even though the cutting blade guide 23 is retreated, the displacement in the inclining direction is suppressed. The cutting/forming mechanism 3 is lowered, and thus is not operated.

<Operation Start of Ejecting Member>

Figure 60:
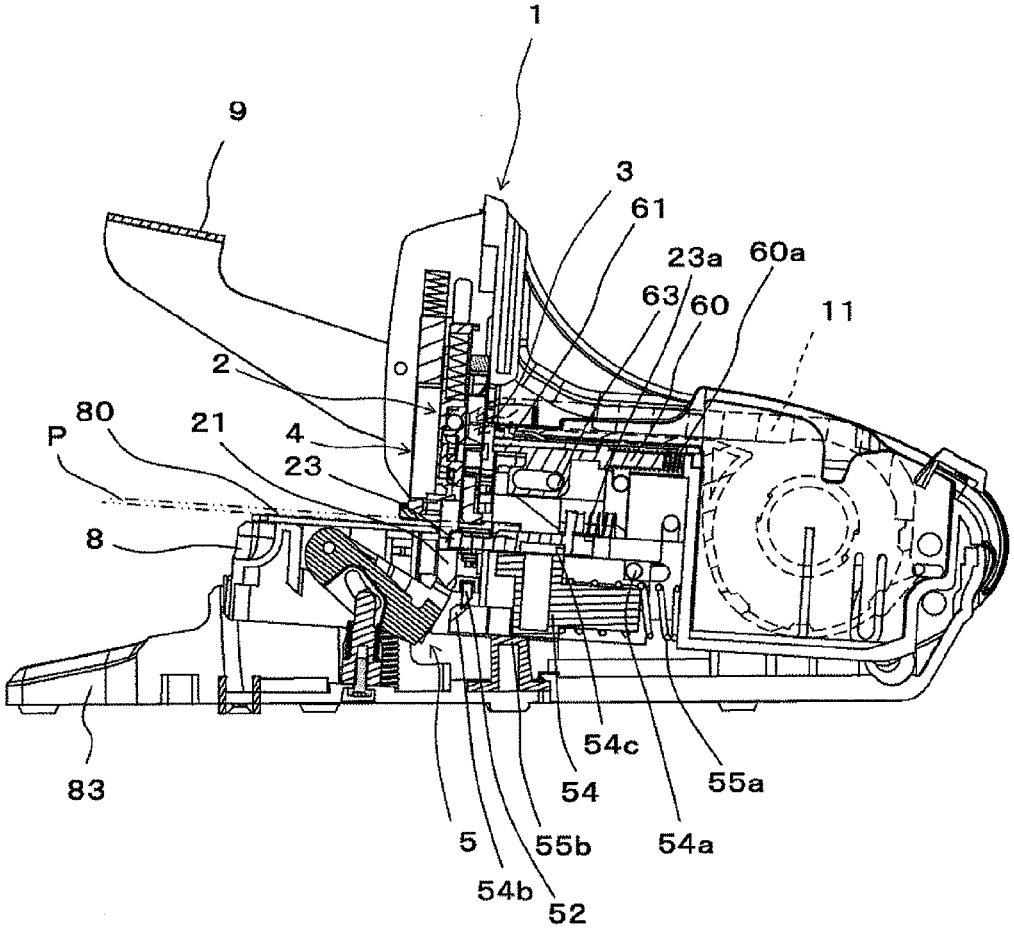
FIG. 60 is an operation chart illustrating an exemplary operation of the entire stapler.
Figure 79:
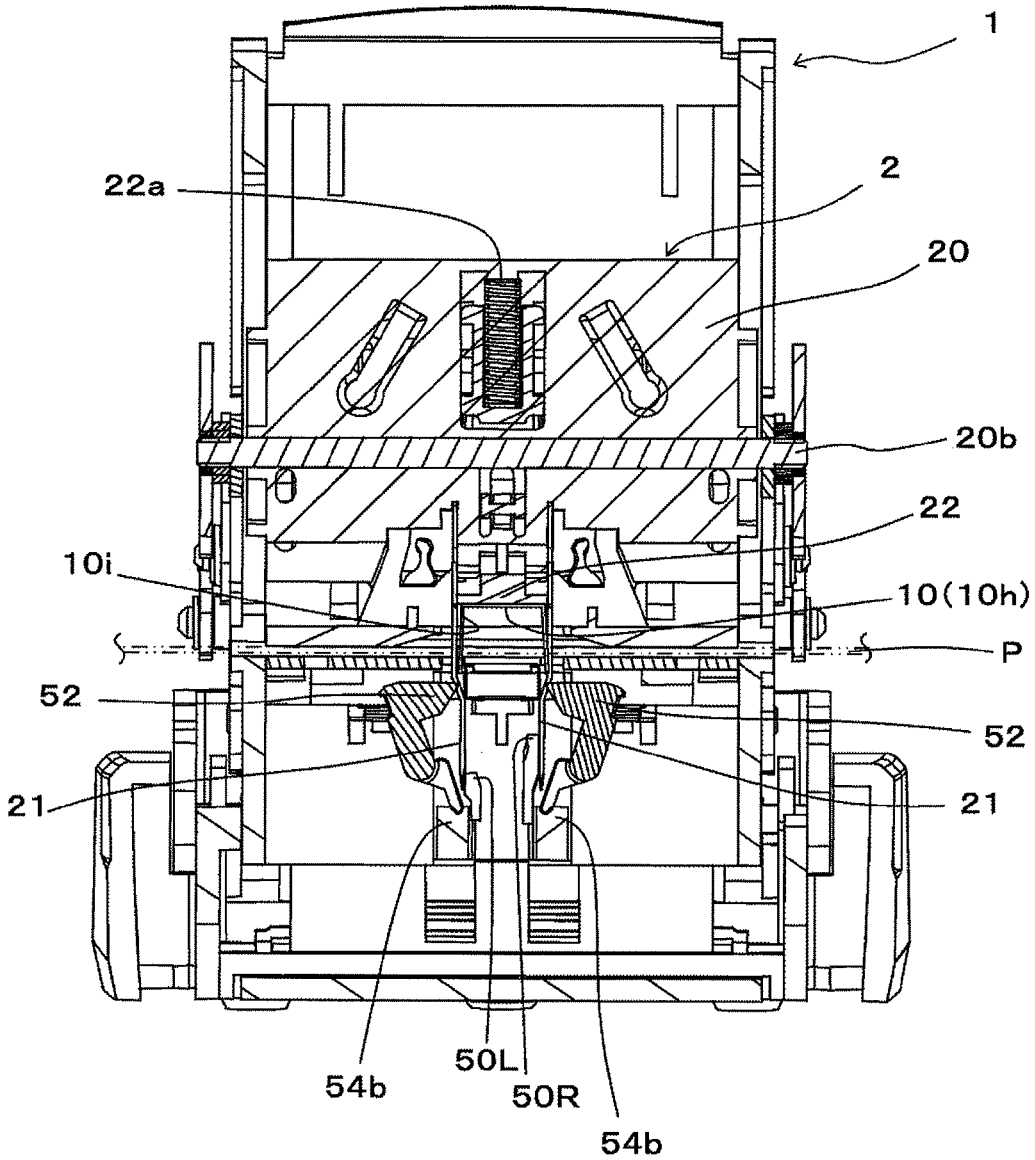
FIG. 79 is an operation chart illustrating an exemplary operation of the penetrating mechanism and the bending mechanism.

If the operating handle 9 is pushed down at the position illustrated in FIG. 60, the retreating operation of the pusher 60 and the slide member 54 is continuously performed, and is guided by the guide surface of the guide portion 54*b* of the slide member 54. As a result, as illustrated in FIG. 79, the ejecting members 52 start closing in the inward direction. In the penetrating mechanism 2, as illustrated in FIG. 79, the second penetrating portion 21*c* of the cutting blade 21 penetrates the paper sheets P, and thus the staple 10 held inside the cutting blades 21 penetrate the paper sheets P.

<Start of Staple Bending>

Figure 61:
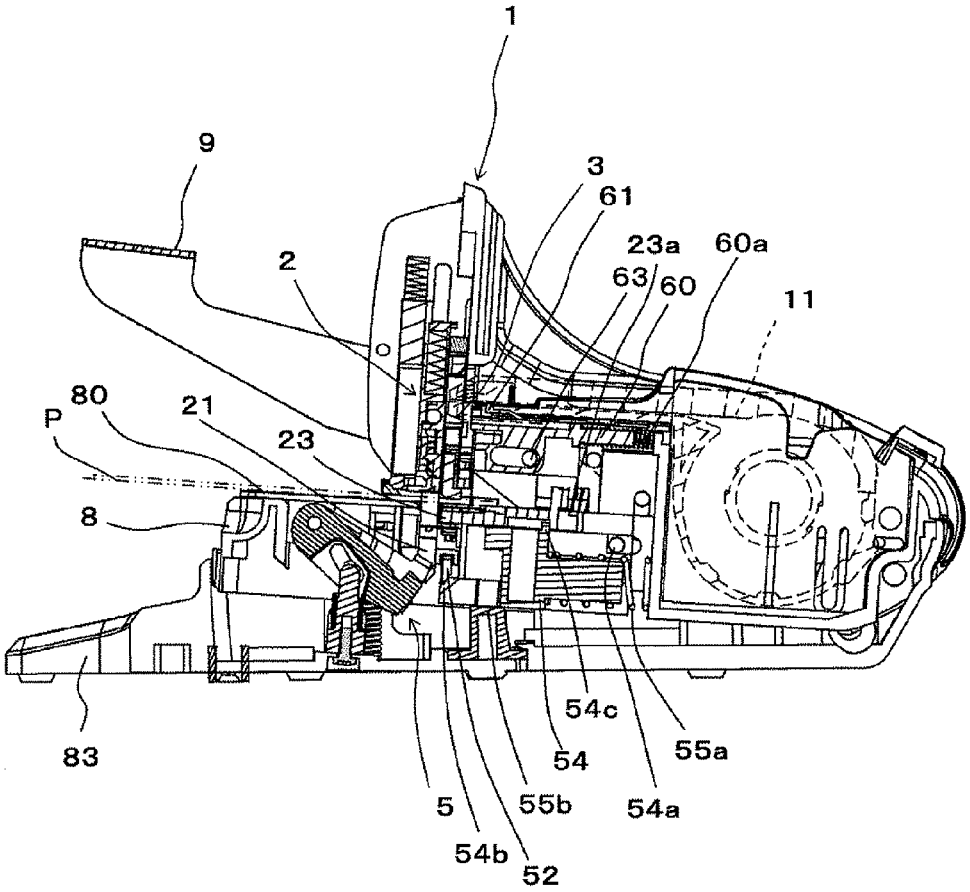
FIG. 61 is an operation chart illustrating an exemplary operation of the entire stapler.

If the operating handle 9 is pushed down at the position illustrated in FIG. 61, the retreating operation of the pusher 60 and the slide member 54 is continuously performed, and is guided by the guide surface of the guide portion 54*b* of the slide member 54. As a result, as illustrated in FIG. 80, the ejecting members 52 are closed in the inward direction, and protrude into the ejecting hole 21*f* of the cutting blade 21 lowered at the predetermined position.

Figure 80:
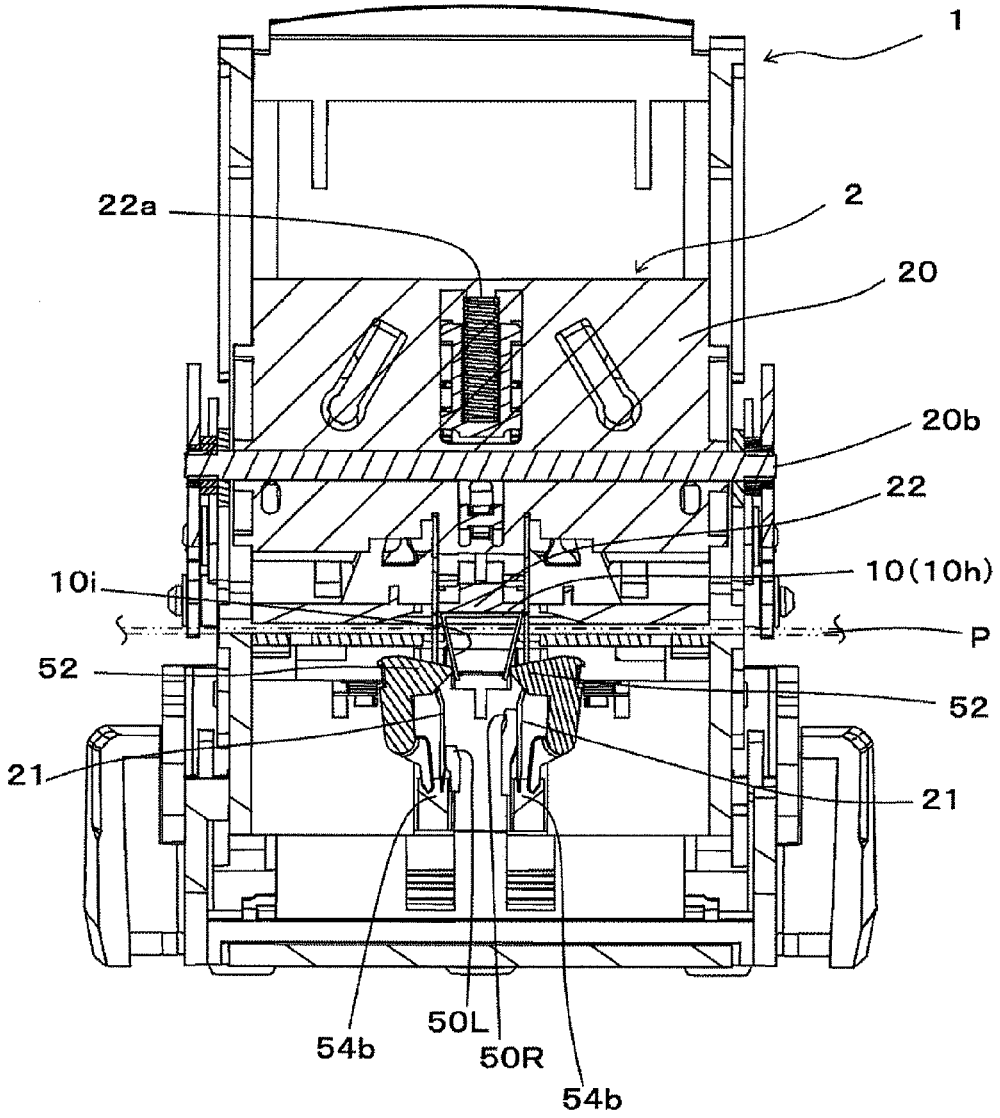
FIG. 80 is an operation chart illustrating an exemplary operation of the penetrating mechanism and the bending mechanism.

In the penetrating mechanism 2, as illustrated in FIG. 80, the second penetrating portion 21*c* of the cutting blade 21 penetrates the paper sheets P. In association with the penetrating operation of the staple 10 held inside the cutting blades 21 into the paper sheets P, the one pair of leg portions 10*i* of the staple 10 are bent in the inward direction by the ejecting member 52 protruding into the ejecting hole 21*f*.

<Landing of Staple Press-Down Portion>

Figure 62:
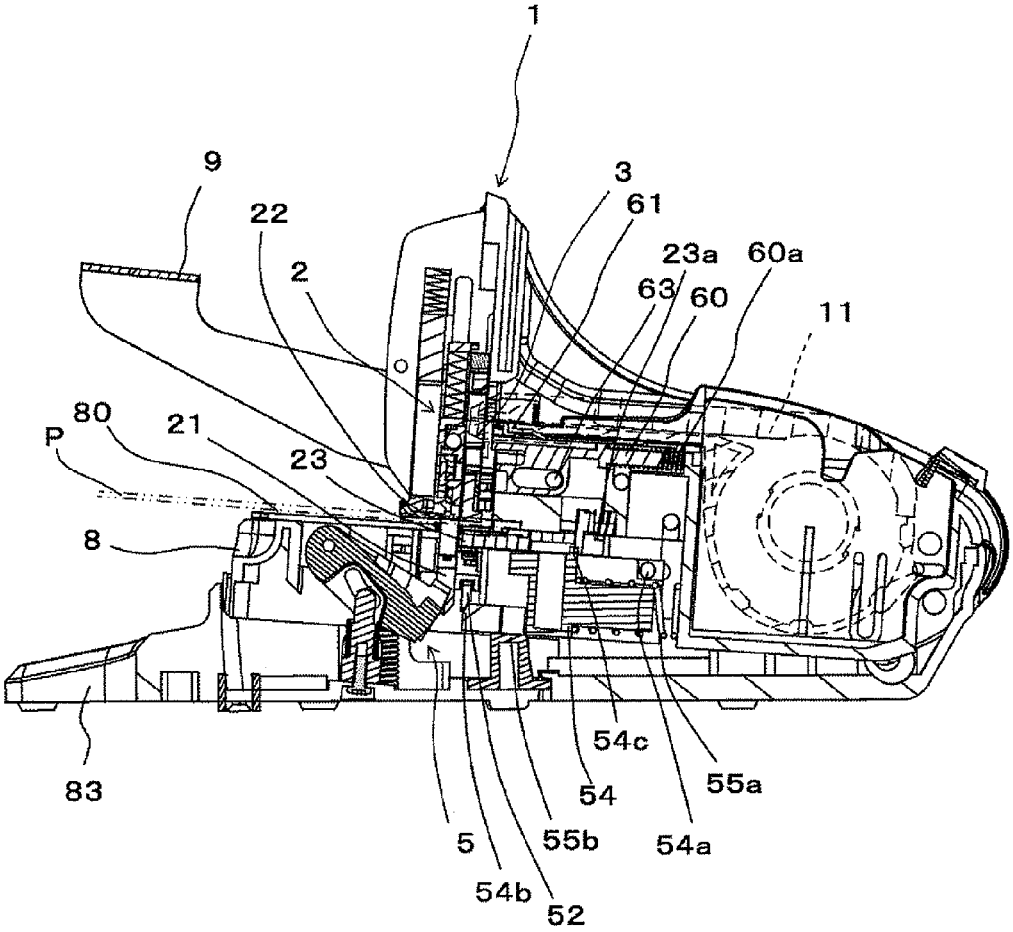
FIG. 62 is an operation chart illustrating an exemplary operation of the entire stapler.
Figure 81:
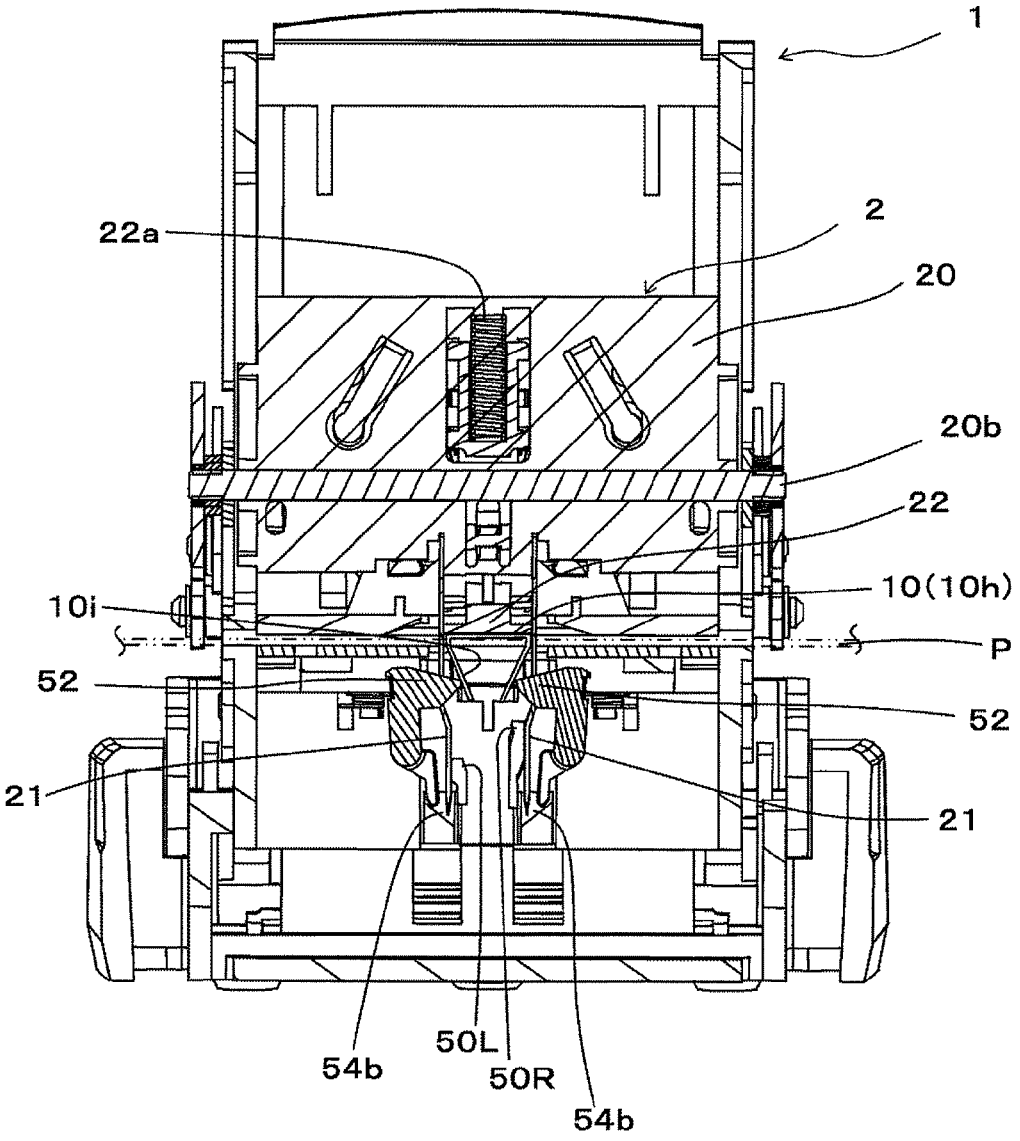
FIG. 81 is an operation chart illustrating an exemplary operation of the penetrating mechanism and the bending mechanism.

If the operating handle 9 is pushed down at the position illustrated in FIG. 62, the retreating operation of the pusher 60 and the slide member 54 is continuously performed. In the penetrating mechanism 2, as illustrated in FIG. 81, the staple press-down portion 22 lands on the paper sheets P.

<Clutch Disengagement>

Figure 50:
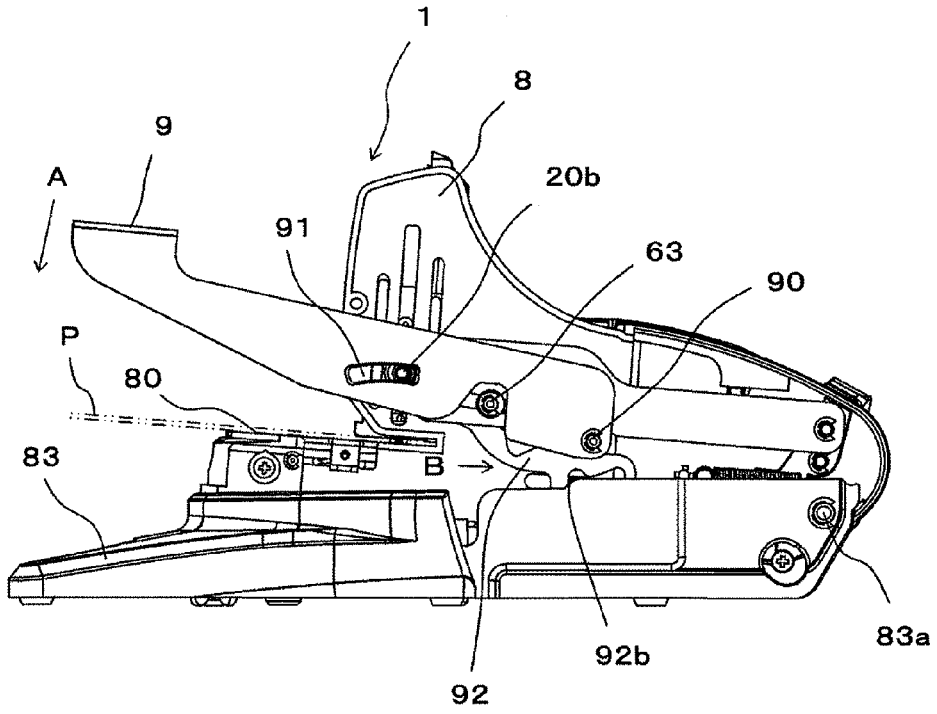
FIG. 50 is an operation chart illustrating an exemplary operation of the operating handle portion.
Figure 63:
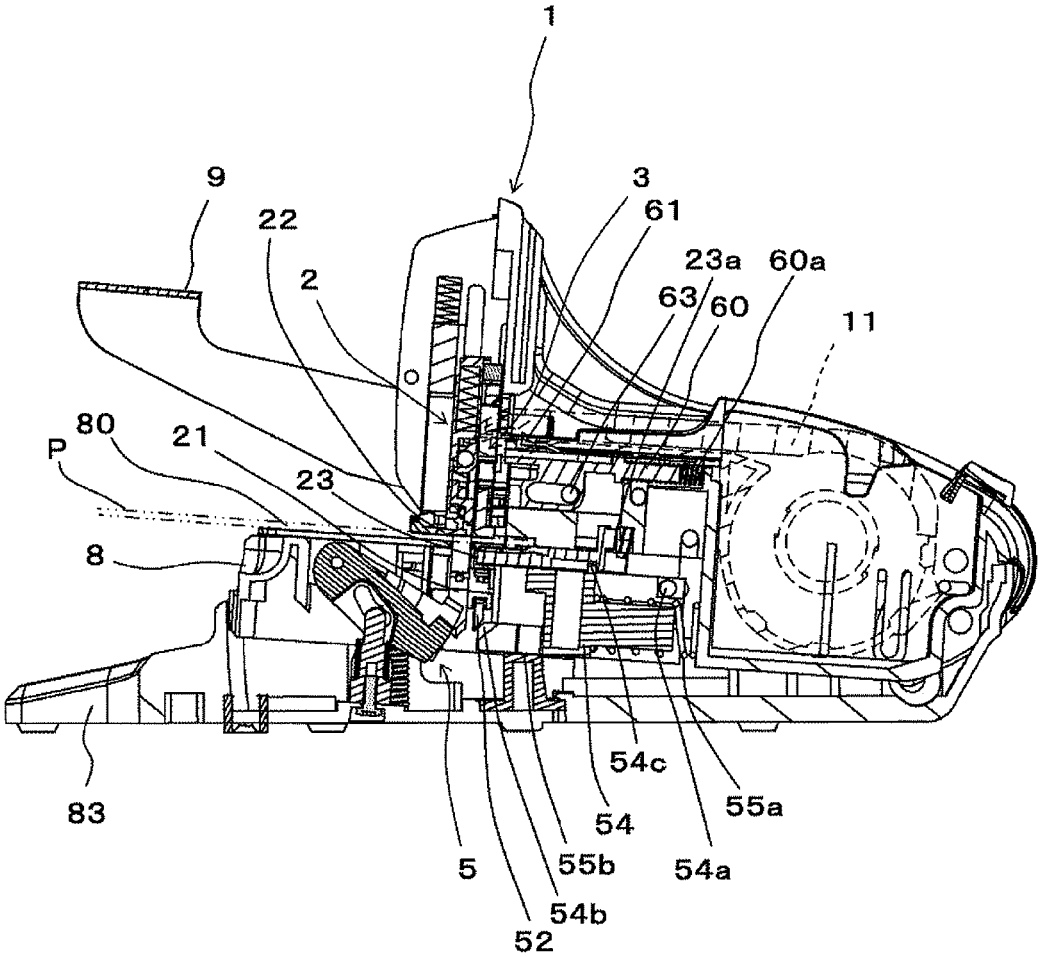
FIG. 63 is an operation chart illustrating an exemplary operation of the entire stapler.

If the operating handle 9 is pushed down at the position illustrated in FIGS. 50 and 63, the retreating operation of the pusher 60 and the slide member 54 is continuously performed, and the slide member 54 is retreated to a determined release position. The slide member 54 is spaced apart from the receiving member 55*b*, which is referred to as clutch disengagement.

Figure 82:
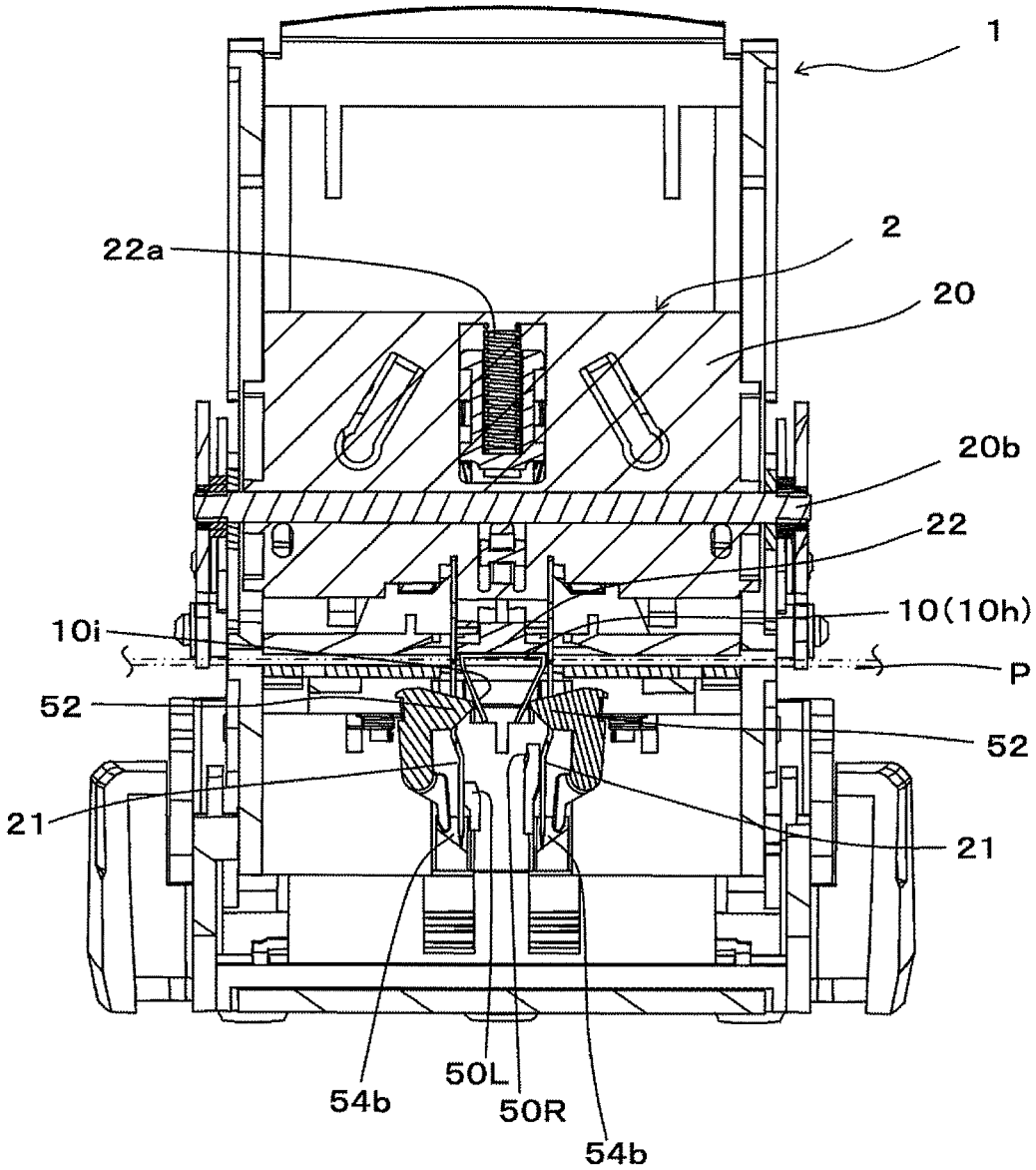
FIG. 82 is an operation chart illustrating an exemplary operation of the penetrating mechanism and the bending mechanism.

The penetrating mechanism 2 is lowered to the bending mechanism operating position M, as illustrated in FIGS. 26, 27, and 82, and the crown portion 10*h* of the staple 10 is stapled by the staple press-down portion 22 to press the paper sheets P.

<Clinch Start>

Figure 64:
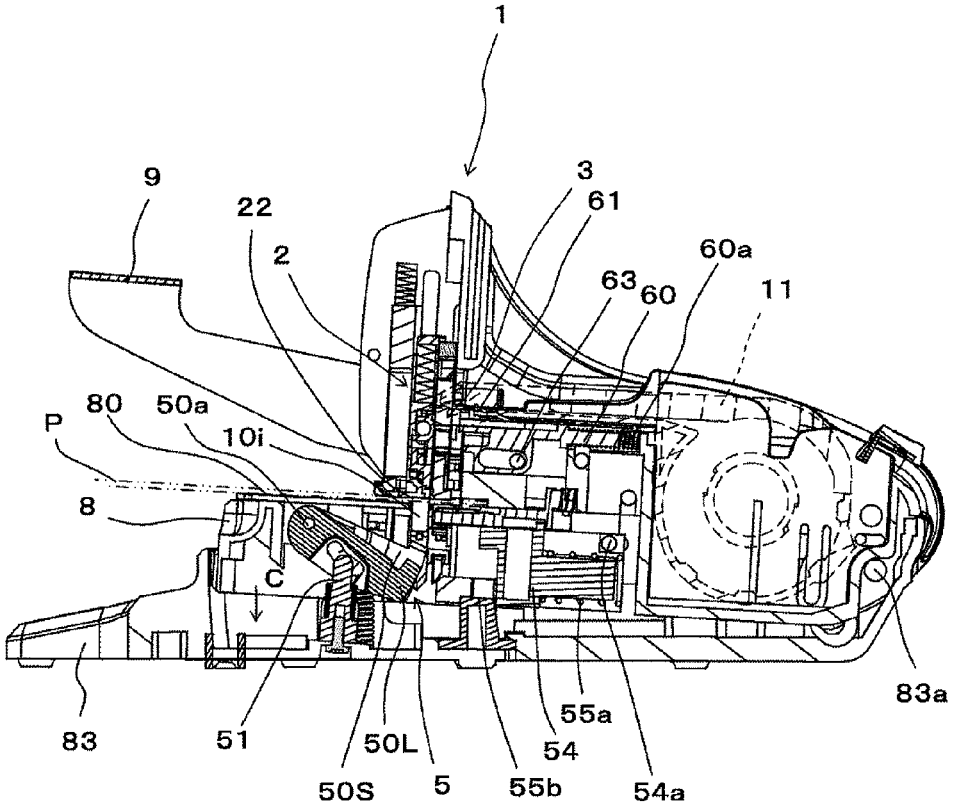
FIG. 64 is an operation chart illustrating an exemplary operation of the entire stapler.
Figure 83:
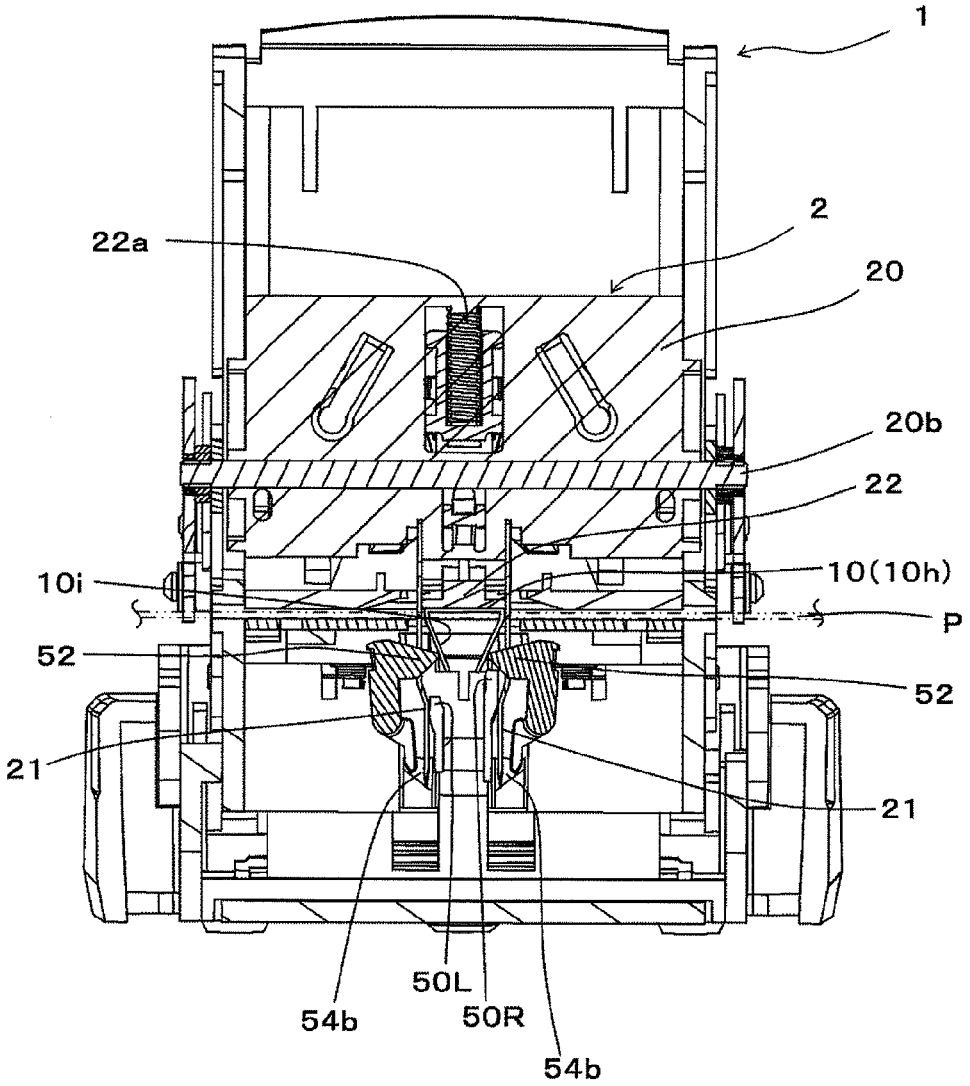
FIG. 83 is an operation chart illustrating an exemplary operation of the penetrating mechanism and the bending mechanism.

If the operating handle 9 is pushed down at the position illustrated in FIG. 64, the retreating operation of the pusher 60 and the slide member 54 is continuously performed. In the bending mechanism 5, as illustrated in FIGS. 64 and 83, the body section 8 is rotated, which is indicated by the arrow C, by the pushing force of the operating handle 9. As the body section 8 is rotated, the first bending member 50R, the second bending member 50L, and the bonding member 40S start pushing up by the push-up member 51, and the operating of bending the leg portions 10*i* of the staple which is referred to as clinch is started.

<Clinch of Right Leg Portion>

Figure 65:
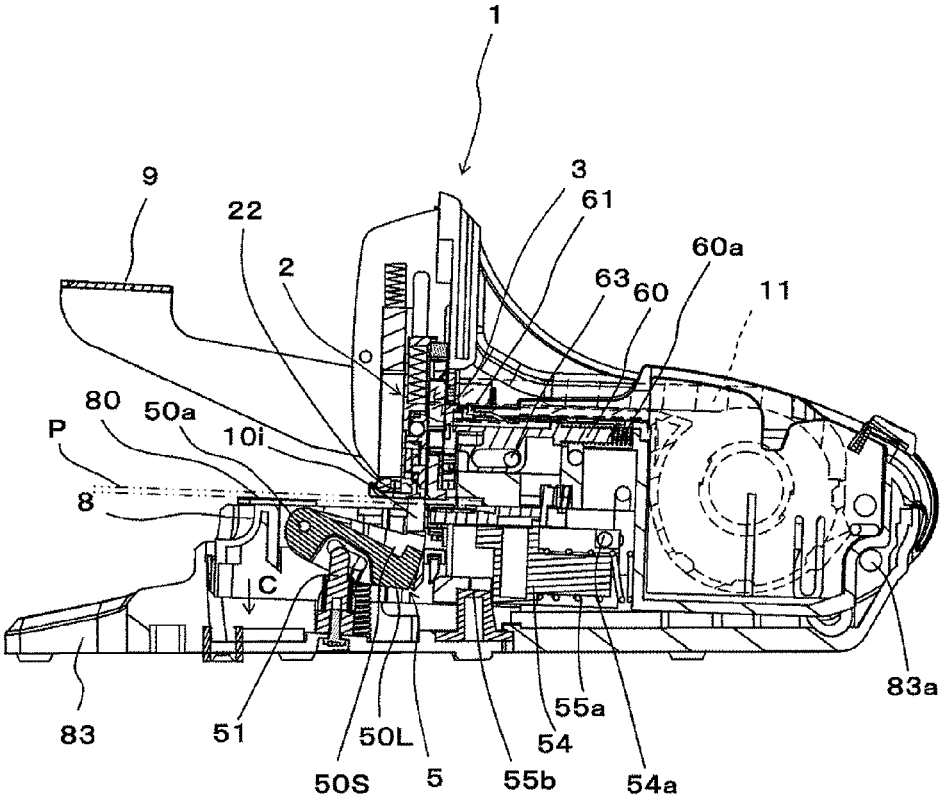
FIG. 65 is an operation chart illustrating an exemplary operation of the entire stapler.
Figure 84:
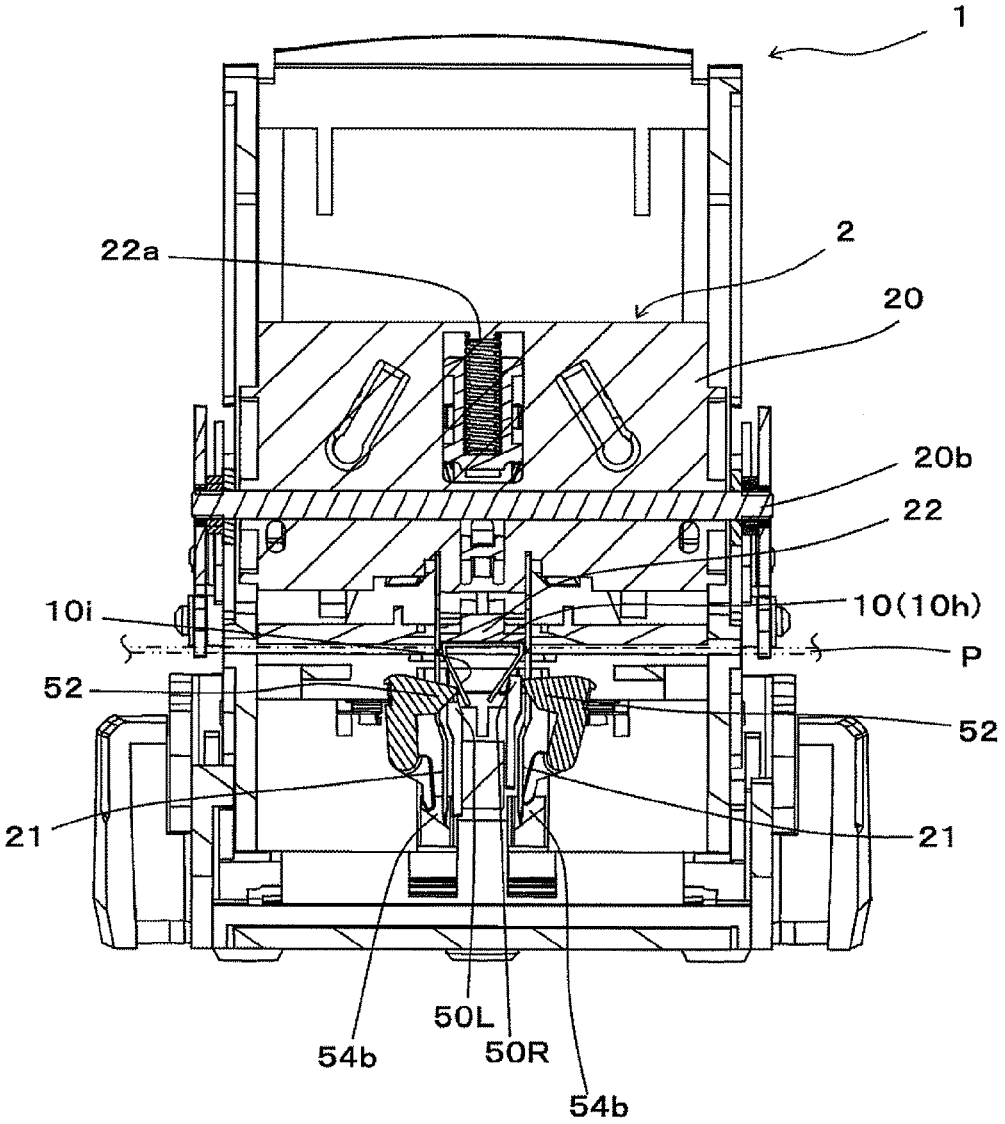
FIG. 84 is an operation chart illustrating an exemplary operation of the penetrating mechanism and the bending mechanism.

If the operating handle 9 is pushed down at the position illustrated in FIG. 65, the retreating operation of the pusher 60 and the slide member 54 is continuously performed. In the bending mechanism 5, as illustrated in FIGS. 65 and 84, the body section 8 is rotated downwardly, which is indicated by the arrow C, by the pushing force of the operating handle 9. The first bending member 50R is pushed up by the push-up member 51, so that the right leg 10*i* of the staple 10 is bent.

The leg portion 10*i* of the staple 10 is bent inwardly at a desired amount by the ejecting member 52. As the first bending member 50R is rotated upwardly, since the first bending member 50R is pushed up while being displaced in an external direction, the first bending member reliably enters the outside of the right leg portion 10*i* of the staple 10, so that the leg portion 10*i* is bent.

<Clinch of Left Leg Portion>

Figure 66:
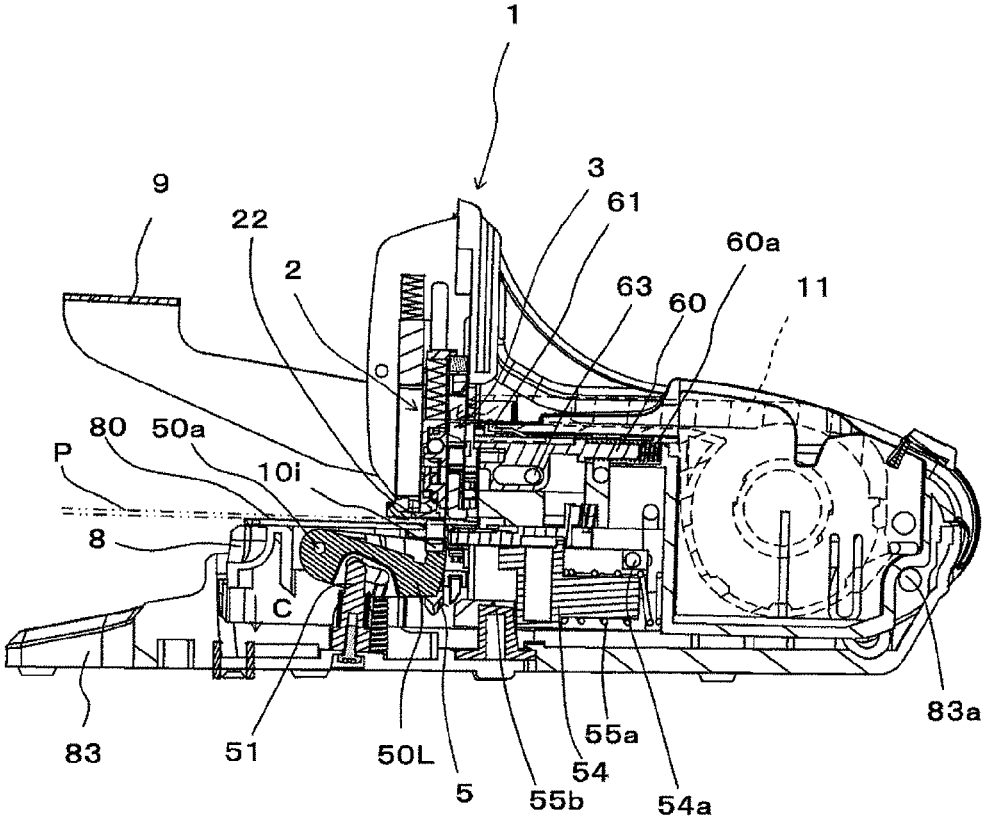
FIG. 66 is an operation chart illustrating an exemplary operation of the entire stapler.
Figure 85:
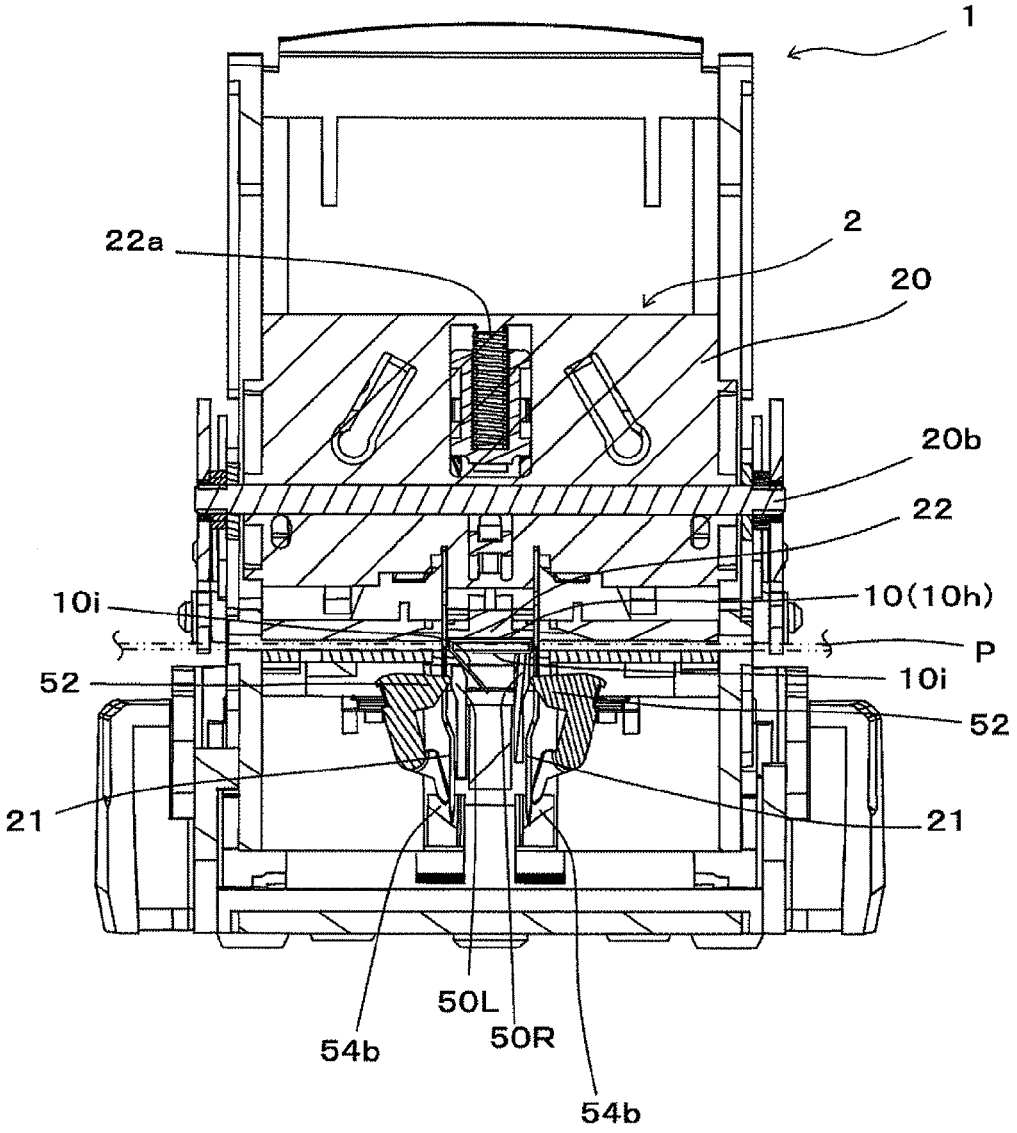
FIG. 85 is an operation chart illustrating an exemplary operation of the penetrating mechanism and the bending mechanism.

If the operating handle 9 is pushed down at the position illustrated in FIG. 66, the retreating operation of the pusher 60 and the slide member 54 is continuously performed. In the bending mechanism 5, as illustrated in FIGS. 65 and 85, the body section 8 is rotated downwardly, which is indicated by the arrow C, by the pushing force of the operating handle 9. The first bending member 50R is pushed up by the push-up member 51, so that the right leg 10*i* of the staple 10 is bent.

As the second bending member 50L is pushed up by the push-up member 51, the left leg portion 10*i* of the staple 10 is bent. As the second bending member 50L is rotated upwardly, since the second bending member 50L is pushed up while being displaced in the external direction, the second bending member reliably enters the outside of the left leg portion 10*i* of the staple 10, so that the leg portion 10*i* is bent.

<Bending End>

Figure 67:
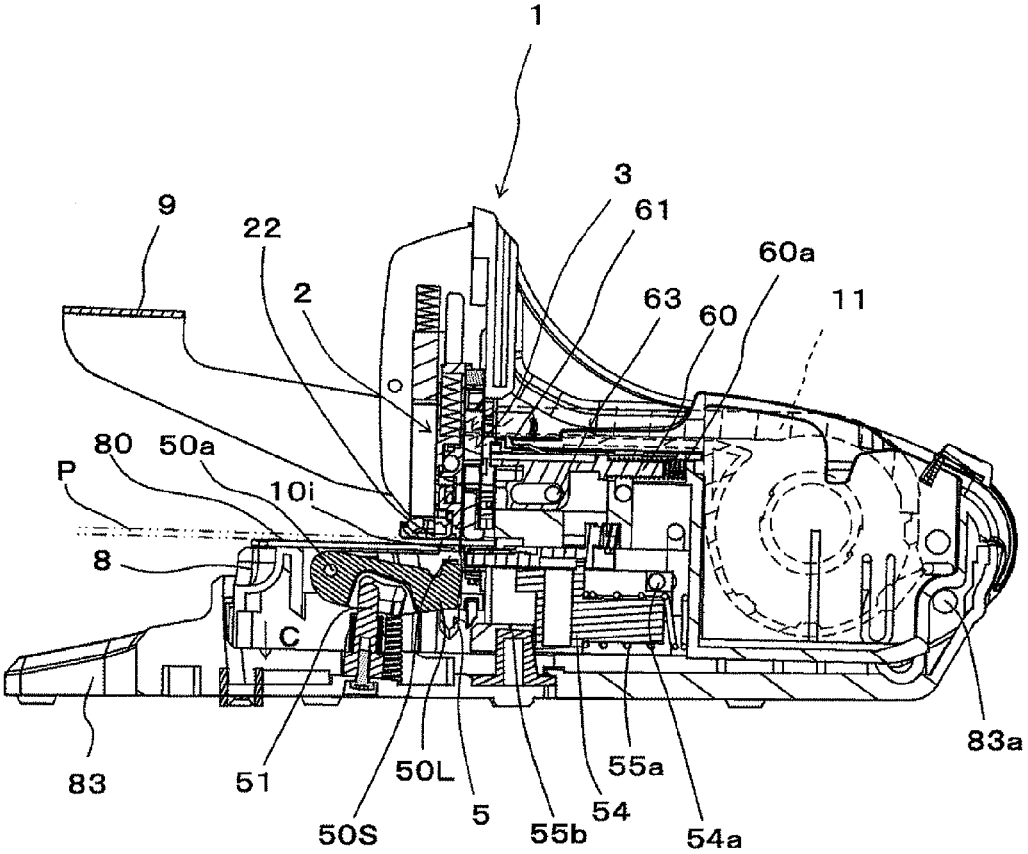
FIG. 67 is an operation chart illustrating an exemplary operation of the entire stapler.
Figure 86:
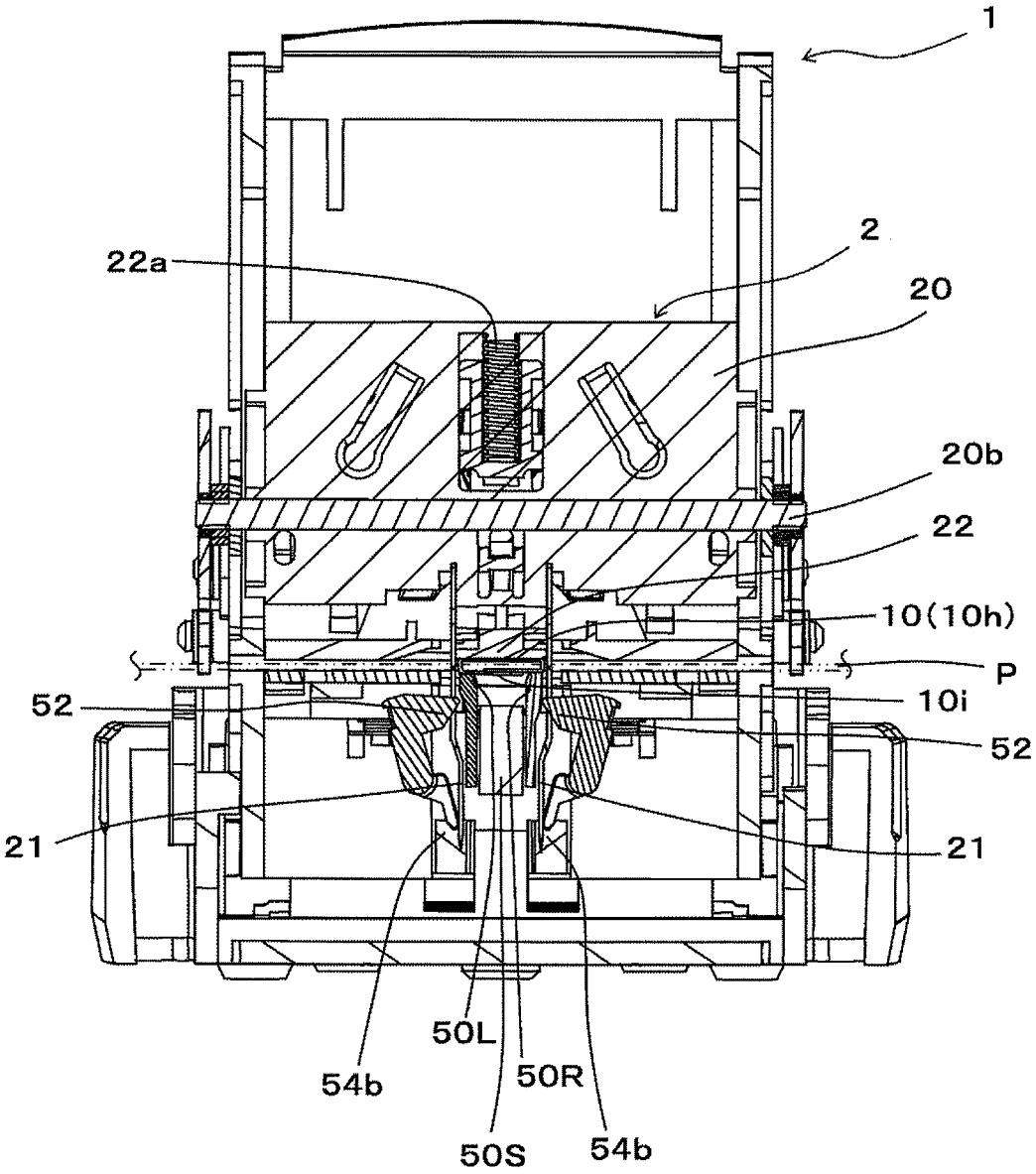
FIG. 86 is an operation chart illustrating an exemplary operation of the penetrating mechanism and the bending mechanism.

If the operating handle 9 is pushed down at the position illustrated in FIG. 67, the retreating operation of the pusher 60 and the slide member 54 is continuously performed. In the bending mechanism 5, as illustrated in FIGS. 67 and 86, the body section 8 is rotated downwardly, which is indicated by the arrow C, by the pushing force of the operating handle 9. The second bending member 50L is pushed up by the push-up member 51, so that the bending of the left leg 10*i* of the staple 10 is terminated.

<Clinch End>

Figure 51:
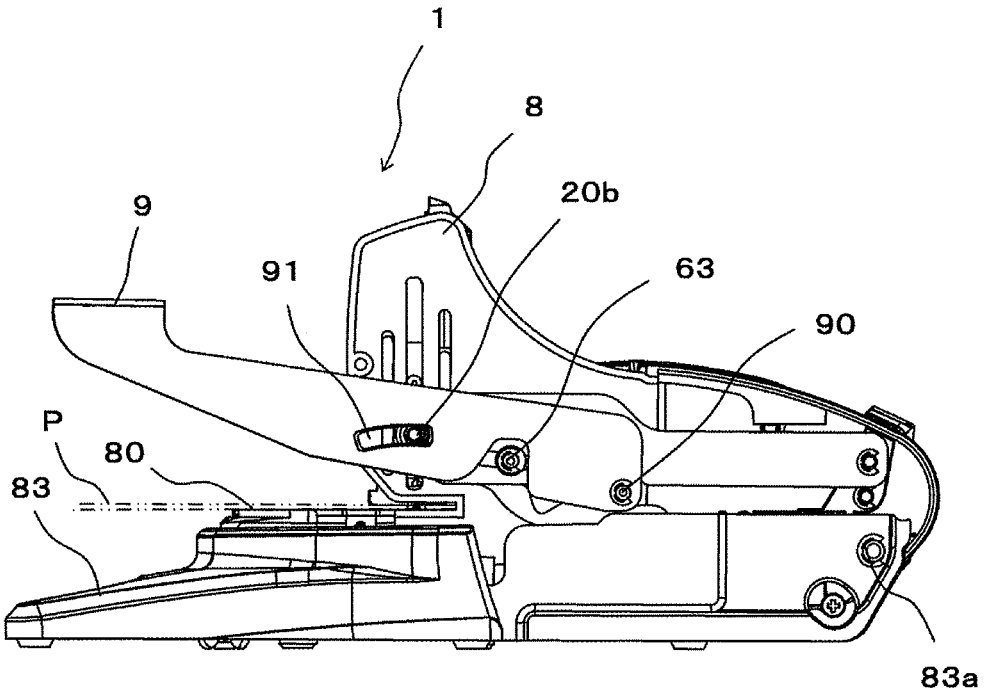
FIG. 51 is an operation chart illustrating an exemplary operation of the operating handle portion.
Figure 68:
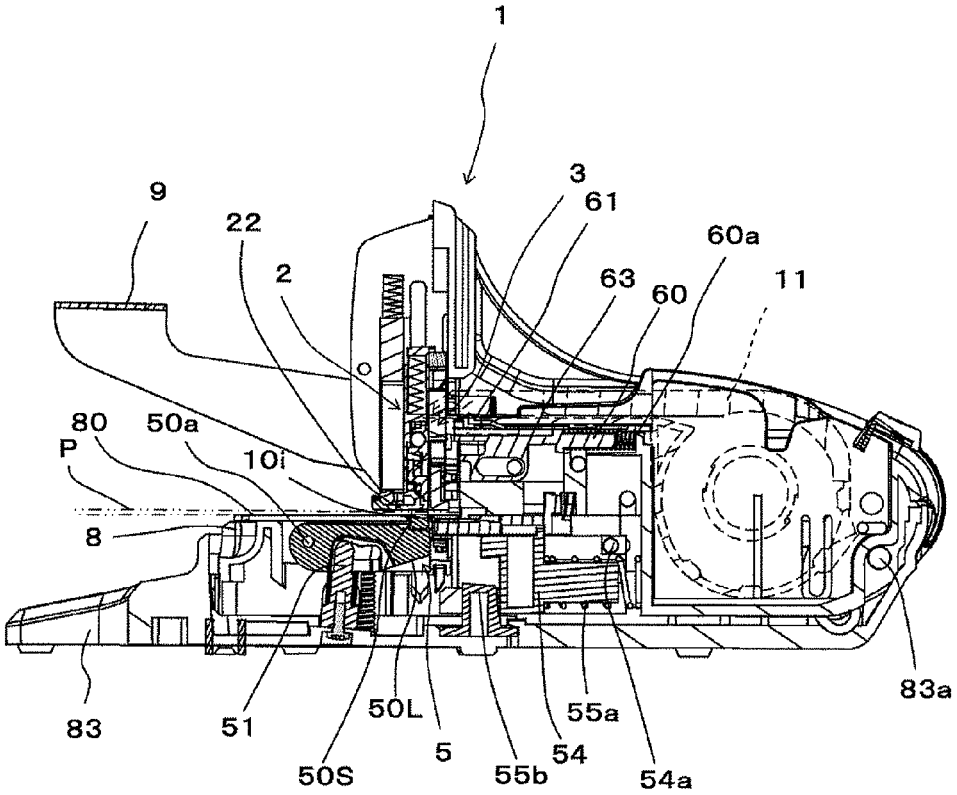
FIG. 68 is an operation chart illustrating an exemplary operation of the entire stapler.
Figure 87:
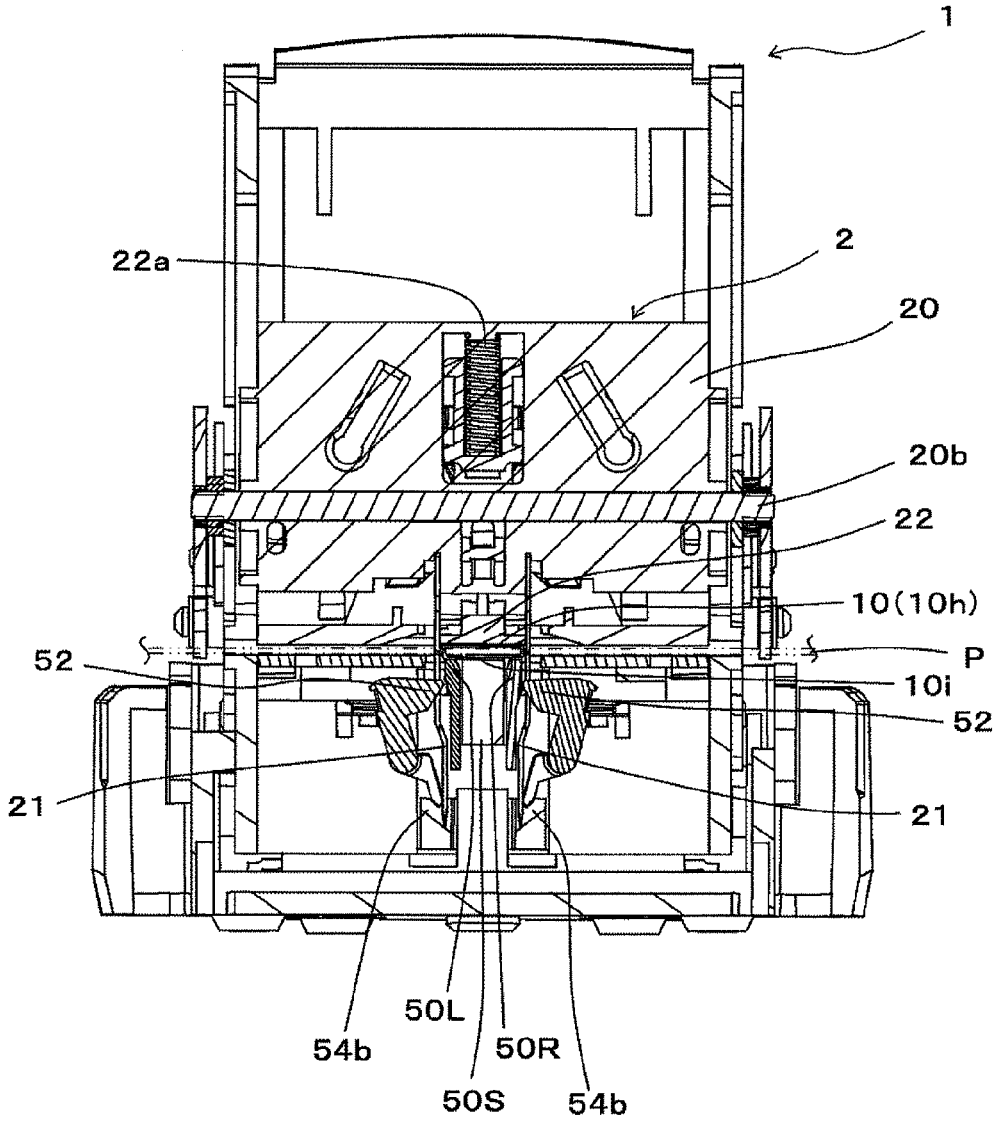
FIG. 87 is an operation chart illustrating an exemplary operation of the penetrating mechanism and the bending mechanism.

If the operating handle 9 is pushed down at the position illustrated in FIGS. 51 and 68, the retreating operation of the pusher 60 and the slide member 54 is continuously performed. In the bending mechanism 5, as illustrated in FIGS. 68 and 87, the body section 8 is rotated downwardly, which is indicated by the arrow C, by the pushing force of the operating handle 9. The bonding member 50S is pushed up by the push-up member 51, so that the one pair of overlapped leg portions 10*i* of the staple are pressed adjacent to the center portion thereof. Accordingly, as illustrated in FIG. 11, the one pair of leg portions 10*i* are bonded at the bonding portion 10*f*, and the clinch is terminated.

<Return Operation Start>

Figure 69:
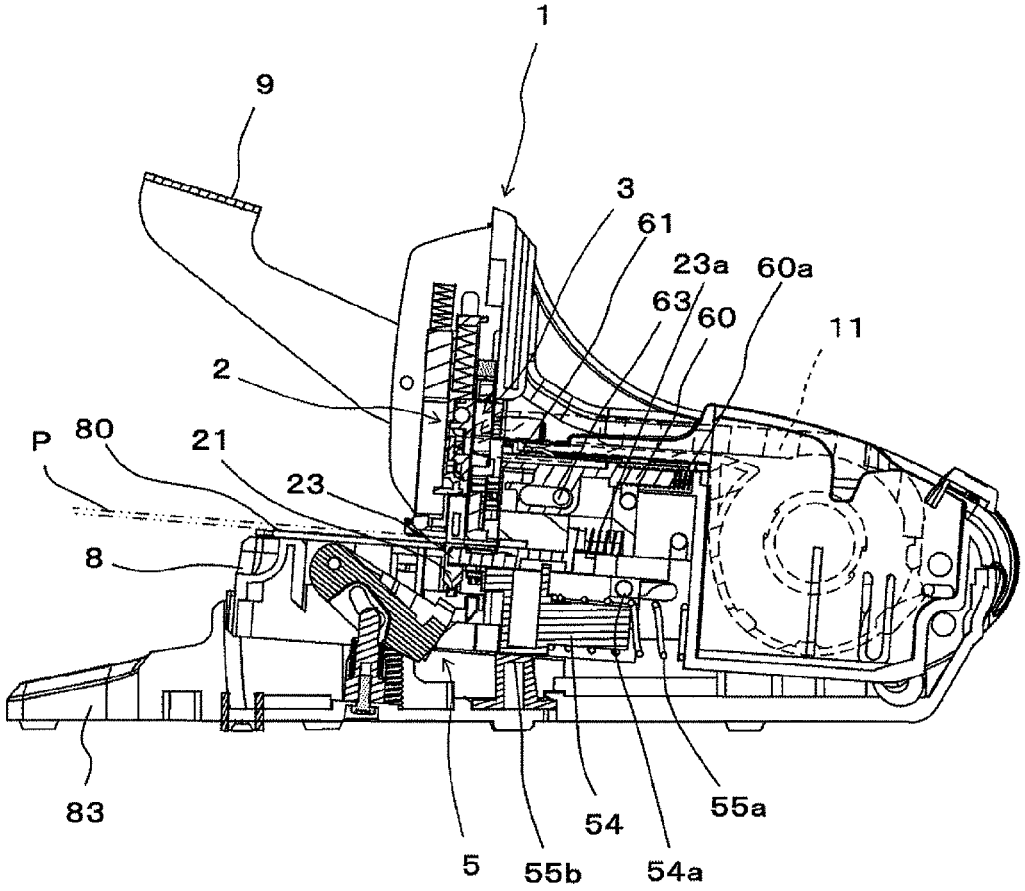
FIG. 69 is an operation chart illustrating an exemplary operation of the entire stapler.
Figure 88:
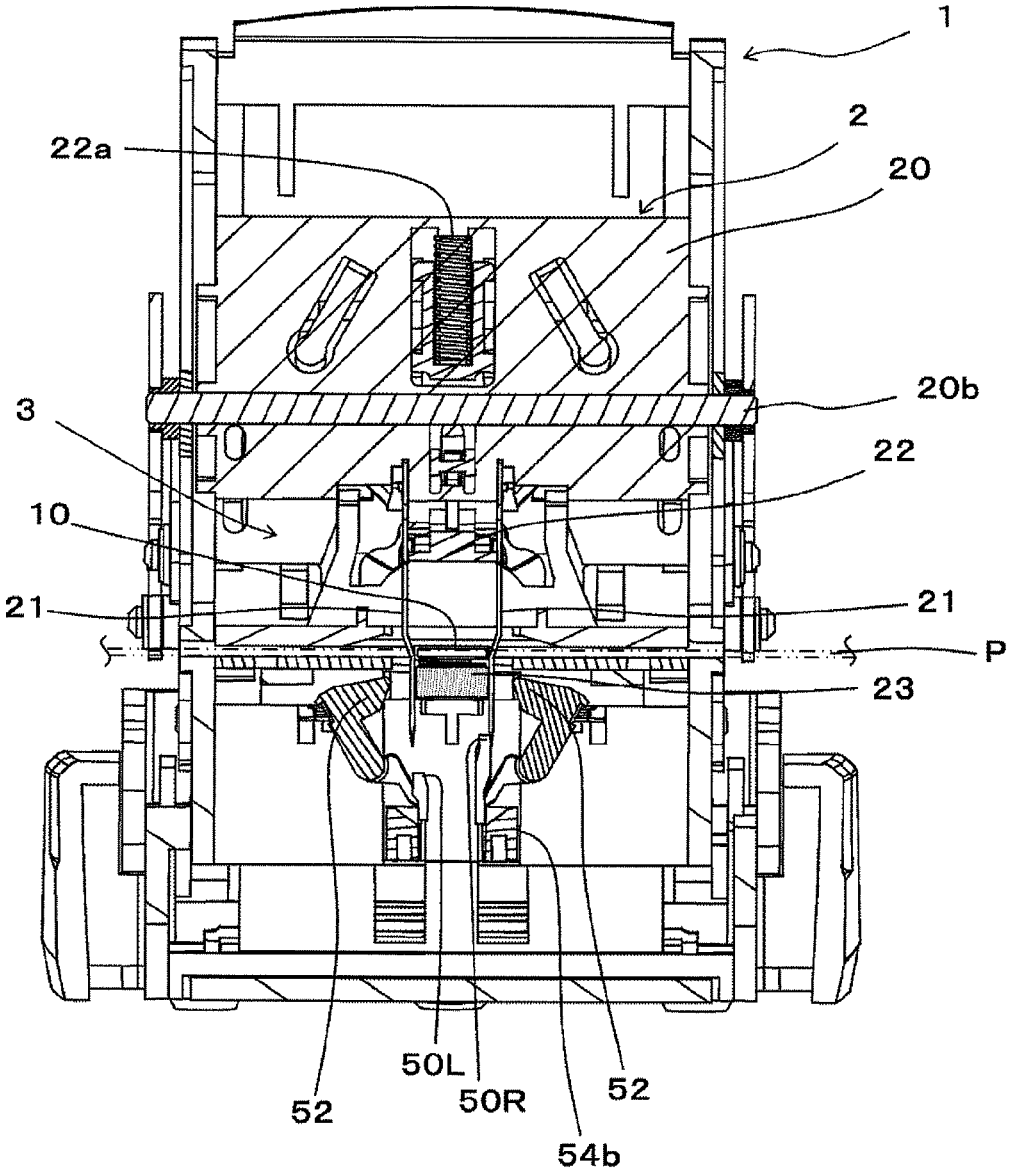
FIG. 88 is an operation chart illustrating an exemplary operation of the penetrating mechanism and the bending mechanism.

If the operating handle 9 is pushed up after the clinch is terminated, the body section 8 is rotated upwardly, and as illustrated in FIG. 69, the slide member 54 is moved forward, and runs up onto the receiving member 55*b*. Further, in association with the advance of the slide member 54, the cutting blade guide 23 is moved forward between the cutting blades while being urged by the spring 23*a*, and simultaneously, the ejecting member 52 is moved backward outwardly from the cutting blade 21, as illustrated in FIG. 88. In addition, the pusher 60 is moved forward. As described above, the feed claw 61 is engaged with the staple-materials-connecting-body 10*a* to start conveyance of the staple-materials-connecting-body 10*a* forward, by the advancing movement of the pusher 60.

Figure 96:
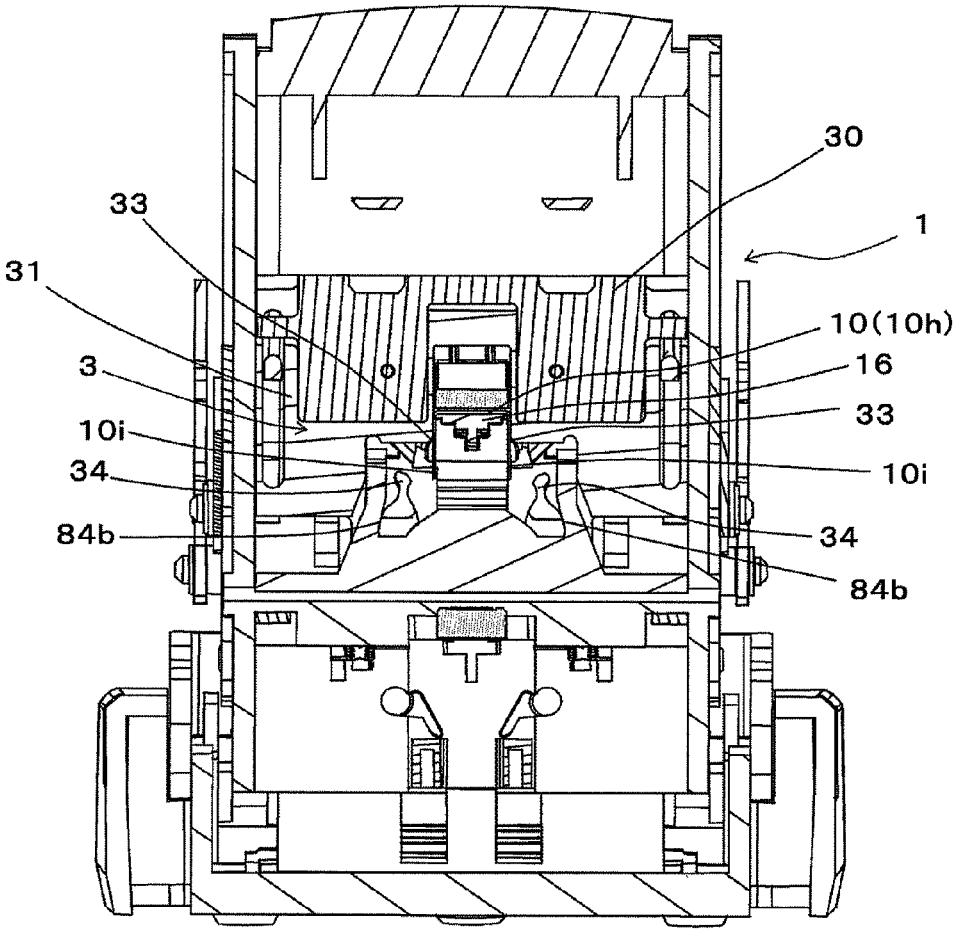
FIG. 96 is an operation chart illustrating an exemplary operation of the cutting/forming mechanism.

In the penetrating mechanism 2, as illustrated in FIG. 88, the cutting blades 21 are moved up in a direction to be withdrawn from the paper sheets P. In the cutting/forming mechanism 3, as illustrated in FIG. 96, in association with the operation of the penetrating mechanism 2, after the cutter plate 30 is moved to the retreat position lifted with respect to the forming plate 31, the forming plate 31 is moved up together with the cutter plate 30. If the forming plate 31 is moved up, the formed staple 10 starts withdrawing from the staple forming portion 33.

Further, as the cutter plate 30 and the forming plate 31 are moved up, the opening retaining members 34 abut against a close cam surface 84*b* formed on the body section 8 to start closing in the inward direction.

<Return Operation>

Figure 70:
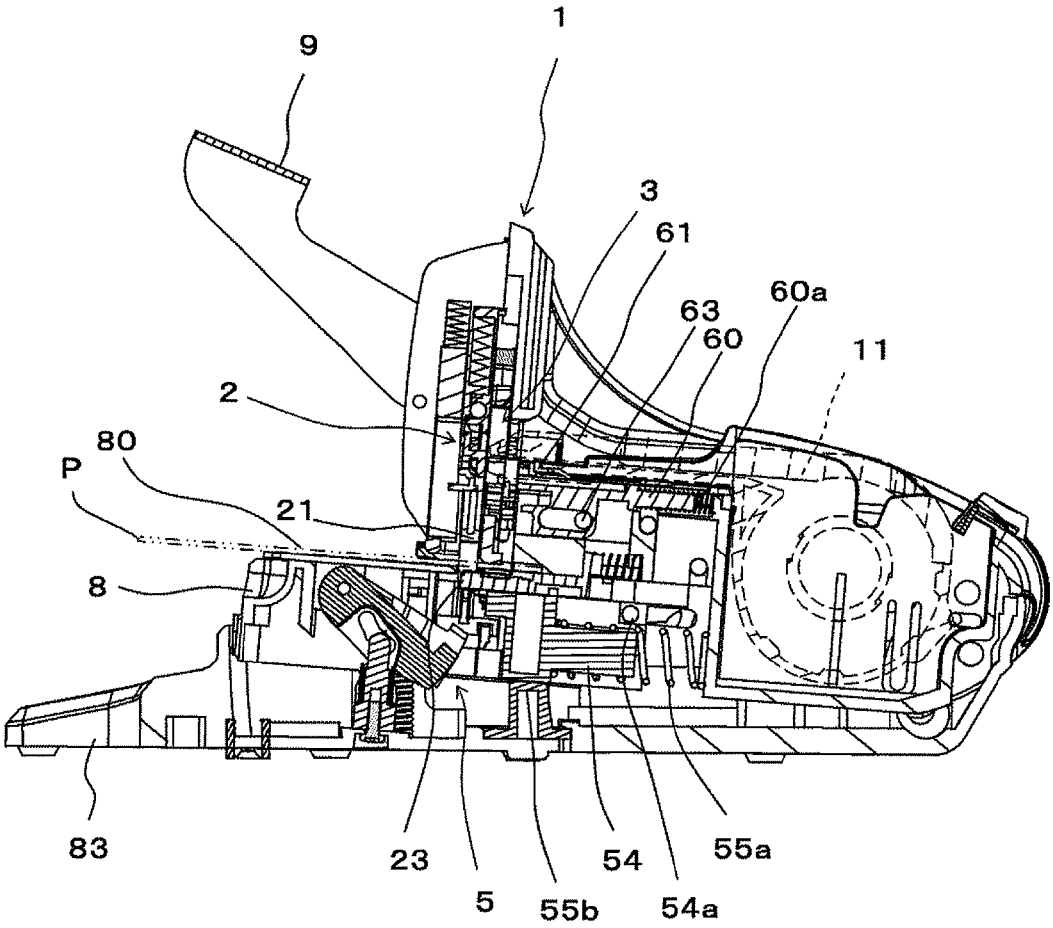
FIG. 70 is an operation chart illustrating an exemplary operation of the entire stapler.
Figure 71:
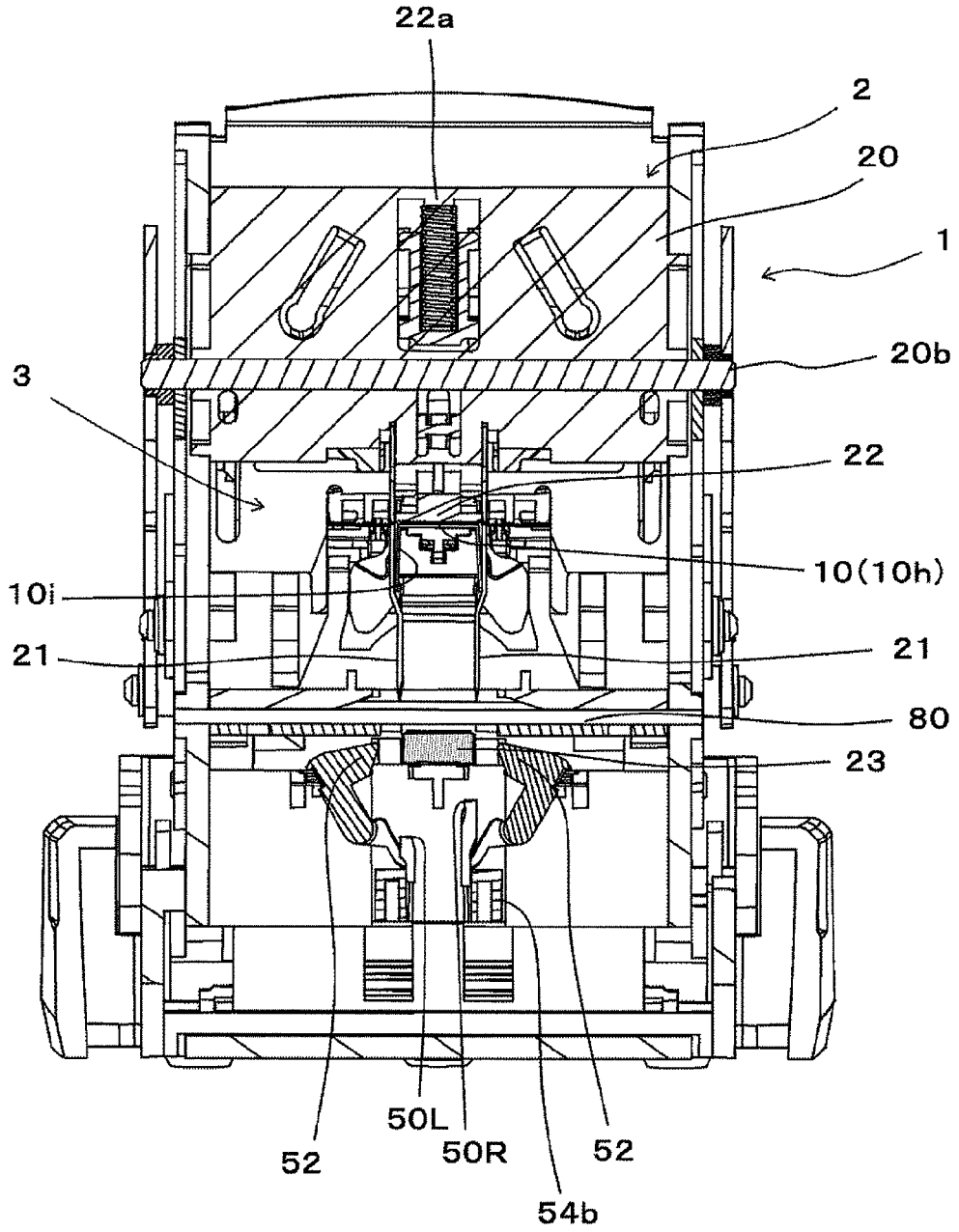
FIG. 71 is an operation chart illustrating an exemplary operation of the penetrating mechanism and a bending mechanism.

If the operating handle 9 is pushed up at the position illustrated in FIG. 70, the advancing operation of the pusher 60 is continuously performed. The advance of slide member 54 is stopped, since the pin 54*a* is separated from the elongated slot 92*b* of the link 92.

Figure 89:
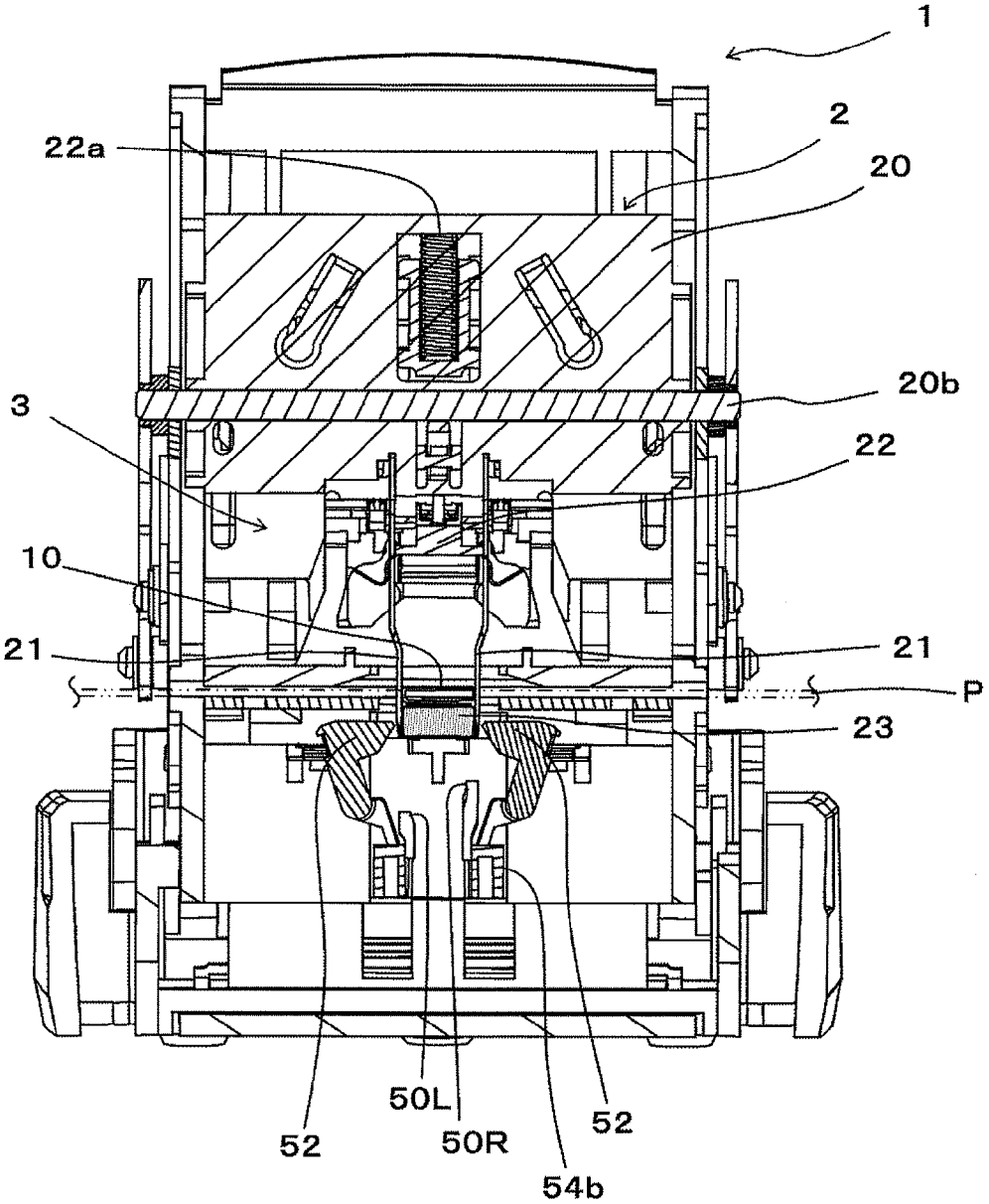
FIG. 89 is an operation chart illustrating an exemplary operation of the penetrating mechanism and the bending mechanism.
Figure 90:
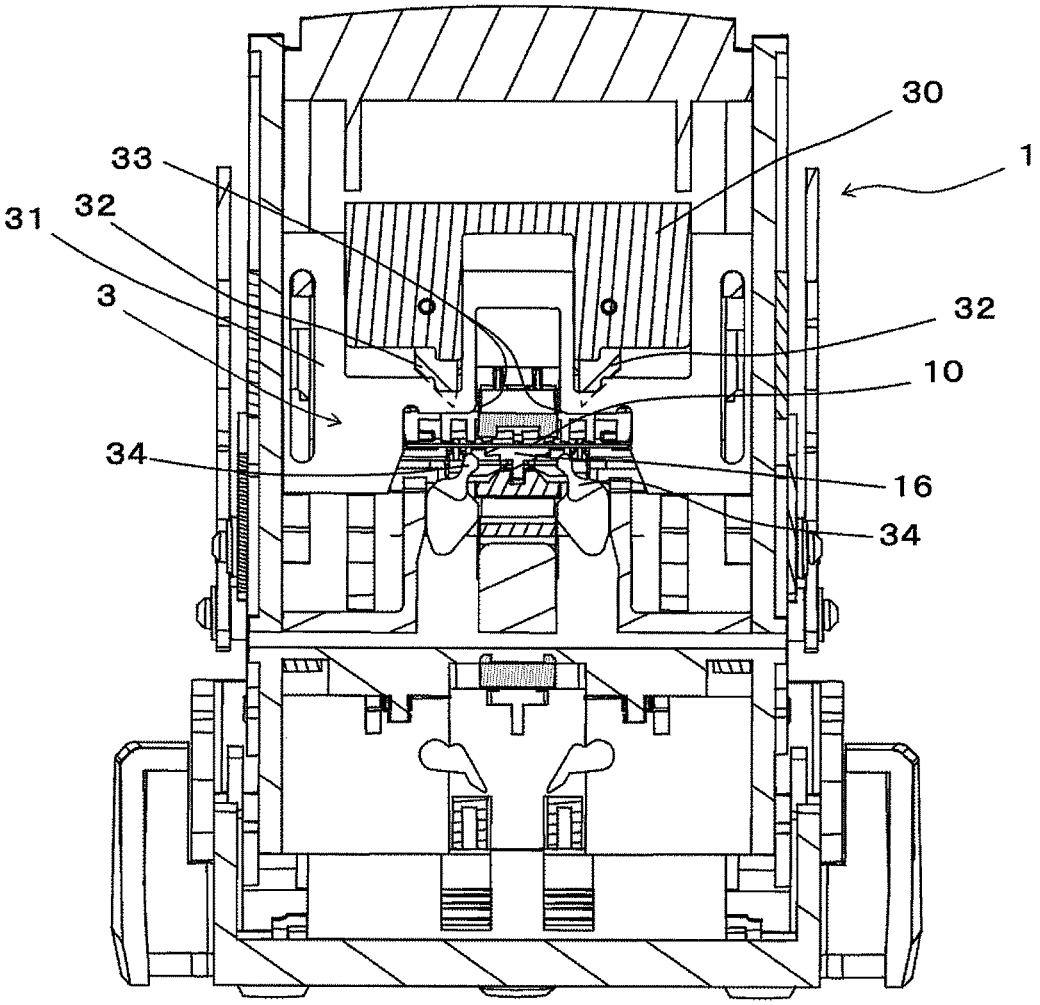
FIG. 90 is an operation chart illustrating an exemplary operation of the cutting/forming mechanism.
Figure 97:
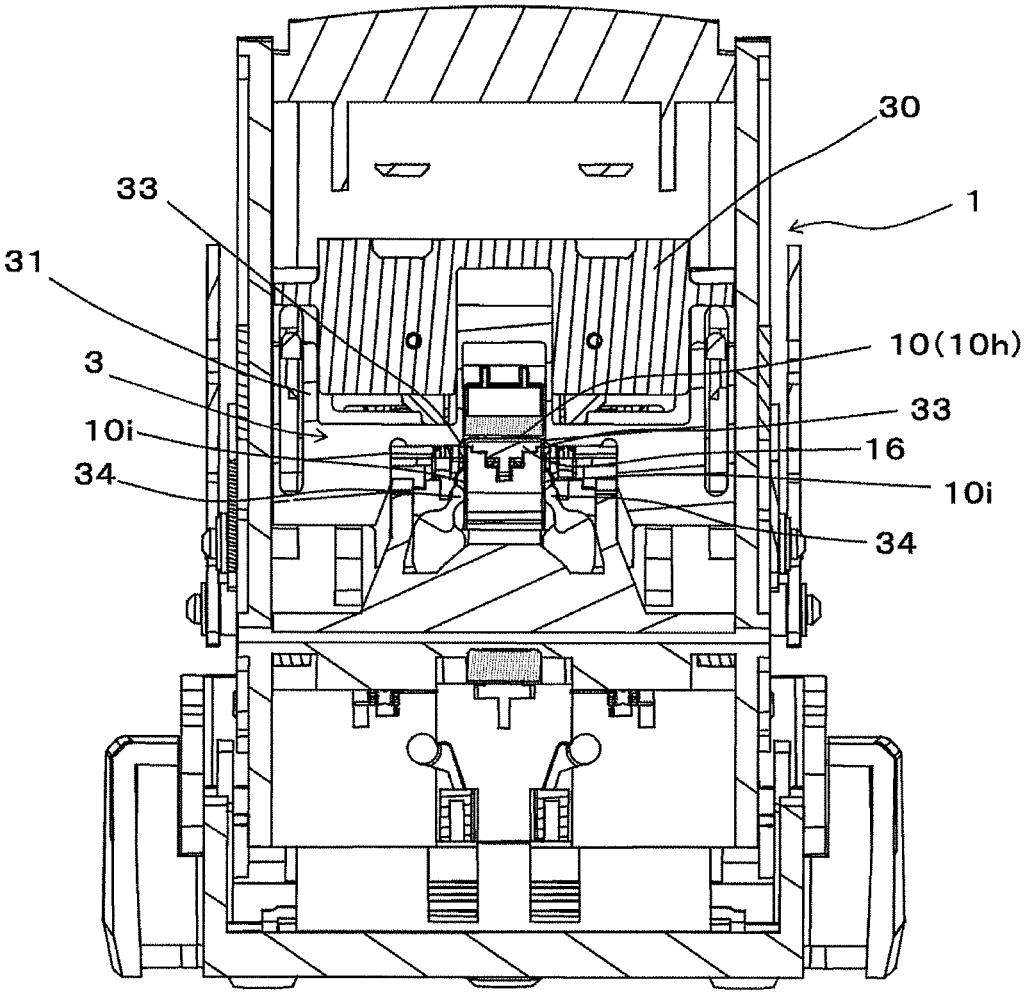
FIG. 97 is an operation chart illustrating an exemplary operation of the cutting/forming mechanism.

In the penetrating mechanism 2, as illustrated in FIG. 89, the cutting blades 21 are moved up in the direction to be withdrawn from the paper sheets P. In the cutting/forming mechanism 3, as illustrated in FIG. 97, in association with the operation of the penetrating mechanism 2, the cutter plate 30 and the forming plate 31 are moved up, and thus the opening retaining members 34 are closed, thereby preventing the leg portions 10*i* of the formed staple 10 from being opened by holding them from the outside.

Figure 52:
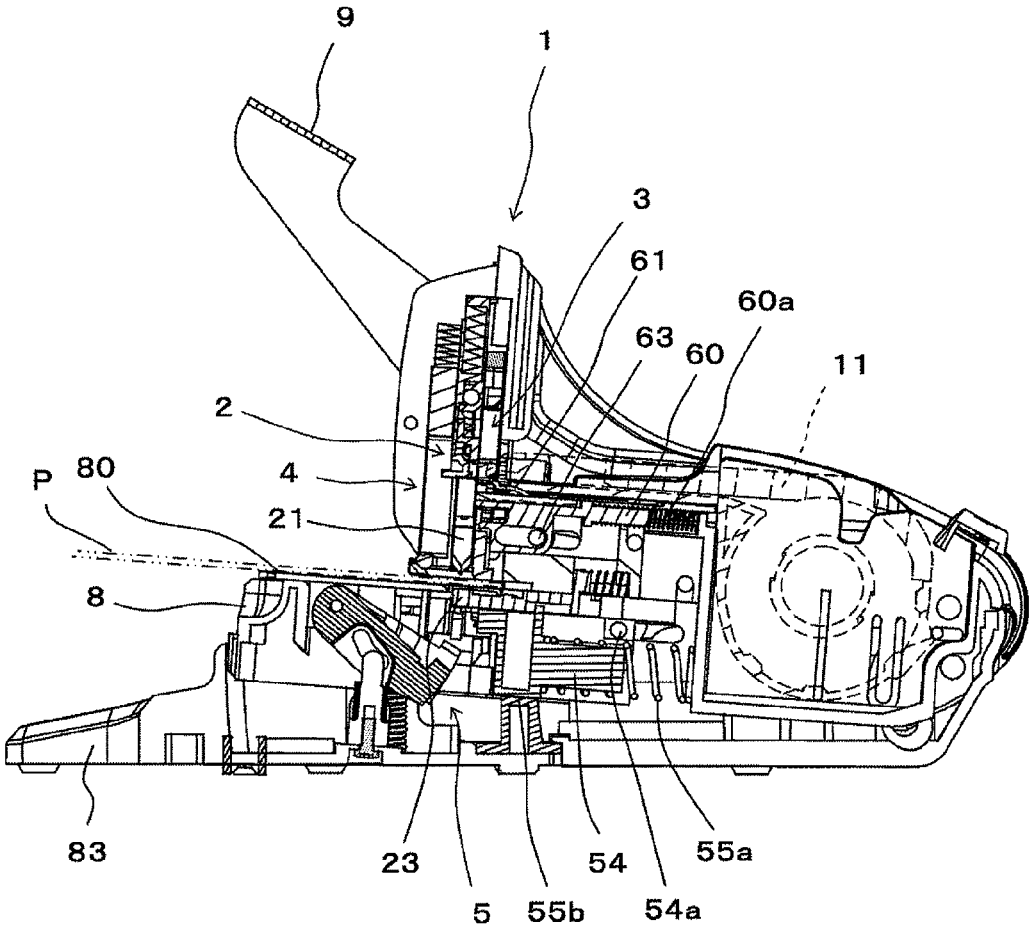
FIG. 52 is an operation chart illustrating an exemplary operation of the entire stapler.

If the operating handle 9 is returned to the standby position, as illustrated in FIG. 52, in the penetrating mechanism 2, the cutting blade 21 is withdrawn from the paper sheets P, so that the stapled paper sheets P can be ejected. Also, as the pusher 50 is moved forward, the next staple cut and formed by the cutting/forming mechanism 3 is conveyed to the penetrating mechanism 2, and is supported between the one pair of cutting blades 21. Simultaneously, the next staple-materials-connecting-body 10*a* is conveyed to the cutting/forming mechanism 3.

The present invention may be applied to a stapler manipulated by a human power or an electric motor to staple a workpiece with the staple made of a non-metal material which is a soft material, such as paper.

In accordance with embodiments of the invention, a stapler 1, in which sheets P are stapled by a non-metal staple 10 including a crown portion 10*h* and a pair of leg portions

10*i*, 10*i* respectively bent and extending in a first direction from both ends of the crown portion 10*h* in a second direction, the second direction being a longitudinal direction of the crown portion 10*h* and perpendicular to the first direction, may include: a penetrating part 2 including a pair of cutting blades 21, 21 which are disposed at an interval in the second direction, wherein holes are formed in the sheets P and the pair of leg portions 10*i*, 10*i* of the staple 10 penetrate the sheets by penetrating and withdrawing the cutting blades 21, 21 into and from the sheets P in the first direction; and a bending part 5 configured to bend the penetrated leg portions 10*i*, 10*i* along the sheets P and to bond the pair of leg portions 10*i*, 10*i* to each other. Blade portions 21*a*, 21*a* that forms the holes in the sheets P may be respectively provided in the cutting blades 21, 21 at their tip end sides in the first direction. An interval in the second direction between the pair of cutting blades 21, 21 at the tip end sides in the first direction where the blade portions 21*a*, 21*a* are provided may be narrower than an interval in the second direction between the pair of cutting blades 21, 21 at base end sides which are opposite to the tip end sides in the first direction. An inner side of one of the pair of the cutting blades 21, 21 and an inner side of the other of the pair of the cutting blades 21, 21 may be facing to each other in the second direction. Inner stepped portions may be respectively provided on the inner side of the one of the cutting blades 21, 21 and the inner side of the other of the cutting blades 21, 21 such that an interval in the second direction between the inner side of the one of the cutting blades and the inner side of the other of the cutting blades is widened from the tip end sides to the base end sides in the first direction, the inner stepped portions defining a staple support portion 21*d* adapted to support the leg portions 10*i*, 10*i* of the staple 10. Outer stepped portions may be respectively provided on an outer side of the one of the cutting blades 21, 21 which positions in an opposite side in the second direction of the inner side of the one of the cutting blades 21, 21 and an outer side of the other side of the cutting blades 21, 21 which positions in an opposite side in the second direction of the inner side of the other of the cutting blades 21, 21 such that an interval in the second direction between the outer side of the one of the cutting blades and the outer side of the other of the cutting blades is widened from the tip end sides to the base end sides in the first direction, the outer stepped portions defining a hole expansion portion 21*e* adapted to expand an interval in the second direction between the holes penetrating the sheets P during the cutting blades 21, 21 penetrating the sheets P.

According to this structure, since the tip ends of the leg portions of the staple are supported by the staple support portions formed inside the one pair of cutting blades, the staple is held between two cutting blades in a state in which the one pair of leg portions of the staple along each cutting blade.

Since the staple is driven against the workpiece together with the cutting blades and the one pair of leg portions of the staple penetrate the workpiece, the hole of the workpiece is widened outwardly when the hole expansion portion penetrates the workpiece.

In the process in which the cutting blades are withdrawn from the workpiece after the workpiece is bound with the staple, a force is applied to the cutting blades to be expanded outwardly, when the staple support portion is withdrawn from the workpiece. However, since the hole formed by the cutting blade is shaped to be widened outwardly, the resistance between the cutting blade and the workpiece is decreased.

The resistance between the cutting blade and the workpiece can be decreased by the operation of the cutting blades which penetrate the workpiece, in which the leg portions of the staple penetrate the workpiece, and the operation of the cutting blades which are withdrawn from the workpiece. Further, in the stapler manipulated by a human power, the load at a pulling-down and returning operation of an operating handle can be decreased Since the hole formed in the workpiece by the cutting blade is widened outwardly by the hole expansion portion, there is no burr inside the hole. Accordingly, when the leg portions of the staple is bent inwardly, there is no convex portion capable of deforming the crown portion or the leg portions, and the appearance of the staple binding the workpiece can be improved.

In accordance with embodiments of the invention, each of the cutting blades 21, 21 may include: a first penetrating portion 21*b* in which at the tip end side thereof in the first direction rather than the staple support portion 21*d*, the inner side of said each of the cutting blades straightly extends in the first direction which is an insertion/withdrawal direction of the cutting blade, and at the tip end side thereof in the first direction rather than the hole expansion portion 21*e*, the outer side of said each of the cutting blades straightly extends in the first direction, and a second penetrating portion 21*c* in which at the base end side thereof in the first direction rather than the staple support portion 21*d*, the inner side of said each of the cutting blades straightly extends in the first direction, and at the base end side thereof in the first direction rather than the hole expansion portion 21*e*, the outer side of said each of the cutting blades straightly extends in the first direction.

The stapler 1 may further include: a cutting blade guide adapted to restrict a displacement of the cutting blades 21, 21 such that the inner side of the one of the cutting blades 21, 21 and the inner side of the other of the cutting blades 21, 21 come close to each other in the second direction.

The stapler 1 may further include: a guide driving part 54 adapted to retreat the cutting blade guide 23 positioned between the pair of the cutting blades 21, 21, after the first penetrating portions 21*b*, 21*b* of the cutting blades 21, 21 penetrate the sheets P.

The stapler 1 may further includes: a cutting/forming part 3 that cuts one of staple materials 10*m* from a staple-materials-connecting-body 10*a* in which a plurality of straight-shape staple materials 10*m* are connected in a band-shape and forms the cut staple material 10*m* to the staple 10 having the crown portion 10*h* and leg portions 10*i*, 10*i* bent from both ends of the crown portion 10*h*, in association with an operation of the penetrating part 2 in which the staple 10 is driven and penetrates the sheets P, and a conveying part 6 that conveys the staple 10 cut from the staple-materials-connecting-body 10*a* and formed to the shape having the crown portion 10*h* and the leg portions 10*i*, 10*i* to the penetrating part 2, and conveys the staple materials 10*m* to the cutting/forming part 3.

In the staple-materials-connecting-body 10*a*, the plurality of staple materials 10*m* may be arranged such that longitudinal directions of the respective staple materials 10*m* are parallel to each other, and vicinities of both end portions in the longitudinal directions of the respective staple materials 10*m* may be connected to each other by pairs of connecting portions 10*c*. A hole 10*d* may be provided in adjacent to each of the connecting portions 10*c* between the connecting portions 10*c* in the longitudinal direction. A slit 10*d* that separates the staple materials 10*m* adjacent to each other may be provided between the respective holes 10*d*. The cutting/forming part 3 may include a pair of cutting blades 32, 32 disposed so that inclined blade edges thereof direct opposite to each other, in which with respect to one of connecting portions 10*c* and the other of connecting portions 10*c* which connect the staple materials 10*m* adjacent to each other, the blade portions 32*a* of the cutting blades 32 are pushed in directions opposed to each other against the connecting portions from the holes adjacent to the connecting portions, from an inside of each staple to an outside, to cut each connecting portion.

What is claimed is:

1. A stapler, in which sheets are stapled by a non-metal staple, the staple including a crown portion and a pair of leg portions respectively bent and extending in a first direction from both ends of the crown portion in a second direction, the second direction being a longitudinal direction of the crown portion and perpendicular to the first direction, the stapler comprising:

a penetrating part including a pair of cutting blades which are disposed at an interval in the second direction, wherein holes are formed in the sheets and the pair of leg portions of the staple penetrate the sheets by penetrating and withdrawing the cutting blades into and from the sheets in the first direction, wherein blade portions that form the holes in the sheets are respectively provided in the cutting blades at their tip end sides in the first direction, wherein an interval in the second direction between the pair of cutting blades at the tip end sides in the first direction where the blade portions are provided is narrower than an interval in the second direction between the pair of cutting blades at base end sides which are opposite to the tip end sides in the first direction, wherein an inner side of one of the pair of the cutting blades and an inner side of the other of the pair of the cutting blades are facing to each other in the second direction, wherein inner stepped portions are respectively provided on the inner side of the one of the cutting blades and the inner side of the other of the cutting blades such that an interval in the second direction between the inner side of the one of the cutting blades and the inner side of the other of the cutting blades is widened from the tip end sides to the base end sides in the first direction, the inner stepped portions defining a staple support portion adapted to support the leg portions of the staple, wherein outer stepped portions are respectively provided on an outer side of the one of the cutting blades which positions in an opposite side in the second direction of the inner side of the one of the cutting blades and an outer side of the other side of the cutting blades which positions in an opposite side in the second direction of the inner side of the other of the cutting blades such that an interval in the second direction between the outer side of the one of the cutting blades and the outer side of the other of the cutting blades is widened from the tip end sides to the base end sides in the first direction, the outer stepped portions defining a hole expansion portion adapted to expand an interval in the second direction between the holes penetrating the sheets during the cutting blades penetrating the sheets and before the staple penetrates the sheets, wherein each of the cutting blades includes:

a first penetrating portion which straightly extends in the first direction at the tip end side of the cutting blade from the staple support portion on the inner side and the hole expansion portion on the outer side; and a second penetrating portion which straightly extends in the first direction at the base end side of the cutting blade from the staple support portion on the inner side and the hole expansion portion on the outer side, and wherein the staple support portion is provided on the inner side of the cutting blade at a boundary between the first penetrating portion and the second penetrating portion.

2. The stapler according to claim 1, further comprising:

a cutting blade guide adapted to restrict a displacement of the cutting blades such that the inner side of the one of the cutting blades and the inner side of the other of the cutting blades come close to each other in the second direction.

3. The stapler according to claim 2, further comprising:

a guide driving part adapted to retreat the cutting blade guide positioned between the pair of the cutting blades, after the first penetrating portions of the cutting blades penetrate the sheets.

4. The stapler according to claim 1, further comprising:

a cutting/forming part that cuts one of staple materials from a staple-materials-connecting-body in which a plurality of straight-shape staple materials are connected in a band-shape and forms the cut staple material to the staple having the crown portion and leg portions bent from both ends of the crown portion, in association with an operation of the penetrating part in which the staple is driven and penetrates the sheets, and a conveying part that conveys the staple cut from the staple-materials-connecting-body and formed to the shape having the crown portion and the leg portions to the penetrating part, and conveys the staple materials to the cutting/forming part.

5. The stapler according to claim 4, wherein, in the staple-materials-connecting-body, the plurality of staple materials are arranged such that longitudinal directions of the respective staple materials are parallel to each other, and vicinities of both end portions in the longitudinal directions of the respective staple materials are connected to each other by pairs of connecting portions, wherein a hole is provided adjacent to each of the connecting portions between the connecting portions in the longitudinal direction, wherein a slit that separates the staple materials adjacent to each other is provided between the respective holes, and wherein the cutting/forming part includes a pair of cutting blades disposed so that inclined blade edges thereof direct opposite to each other, in which with respect to one of connecting portions and the other of connecting portions which connect the staple materials adjacent to each other, the blade portions of the cutting blades are pushed in directions opposed to each other against the connecting portions from the holes adjacent to the connecting portions, from an inside of each staple to an outside, to cut each connecting portion.

* * * * *